US006696215B2

(12) United States Patent
Yasuda et al.

(10) Patent No.: US 6,696,215 B2
(45) Date of Patent: Feb. 24, 2004

(54) SILVER HALIDE PHOTOGRAPHIC LIGHT SENSITIVE MATERIAL

(75) Inventors: Shoji Yasuda, Minami-ashigara (JP); Kohzaburoh Yamada, Minami-ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/263,165

(22) Filed: Oct. 3, 2002

(65) Prior Publication Data

US 2003/0232272 A1 Dec. 18, 2003

(30) Foreign Application Priority Data

Oct. 3, 2001 (JP) ..... 2001-307827

(51) Int. Cl.[7] ..... G03C 1/10; G03C 1/295

(52) U.S. Cl. ..... 430/264; 430/566; 430/599; 430/600; 430/603; 430/955

(58) Field of Search ..... 430/264, 566, 430/599, 600, 603, 955, 598

(56) References Cited

U.S. PATENT DOCUMENTS 5,747,235 A * 5/1998 Farid et al. ..... 430/600
5,747,236 A * 5/1998 Farid et al. ..... 430/600
5,994,051 A * 11/1999 Gould et al. ..... 430/600
6,593,075 B1 * 7/2003 Ichikawa et al. ..... 430/600

* cited by examiner

*Primary Examiner*—Richard L. Schilling
(74) *Attorney, Agent, or Firm*—Birch, Stewart, Kolasch & Birch, LLP

(57) ABSTRACT

Disclosed is a silver halide photographic light-sensitive material comprising at least one silver halide emulsion layer on a support, which contains a compound of which one-electron oxidized derivative produced by one electron oxidation of the compound is capable of releasing two or more electrons with a bond cleavage and has a characteristic curve drawn in orthogonal coordinates of logarithm of light exposure (x-axis) and optical density (y-axis) using equal unit lengths for the both axes, on which gamma is 5.0 or more for the optical density range of 0.3–3.0. This silver halide photographic light-sensitive material shows high contrast and high sensitivity.

20 Claims, 1 Drawing Sheet

SILVER HALIDE PHOTOGRAPHIC LIGHT SENSITIVE MATERIAL

TECHNICAL FIELD

The present invention relates to a silver halide photographic light-sensitive material. In particular, the present invention relates to an ultrahigh contrast negative type photographic light-sensitive material suitable as a silver halide photographic light-sensitive material used for a photomechanical process.

RELATED ART

In photomechanical processes used in the field of graphic arts, used is a method in which photographic images of continuous tone are converted into so-called dot images in which variable image density is represented by sizes of dot areas, and such images are combined with photographed images of characters or line originals to produce printing plates. For silver halide photographic light-sensitive materials used for such a purpose, ultrahigh contrast photographic characteristic enabling clear distinction between image portions and non-image portions has been required in order to obtain favorable reproducibility of characters, line originals and dot images.

As a system responding to such a requirement, there has been known the so-called lithographic development method in which a silver halide light-sensitive material comprising silver chlorobromide is treated with a hydroquinone developer having an extremely low effective concentration of sulfite ions to obtain images of high contrast. However, in this method, the developer is extremely unstable against oxidation by air since the sulfite ion concentration in the developer is extremely low, and therefore a lot of developer must be replenished in order to stably maintain the developer activity.

As image forming systems in which the instability of the image formation according to the lithographic development method is eliminated and light-sensitive materials are processed with a developer showing good storage stability to obtain ultrahigh contrast photographic characteristic, there can be mentioned those described in U.S. Pat. Nos. 4,166,742, 4,168,977, 4,221,857, 4,224,401, 4,243,739, 4,269,922, 4,272,606, 4,311,781, 4,332,878, 4,618,574, 4,634,661, 4,681,836, 5,650,746 and so forth. These are systems in which a silver halide photographic light-sensitive material of surface latent image type containing a hydrazine derivative is processed with a developer containing hydropuinone/metol or hydroquinone/phenidone as main developing agents and 0.15 mol/l or more of sulfite preservative and having pH of 11.0–12.3 to form ultrahigh contrast negative images having a gamma of 10 or higher. According to these systems, photographic characteristics of ultrahigh contrast and high sensitivity can be obtained, and because sulfite can be added to the developer at a high concentration, stability of the developer to air oxidation is markedly improved compared with conventional lithographic developers.

In order to form sufficiently ultrahigh contrast images with use of a hydrazine derivative, it is necessary to perform processing with a developer having pH of 11 or higher, usually 11.5 or higher. Although it becomes possible to increase the stability of the developer by use of a sulfite preservative at a high concentration, it is necessary to use such a developer of high pH as described above in order to obtain ultrahigh contrast photographic images, and the developer is likely to suffer from air oxidation and instable even with the presence of the preservative. Therefore, various attempts have been made in order to realize ultrahigh images with a lower pH to further improve stability of the developer.

For example, U.S. Pat. No. 4,269,929 (Japanese Patent Laid-open Publication (Kokai, henceforth referred to as "JP-A") No. 61-267759), 4,737,452 (JP-A-60-179734), 5,104,769, 4,798,780, JP-A-1-179939, JP-A-1-179940, U.S. Pat. Nos. 4,998,604, 4,994,365 and JP-A-8-272023 disclose methods of using a highly active hydrazine derivative and a nucleation accelerator in order to obtain ultrahigh images by using a developer having pH of less than 11.0.

However, since silver halide photographic light-sensitive materials used for such image-forming systems contain highly active compounds, they suffer from problems concerning storage stability such as fluctuation of sensitivity and increase of fog during storage. Most of the problems are caused due to high emulsion sensitivity, and therefore it has been desired to develop a technique for obtaining higher sensitivity with superior storage stability.

Considering these problems of the conventional techniques, an object of the present invention is to provide a silver halide photographic light-sensitive material that provides high contrast and high sensitivity.

SUMMARY OF THE INVENTION

As a result of various researches of the inventors of the present invention, they found that the aforementioned object could be achieved by a silver halide photographic light-sensitive material containing a compound of a particular structure and having a particular gamma, and accomplished the present invention.

That is, the present invention provides a silver halide photographic light-sensitive material comprising at least one silver halide emulsion layer on a support, which contains at least one compound selected from compounds of the following Types (i) to (iv) and has a characteristic curve drawn in orthogonal coordinates of logarithm of light exposure (x-axis) and optical density (y-axis) using equal unit lengths for the both axes, on which gamma is 5.0 or more for the optical density range of 0.3–3.0.

Type (i)

A compound of which one-electron oxidized derivative produced by one electron oxidation of the compound is capable of releasing two or more electrons with a bond cleavage.

Type (ii)

A compound of which one-electron oxidized derivative produced by one electron oxidation of the compound is capable of releasing one more electron with a carbon-carbon bond cleavage and which has two or more groups adsorptive to silver halide in the same molecule.

Type (iii)

A compound of which one-electron oxidized derivative produced by one electron oxidation of the compound is capable of releasing one or more electrons after undergoing a bond formation reaction.

Type (iv)

A compound of which one-electron oxidized derivative produced by one electron oxidation of the compound is capable of releasing one or more electrons after undergoing an intramolecular ring cleavage.

In the present invention, the compounds of Types (i) to (iv) are preferably compounds represented by following formulas (1-1) to (4-2).

Formula (1-1)

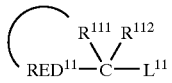

Formula (1-2)

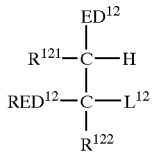

Formula (2)

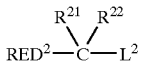

Formula (3)

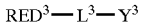

Formula (4-1)

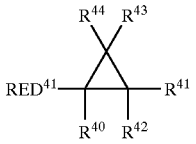

Formula (4-2)

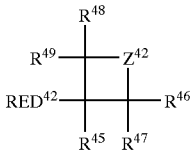

In the formula (1-1), $RED^{11}$ represents a reducing group, $L^{11}$ represents a leaving group, and $R^{112}$ represents a hydrogen atom or a substituent. $R^{111}$ represents a nonmetallic group that can form a ring structure corresponding to a tetrahydro, hexahydro or octahydro derivative of a 5- or 6-membered aromatic ring (including an aromatic heterocyclic ring) together with a carbon atom (C) and $RED^{11}$.

In the formula (1-2), $RED^{12}$ and $L^{12}$ each represent groups having the same meanings as the groups $RED^{11}$ and $L^{11}$ in the formula (1-1) respectively. $R^{121}$ and $R^{122}$ each independently represent a hydrogen atom or a substituent. $ED^{12}$ represents an electron donor group. $R^{121}$ and $RED^{12}$, $R^{121}$ and $R^{122}$ or $ED^{12}$ and $RED^{12}$ may bond to each other to form a ring structure.

In the formula (2), $RED^{2}$ represents a group having the same meaning as $RED^{12}$ in the formula (1-2). $L^{2}$ represents a carboxyl group or a salt thereof, and $R^{21}$ and $R^{22}$ each independently represent a hydrogen atom or a substituent. $RED^{2}$ and $R^{21}$ may bond to each other to form a ring structure. However, the compounds represented by the formula (2) are compounds having two or more groups adsorptive to silver halide in each molecule.

In the formula (3), $RED^{3}$ represents a group having the same meaning as $RED^{12}$ in the formula (1-2). $Y^{3}$ represents a reactive group containing a carbon-carbon double bond site or carbon-carbon triple bond site that can react with one electron oxidized derivative produced by one electron oxidization of $RED^{3}$ to form a novel bond. $L^{3}$ represents a bridging group bonding $RED^{3}$ and $Y^{3}$.

In the formulas (4-1) and (4-2), $RED^{41}$ and $RED^{42}$ each independently represent a group having the same meaning as $RED^{12}$ in the formula (1-2). $R^{40}$ to $R^{44}$ and $R^{45}$ to $R^{49}$ each independently represent a hydrogen atom or a substituent. In the formula (4-2), $Z^{42}$ represents $—CR^{420}R^{421}—$, $—NR^{423}—$ or —O—. $R^{420}$ and $R^{421}$ each independently represent a hydrogen atom or a substituent, and $R^{423}$ represents a hydrogen atom, an alkyl group, an aryl group, or a heterocyclic group.

Among the aforementioned compounds of Type (i), Type (iii) and Type (iv), more preferred are those compounds having a group adsorptive to silver halide and/or a partial structure of sensitizing dye in the molecules. Still more preferred are those having a group adsorptive to silver halide in the molecules.

The silver halide photographic light-sensitive material of the present invention preferably contains a hydrazine compound. Further, it preferably has a film surface pH of 6.0 or less, more preferably 4.5–6.0, on the emulsion layer side.

According to the present invention, there can be provided a high contrast silver halide photographic light-sensitive material that shows high sensitivity and good storage stability. The silver halide photographic light-sensitive material of the present invention is useful as an ultrahigh contrast negative type photographic light-sensitive material suitable as a silver halide photographic light-sensitive material used for a photomechanical process.

BEST MODE FOR CARRYING OUT THE INVENTION

Figure 1:
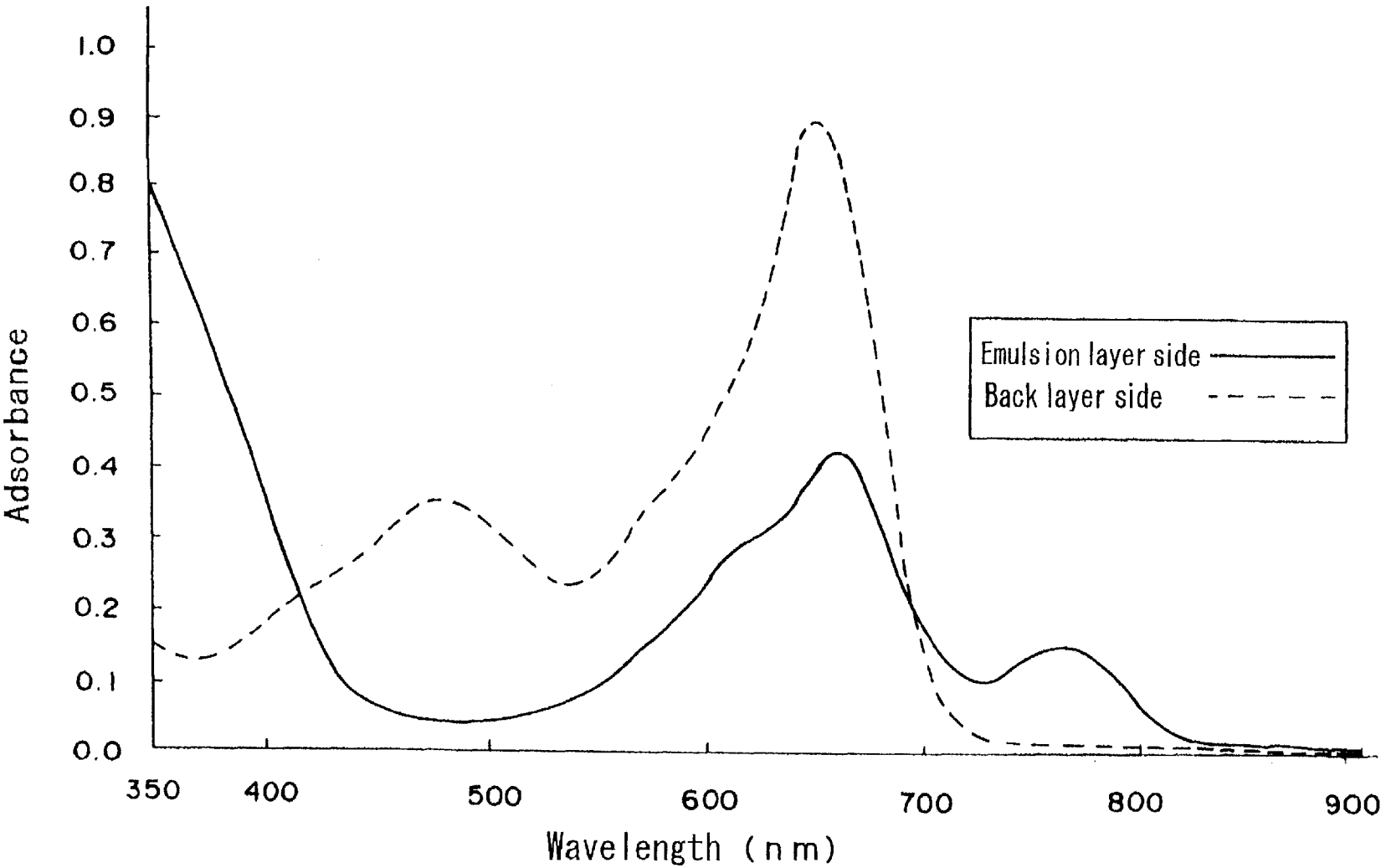
FIG. 1 shows absorption spectra for emulsion layer side and back layer side of a silver halide photographic light-sensitive material according to an embodiment of the present invention. The longitudinal axis represents absorbance (graduated in 0.1), and the transverse axis represents wavelength of from 350 nm to 950 nm. The solid line represents the absorption spectrum of the emulsion layer side, and the broken line represents the absorption spectrum of the back layer side.

The silver halide photographic light-sensitive material of the present invention will be explained in detail hereafter. In the present specification, ranges indicated with "–" mean ranges including the numerical values before and after "–" as the minimum and maximum values, respectively.

The silver halide photographic light-sensitive material of the present invention comprises at least one silver halide emulsion layer on a support. It is characterized by having a characteristic curve drawn in orthogonal coordinates of logarithm of light exposure (x-axis) and optical density (y-axis) using equal unit lengths for the both axes, on which gamma is 5.0 or more for the optical density range of 0.3–3.0 and containing at least one compound selected from compounds of Types (i) to (iv).

The "gamma" used in the present invention means inclination of a straight line connecting two points corresponding to optical densities of 0.3 and 3.0 on a characteristic curve drawn in orthogonal coordinates of optical density (y-axis) and common logarithm of light exposure (x-axis), in which equal unit lengths are used for the both axes. That is, when the angle formed by the straight line and the x-axis is represented by θ, the gamma is represented by tan θ.

In the present invention, in order to obtain the characteristic curve, the silver halide photographic light-sensitive material is processed by using a developer (ND-1 produced by Fuji Photo Film Co., Ltd) and a fixer (NF-1 produced by Fuji Photo Film Co., Ltd.) in an automatic developing machine (FG-680AG produced by Fuji Photo Film Co., Ltd) with development conditions of 35° C. for 30 seconds.

The silver halide photographic light-sensitive material of the present invention has a characteristic curve with a gamma of 5.0 or more, preferably 5.0–100, more preferably 5.0–30.

Various methods can be used as the method for obtaining a silver halide photographic light-sensitive material having the characteristic curve defined by the present invention. For example, gamma of the silver halide photographic light-sensitive material can be controlled by using silver halide emulsion containing a heavy metal that can realize high contrast (e.g., a metal belonging to Group VIII). It is particularly preferable to use a silver halide emulsion containing a rhodium compound, iridium compound, ruthenium compound or the like. Further, it is also preferable to add at least one compound selected from hydrazine derivatives, amine compounds, phosphonium compounds and so forth as a nucleating agent on the side having an emulsion layer.

The compounds of Types (i) to (iv) used in the present invention will be explained in detail hereafter.

The compound of Type (i) is a compound of which one-electron oxidized derivative produced by one electron oxidation of the compound can release two or more electrons with a subsequent bond cleavage reaction.

In the definition of the compound of Type (i), the "bond cleavage reaction" specifically means a reaction for cleavage of a carbon-carbon or carbon-silicon bond, and it may be accompanied by cleavage of carbon-hydrogen bond. The compound of Type (i) is a compound that can release two or more electrons (preferably three or more electrons), in other words, that can further be oxidized for two or more electrons (preferably three or more electrons), with a bond cleavage reaction only after it is one electron oxidized and thus becomes a one electron oxidized derivative.

Preferred compounds as the compound of Type (i) are compounds represented by the aforementioned formula (1-1) or (1-2). These compounds are compounds that can, after one electron oxidization of the reducing group represented by $RED^{11}$ or $RED^{12}$ in the formula (1-1) or (1-2), release two or more electrons, preferably three or more electrons, due to spontaneous dissociation of $L^{11}$ or $L^{12}$, that is, due to cleavage of C (carbon atom)-$L^{11}$ bond or C (carbon atom)-$L^{12}$ bond.

First, the compounds represented by the formula (1-1) will be explained in detail hereafter.

In the formula (1-1), $RED^{11}$ represents a reducing group, $L^{11}$ represents a leaving group, and $R^{112}$ represents a hydrogen atom or a substituent. $R^{111}$ represents a nonmetallic group that can form a ring structure corresponding to a tetrahydro, hexahydro or octahydro derivative of a 5- or 6-membered aromatic ring (including an aromatic heterocyclic ring) together with a carbon atom (C) and $RED^{11}$.

The reducing group that is represented by $RED^{11}$ in the formula, (1-1) and can be one electron-oxidized is a group that can bond to $R^{111}$ to form a particular ring, and specific examples thereof include divalent groups formed from the following monovalent groups by removing one hydrogen atom at a site suitable for the ring formation. Such monovalent groups include, for example, an alkylamino group, an arylamino group (anilino group, naphthylamino group etc.), a hetelocyclylamino group (benzothiazolylamino group, pyrrolylamino group etc.), an alkylthio group, an arylthio group (phenylthio group etc.), a heterocyclylthio group, an alkoxy group, an aryloxy group (phenoxy group etc.), a hetelocyclyloxy group, an aryl group (phenyl group, naphthyl group, anthranyl group etc.), an aromatic or non-aromatic heterocyclic group (specific examples of the heterocyclic ring include, for example, tetrahydroquinoline ring, tetrahydroisoquinoline ring, tetrahydroquinoxaline ring, tetrahydroquinazoline ring, indoline ring, indole ring, indazole ring, carbazole ring, phenoxazine ring, phenothiazine ring, benzothiazoline ring, pyrrole ring, imidazole ring, thiazoline ring, piperidine ring, pyrrolidine ring, morpholine ring, benzimidazole ring, benzimidazoline ring, benzoxazoline ring, 3,4-methylenedioxyphenyl ring etc.) and so forth ($RED^{11}$ will be described with names of monovalent groups hereafter for convenience). These groups may have a substituent.

Examples of the substituent include, for example, a halogen atom, an alkyl group (including an aralkyl group, a cycloalkyl group, an active methine group etc.), an alkenyl group, an alkynyl group, an aryl group, a heterocyclic group (substitution position is not particularly limited), a heterocyclic group containing a quaternized nitrogen atom (e.g., pyridinio group, imidazolio group, quinolinio group, isoquinolinio group), an acyl group, an alkoxycarbonyl group, an aryloxycarbonyl group, a carbamoyl group, a carboxyl group or a salt thereof, a sulfonylcarbamoyl group, an acylcarbamoyl group, a sulfamoylcarbamoyl group, a carbazoyl group, an oxalyl group, an oxamoyl group, a cyano group, a thiocarbamoyl group, a hydroxy group, an alkoxy group (including a group containing ethyleneoxy group or propyleneoxy group repeating units), an aryloxy group, a hetelocyclyloxy group, an acyloxy group, an (alkoxy or aryloxy) carbonyloxy group, a carbamoyloxy group, a sulfonyloxy group, an amino group, an (alkyl, aryl or heterocyclyl)amino group, an acylamino group, a sulfonamido group, a ureido group, a thioureido group, an imido group, an (alkoxy or aryloxy)carbonylamino group, a sulfamoylamino group, a semicarbazido group, a thiosemicarbazide group, a hydrazino group, an ammonio group, an oxamoylamino group, an (alkyl or aryl)sulfonylureido group, an acylureido group, an acylsulfamoylamino group, a nitro group, a mercapto group, an (alkyl, aryl or heterocyclyl)thio group, an (alkyl or aryl)sulfonyl group, an (alkyl or aryl)sulfinyl group, a sulfo group or a salt thereof, a sulfamoyl group, an acylsulfamoyl group, a sulfonylsulfamoyl group or a salt thereof, a group containing a phosphoric acid amide or phosphoric acid ester structure and so forth. These substituents may be further substituted with these substituents.

In the formula (1-1), $L^{11}$ is represents a leaving group that can be eliminated by a bond cleavage reaction only after the reducing group represented by $RED^{11}$ undergoes one electron oxidation, and it specifically represents a carboxyl group or a salt thereof or a silyl group.

When $L^{11}$ represents a salt of carboxyl group, a counter ion that forms the salt may be specifically an alkali metal ion, alkaline earth metal ion, heavy metal ion, ammonium ion, phosphonium ion or the like. When $L^{11}$ represents a silyl group, the silyl group specifically represents a trialkylsilyl group, an aryldialkylsilyl group, a triarylsilyl group or the like, wherein the alkyl group may be methyl group, ethyl group, benzyl group, tert-butyl group or the like, and the aryl group may be phenyl group or the like.

In the formula (1-1), $R^{112}$ represents a hydrogen atom or a substituent that can substitute on a carbon atom. When $R^{112}$ represents a substituent that can substitute on a carbon atom, the substituents mentioned for $RED^{11}$ having a substituent can be mentioned as specific examples of the substituent. However, $R^{112}$does not represent the same group as $L^{11}$.

In the formula (1-1), $R^{111}$ represents a nonmetallic group that can form a particular 5- or 6-membered ring structure together with a carbon atom (C) and $RED^{11}$. The particular 5- or 6-membered ring structure formed by $R^{111}$ means a ring structure corresponding to a tetrahydro, hexahydro or octahydro derivative of a 5- or 6-membered aromatic ring (including an aromatic heterocyclic ring). The hydro derivatives used herein mean ring structures derived from aromatic rings (including aromatic heterocyclic rings) of which carbon-carbon double bonds (or carbon-nitrogen double bonds) contained in the ring are partially hydrogenated. A tetrahydro derivative means such a structure in which two of carbon-carbon double bonds (or carbon-nitrogen double bonds) are hydrogenated, a hexahydro derivative means such a structure in which three of carbon-carbon double bonds (or carbon-nitrogen double bonds) are hydrogenated, and an octahydro derivative means such a structure in which four of carbon-carbon double bonds (or carbon-nitrogen double bonds) are hydrogenated. By the hydrogenation, an aromatic ring becomes a partially hydrogenated non-aromatic ring structure.

Specifically, examples of monocyclic 5-membered ring include pyrrolidine ring, imidazolidine ring, thiazolidine ring, pyrazolidine ring, oxazolidine ring etc., which correspond to tetrahydro derivatives of aromatic rings of pyrrole ring, imidazole ring, thiazole ring, pyrazole ring, oxazole ring etc. Examples of monocyclic 6-membered ring include tetrahydro derivatives of aromatic rings such as pyridine ring, pyridazine ring, pyrimidine ring and pyrazine ring, and there can be mentioned, for example, piperidine ring, tetrahydropyridine ring, tetrahydropyrimidine ring, piperazine ring and so forth. Examples of condensed rings of 6-membered ring include tetralin ring, tetrahydroquinoline ring, tetrahydroisoquinoline ring, tetrahydroquinazoline ring, tetrahydroquinoxaline ring etc., which correspond to tetrahydro derivatives of aromatic rings of naphthalene ring, quinoline ring, isoquinoline ring, quinazoline ring, quinoxaline ring etc. Examples of tricyclic compound include tetrahydrocarbazole ring, which is a tetrahydro derivative of carbazole ring, octahydrophenanthridine ring, which is a octahydro derivative of phenanthridine ring, and so forth.

These ring structures may further have a substituent, and examples of the substituent include the same substituents explained as substituents of $RED^{11}$. Substituents of these ring structure may bond to each other to form a ring, and such a newly formed ring is a non-aromatic carbon ring or heterocyclic ring.

The preferred range of the compound represented by the formula (1-1) will be explained hereafter.

In the formula (1-1), $L^{11}$ is preferably a carboxyl group or a salt thereof. The counter ion of the salt is preferably an alkali metal ion or ammonium ion, and an alkali metal ion (especially $Li^+$, $Na^+$ or $K^+$ ion) is most preferred.

In the formula (1-1), $RED^{11}$ is preferably an alkylamino group, an arylamino group, a hetelocyclylamino group, an aryl group or an aromatic or a non-aromatic heterocyclic group. Among these, the heterocyclic group is preferably tetrahydroquinolinyl group, tetrahydroquinoxalinyl group, tetrahydroquinazolinyl group, indolyl group, indolenyl group, carbazolyl group, phenoxazinyl group, phenothiazinyl group, benzothiazolinyl group, pyrrolyl group, imidazolyl group, thiazolidinyl group, benzimidazolyl group, benzimidazolinyl group, 3,4-methylenedioxyphenyl-1-yl group or the like. More preferred are an arylamino group (especially anilino group) and an aryl group (especially phenyl group)

When $RED^{11}$ represents an aryl group, the aryl group preferably has at least one electron donor group. Specifically, the electron donor group is a hydroxy group, an alkoxy group, a mercapto group, a sulfonamido group, an acylamino group, an alkylamino group, an arylamino group, a hetelocyclylamino group, an active methine group, an aromatic heterocyclic groups having excessive electrons (e.g., indolyl group, pyrrolyl group, imidazolyl group, benzimidazolyl group, thiazolyl group, benzothiazolyl group, indazoilyl group etc.), a non-aromatic nitrogen-containing heterocyclic group that substitutes at a nitrogen atom (pyrrolidinyl group, indolinyl group, piperidinyl group, piperazinyl group, morpholino group etc.) or the like. The active methine group used herein means a methine group substituted with two of electron-withdrawing groups, and the electron-withdrawing group means an acyl group, an alkoxycarbonyl group, an aryldxycarbonyl group, a carbamoyl group, an alkylsulfonyl group, an arylsulfonyl group, a sulfamoyl group, a trifluoromethyl group, a cyano group, a nitro group or an imino group. Two of the electron-withdrawing groups may bond to each other to form a ring structure.

When $RED^{11}$ represents an aryl group, preferred substituents of the aryl group are an alkylamino group, a hydroxy group, an alkoxy group, a mercapto group, a sulfonamido group, an active methine group and a non-aromatic nitrogen-containing heterocyclic group that substitutes at a nitrogen atom, more preferred are an alkylamino group, a hydroxy group, an active methine group and a non-aromatic nitrogen-containing heterocyclic group that substitutes at a nitrogen atom, and the most preferred are an alkylamino group, and a non-aromatic nitrogen-containing heterocyclic group that substitutes at a nitrogen atom.

In the formula (1-1), $R^{112}$ preferably represents a hydrogen atom, an alkyl group, an aryl group (phenyl group etc.), an alkoxy group (methoxy group, ethoxy group, benzyloxy group etc.), a hydroxy group, an alkylthio group (methylthio group, butylthio group etc.), an amino group, an alkylamino group, an arylamino group or a hetelocyclylamino group, more preferably a hydrogeniatom, an alkyl group, an alkoxy group, a phenyl group, or an alkylamino group.

In the formula (1-1), $R^{111}$ preferably represents a nonmetallic group that can form any of the following particular 5- or 6-membered ring structures together with a carbon atom (C) and $RED^{11}$. That is, there are mentioned pyrrolidine ring, imidazolidine ring etc. corresponding to tetrahydro derivatives of pyrrole ring, imidazole ring etc., which are monocyclic 5-membered aromatic rings; tetrahydro derivatives or hexahydro derivatives of pyridine ring, pyridazine ring, pyrimidine ring and pyrazine ring, which are monocyclic 6-membered aromatic rings (e.g., piperidine ring, tetrahydropyridine ring, tetrahydropyrimidine ring, piperazine ring etc.); tetralin ring, tetrahydroquinoline ring, tetrahydroisoquinoline ring, tetrahydroquinazoline ring, tetrahydroquinoxaline ring etc. corresponding to tetrahydro derivatives of naphthalene ring, quinoline ring, isoquinoline ring, quinazoline ring and quinoxaline ring, which are condensed 6-membered aromatic rings; hydro derivatives of tricyclic aromatic rings such as tetrahydrocarbazole ring, which is a tetrahydro derivative of carbazole ring, octahydrophenanthridine ring, which is an octahydro derivative of phenanthridine ring, and so forth.

The ring structure formed by $R^{111}$ is more preferably pyrrolidine ring, imidazolidine ring, piperidine ring, tetrahydropyridine ring, tetrahydropyrimidine ring, piperazine ring, tetrahydroquinoline ring, tetrahydroquinazoline ring, tetrahydroquinoxaline ring or tetrahydrocarbazole ring, particularly preferably pyrrolidine ring, piperidine ring, piperazine ring, tetrahydroquinoline ring, tetrahydroquinazoline ring, tetrahydroquinoxaline ring or tetrahydrocarbazole ring, most preferably pyrrolidine ring, piperidine ring or tetrahydroquinoline ring.

The compound represented by the formula; (1-2) will be explained in detail hereafter.

In the formula (1-2), $RED^{12}$ and $L^{12}$ are groups having the same meaning as those of $RED^{11}$ and $L^{11}$ in the formula (1-1), respectively, and the preferred ranges thereof are also the same. However, $RED^{12}$ is a monovalent group except for the case that it forms the ring structure mentioned below, and specific examples thereof include the groups mentioned for $RED^{11}$ with names of monovalent groups. $R^{121}$ and $R^{122}$ are groups having the same meanings as that of $R^{112}$ in the formula (1-1), and the preferred ranges thereof are also the same. $ED^{12}$ represents an electron donor group. $R^{121}$ and $RED^{12}$, $R^{121}$ and $R^{122}$ or $ED^{12}$ and $RED^{12}$ may bond to each other to form a ring structure.

The electron donor group represented by $ED^{12}$ in the formula (1-2) is a hydroxy group, an alkoxy group, a mercapto group, an alkylthio group, an arylthio group, a heterocyclylthio group, a sulfonamido group, an acylamino group, an alkylamino group, an arylamino group, a hetelocyclylamino group, an activemethine group, an aromatic heterocyclic group having excessive electrons (e.g., indolyl group, pyrrolyl group, imidazolyl group etc.), a non-aromatic nitrogen-containing heterocyclic group that substitutes at a nitrogen atom (pyrrolidinyl group, piperidinyl group, indolinyl group, piperazinyl group, morpholino group etc.) or an aryl group substituted with any of these electron donor groups (e.g., p-hydroxyphenyl group, p-dialkylaminophenyl group, o,p-dialkoxyphenyl group, 4-hydroxynaphthyl group etc.). The active methine group may be the same as that explained as a substituent of aryl group represented by $RED^{11}$.

$ED^{12}$ is preferably a hydroxy group, an alkoxy group, a mercapto group, a sulfonamido group, an alkylamino group, an arylamino group, an active methine group, an aromatic heterocyclic group having excessive electrons, a non-aromatic nitrogen-containing heterocyclic group that substitutes at a nitrogen atom or a phenyl group substituted with any of these electron donor groups. Preferred are a hydroxy group, a mercapto group, a sulfonamido group, an alkylamino group, an arylamino group, an active methine group, a non-aromatic nitrogen-containing heterocyclic group that substitutes at a nitrogen atom and a phenyl group substituted with any of these electron donor groups (e.g., p-hydroxyphenyl group, p-dialkylaminophenyl group, o,p-dialkoxyphenyl group etc.).

In the formula (1-2), $R^{122}$ and RED 12, $R^{122}$ and $R^{121}$ or $ED^{12}$ and $RED^{12}$may bond to each other to form a ring structure. The ring formed in this case is a non-aromatic carbon ring or heterocyclic ring, and it may have a substituted or unsubstituted 5- to 7-membered monocyclic or condensed ring structure.

Specific examples of the ring structure formed by $R^{122}$ and $RED^{12}$ include pyrrolidine ring, pyrroline ring, imidazolidine ring, imidazoline ring, thiazolidine ring, thiazoline ring, pyrazolidine ring, pyrazoline ring, oxazolidine ring, oxazoline ring, indan ring, piperidine ring, piperazine ring, morpholine ring, tetrahydropyridine ring, tetrahydropyrimidine ring, indoline ring, tetralin ring, tetrahydroquinoline ring, tetrahydroisoquinoline ring, tetrahydroquinoxaline ring, tetrahydro-1,4-oxazine ring, 2,3-dihydrobenz-1,4-oxazine ring, tetrahydro-1,4-thiazine ring, 2,3-dihydrobenzo-1,4-thiazine ring, 2,3-dihydrobenzofuran ring, 2,3-dihydrobenzothiophene ring and so forth.

When $ED^{12}$ and $RED^{12}$ form a ring structure, $ED^{12}$ preferably represents an amino group, an alkylamino group or an arylamino group, and specific examples of the formed ring structure include tetrahydropyrazine ring, piperazine ring, tetrahydroquinoxaline ring, tetrahydroisoquinoline ring and so forth.

When $R^{12}$ and $R^{121}$ form a ring structure, specific example of the ring structure include cyelohexane ring, cyclopentane ring and so forth.

Among the compounds represented by the formula (1-1), still more preferred are compounds represented by following formulas (10) to (12), and among the compounds represented by the formula (1-2), still more preferred are compounds represented by the following formulas (13) and (14).

Formula (10)

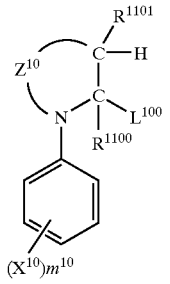

Formula (11)

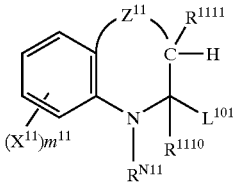

Formula (12)

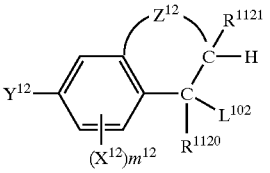

Formula (13)

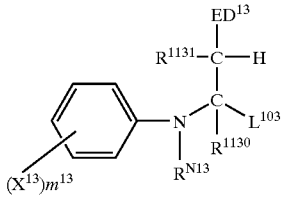

Formula (14)

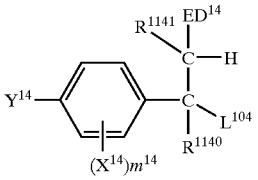

In the formulas (10) to (14), $L^{100}$, $L^{101}$, $L^{102}$, $L^{103}$ and $L^{104}$ are groups having the same meanings as that of $L^{11}$ in the formula (1-1), and the preferred ranges thereof are also the same. $R^{1100}$ and $R^{1101}$, $R^{1110}$ and $R^{1111}$, $R^{1120}$, $R^{1121}$, $R^{1130}$ and $R^{1131}$, $R^{1140}$ and $R^{1141}$ are groups having the same meanings as those of $R^{121}$and $R^{122}$in the formula (1-2), respectively, and the preferred ranges thereof are also the same. $ED^{13}$ and $ED^{14}$ represent a group having the same meaning as $ED^{12}$ in the formula (1-2), and the preferred ranges thereof are also the same.

$X^{10}$, $X^{11}$, $X^{12}$, $X^{13}$ and $X^{14}$ each represent a substituent that can substitute on a benzene ring. $m^{10}$, $m^{11}$, $m^{12}$, $m^{13}$ and $m^{14}$each represent an integer of 0–3, and when these represent an integer of 2 or more, two or more of $X^{10}$, $X^{11}$, $X^{12}$, $X^{13}$ and $X^{14}$ may be the identical to or different from each other or one another. $Y^{12}$ and $Y^{14}$ represent an amino group, an alkylamino group, an arylamino group, a non-aromatic nitrogen-containing heterocyclic group that substitutes at a nitrogen atom (pyrrolyl group, piperidinyl group, indolinyl group, piperazino group, morpholino group etc.), a hydrpxy group or an alkoxy group.

$Z^{10}$, $Z^{11}$ and $Z^{12}$ represent a nonmetallic group that can form a particular ring structure. The particular ring structure formed by $Z^{10}$ is a ring structure corresponding to a tetrahydro or hexahydro derivative of a 5- or 6-membered monocyclic or condensed ring nitrogen-containing heterocyclic ring. Specific examples thereof include pyrrolidine ring, imidazolidine ring, thiazolidine ring, pyrazolidine ring, piperidine ring, tetrahydropyridine ring, tetrahydropyrimidine ring, piperazine ring, tetrahydroquinoline ring, tetrahydroisoquinoline ring, tetrahydroquinazoline ring, tetrahydroquinoxaline ring and so forth. Specific examples of the particular ring structure formed by $Z^{11}$ include tetrahydroquinoline ring and tetrahydroquinoxaline ring. Specific examples of the particular ring structure formed by $Z^{12}$ include tetralin ring, tetrahydroquinoline ring and tetrahydroisoquinoline ring.

$R^{N11}$ and $R^{N13}$ each represent a hydrogen atom or a substituent that can substitute on a nitrogen atom. Specific examples of the substituent include an alkyl group, an alkenyl group, an alkynyl group, an aryl group, a heterocyclic group and an acyl group, and preferred are an alkyl group and an aryl group.

As specific examples of the substituent that can substitute on the benzene ring represented by $X^{10}$, $X^{11}$, $X^{12}$, $X^{13}$ and $X^{14}$, the same substituents as those of $RED^{11}$ in the formula (1-1) can be mentioned. It is preferably a halogen atom, an alkyl group, an aryl group, a heterocyclic group, an acyl group, an alkoxycarbonyl group, an aryloxycarbonyl group, a carbamoyl group, a cyano group, an alkoxy group (including a group containing ethyleneoxy group or propyleneoxy group repeating units), an (alkyl, aryl or heterocyclyl) amino group, an acylamino group, a sulfonamido group, a ureido group, a thioureido group, an imido group, an (alkoxy or aryloxy)carbonylamino group, a nitro group, an (alkyl, aryl or heterocyclyl)thio group, an (alkyl or aryl)sulfonyl group, a sulfamoyl group or the like.

$m^{10}$, $m^{11}$, $m^{12}$, $m^{13}$ and $m^{14}$ preferably represent 0–2, more preferably 0 or 1.

$Y^{12}$ and $Y^{14}$ preferably represent an alkylamino group, an arylamino group, a non-aromatic nitrogen-containing heterocyclic group that substitutes at a nitrogen atom, a hydroxy group or an alkoxy group, more preferably an alkylamino group, a non-aromatic 5- or 6-membered nitrogen-containing heterocyclic group that substitutes at a nitrogen atom or a hydroxy group, most preferably an alkylamino group (especially dialkylamino group) or a non-aromatic 5- or 6-membered nitrogen-containing heterocyclic group that substitutes at a nitrogen atom.

In the formula (13), $R^{1131}$ and $X^{13}$, $R^{1131}$ and $R^{N13}$, $R^{1130}$ and $X^{13}$ or $R^{1130}$ and $R^{N13}$ may bond to each other to form a ring structure. Moreover, in the formula (14), $R^{1141}$ and $X^{14}$, $R^{1141}$ and $R^{1140}$, $ED^{14}$ and $X^{14}$ or $R^{1140}$ and $X^{14}$ may bond to each other to form a ring structure. The ring formed in these cases is a non-aromatic carbon ring or heterocyclic ring, and it may have a substituted or unsubstituted 5- to 7-membered monocyclic or condensed ring structure.

The compounds of the formula (13) where $R^{1131}$ and $X^{13}$ bond to each other to form a ring structure or $R^{1131}$ and $R^{N13}$ bond to each other to form a ring structure as well as those compounds that do not form such a ring structure are preferred examples of the compounds of the formula (13).

Specific examples of the ring structure formed by $R^{1131}$ and $X^{13}$ bonding to each other in the formula (13) include indoline ring ($R^{1131}$ represents a single bond in this case), tetrahydroquinoline ring, tetrahydroquinoxaline ring, 2,3-dihydrobenz-1,4-oxazine ring, 2,3-dihydrobenzo-1,4-thiazine ring and so forth. Particularly preferred are indoline ring, tetrahydroquinoline ring and tetrahydroquinoxaline ring.

Specific examples of the ring structure formed by $R^{1113}$ and $R^{N13}$ in the formula (13) include pyrrolidine ring, pyrroline ring, imidazolidine ring, imidazoline ring, thiazolidine ring, thiazoline ring, pyrazolidine ring, pyrazoline ring, oxazolidine ring, oxazoline ring, piperidine ring, piperazine ring, morpholine ring, tetrahydropyridine ring, tetrahydropyrimidine ring, indoline ring, tetrahydroquinoline ring, tetrahydroisoquinoline ring, tetrahydroquinoxaline ring, tetrahydro-1,4-oxazine ring, 2,3-dihydrobenz-1,4-oxazine ring, tetrahydro-1,4-thiazine ring, 2,3-dihydrobenzo-1,4-thiazine ring, 2,3-dihydrobenzofuran ring, 2,3-dihydrobenzothiophene ring and so forth. Particularly preferred are pyrrolidine ring, piperidine ring, tetrahydroquinoline ring and tetrahydroquinoxaline ring.

The compounds of the formula (14) where $R^{1141}$ and $X^{14}$ bond to each other to form a ring and the compounds of the formula (14) where $ED^{14}$ and $X^{14}$ bond to each other to form a ring as well as the compounds where such a ring structure is not formed are preferred examples of the compound represented by the formula (14). Examples of the ring structure formed by $R^{1141}$ and $X^{14}$ bonding to each other in the formula (14) include indan ring, tetralin ring, tetrahydroquinoline ring, tetrahydroisoquinoline ring, indoline ring and so forth. Examples of the ring formed by $ED^{14}$ and $X^{14}$bonding to each other include tetrahydroisoquinoline ring, tetrahydrocinnoline ruing and so forth.

The compound of Type (ii) will be explained hereafter.

The compound of Type (ii) is a compound that, can, only after it undergoes one electron oxidation and becomes one electron oxidized derivative, release one more electron with a carbon-carbon bond cleavage reaction, in other wards, further undergo one electron oxidation. The bond cleavage reaction means a reaction for cleavage of a carbon-carbon bond, and it may be accompanied by cleavage of carbon-hydrogen bond.

Among the compounds of Type (ii), preferred compounds are those represented by the formula (2). The compound of Type (ii) is a compound that can release one electron along with spontaneous dissociation of $L^2$ by a bond cleavage reaction, i.e., cleavage of C (carbon atom)-$L^2$ bond, after the reducing group represented by $RED^2$ undergoes one electron oxidation.

However, the compound of Type (ii) is a compound having two or more groups adsorptive to silver halide in the molecule. More preferably, it is a compound having two or more nitrogen-containing heterocyclic groups substituted with a mercapto group as the adsorptive groups. The adsorptive group will be explained later.

In the formula (2), $RED^2$ represents a group having the same meaning as that of $RED^{12}$in the formula (1-2), and the preferred range thereof is also the same. $L^2$ represents a carboxyl group or a salt thereof. The counter ion that forms the salt may be the same as the counter ion explained for $L^{11}$ in the formula (1-1), and the preferred range is also the same. $R^{21}$ and $R^{22}$ represent a hydrogen atom or a substituent. These are groups having the same meanings as that of $R^{112}$ in the formula (1-1), and the preferred ranges are also the same. $RED^2$ and $R^{21}$ may bond to each other to form a ring structure.

The ring structure formed in this case is a non-aromatic 5- to 7-membered carbon ring or heterocyclic ring, which may be monocyclic ring or condensed ring and may have a substituent. Specific examples of the ring structure include, for example, indoline ring, 2,3-dihydrobenzothiophene ring, 2,3-dihydrobenzofuran ring, 1,2-dihydropyridine ring, 1,4-dihydropyridine ring, benzo-a-pyran ring, benzothiazoline ring, benzoxazoline ring, benzimidazoline ring, 1,2-dihydroquinoline ring, 1,2-dihydroquinazoline ring, 1,2-dihydroquinoxaline ring, chroman ring, isochroman ring and so forth. Preferred are indoline ring, 2,3-dihydrobenzothiophene ring, 1,2-dihydropyridine ring, benzothiazoline ring, benzoxazoline ring, benzimidazoline ring, 1,2-dihydroquinoline ring, 1,2-dihydroquinazoline ring, 1,2-dihydroquinoxaline ring and so forth, more preferred are indoline ring, benzothiazoline ring, benzimidazoline ring and 1,2-dihydroquinoline ring, and particularly preferred is indoline ring.

The compound of Type (iii) will be explained hereafter.

The compound of Type (iii) is a compound characterized in that its one-electron oxidized derivative produced by one electron oxidation of the compound can further release one or more electrons after undergoing a subsequent bond formation process. The bond formation process referred to herein means formation of bond between atoms such as carbon-carbon, carbon-nitrogen, carbon-sulfur and carbon-oxygen.

The compound of Type (iii) is preferably a compound characterized in that its one-electron oxidized derivative produced by one electron oxidation of the compound can release one or more electrons after reacting with a carbon-carbon double bond site or carbon-carbon triple bond site to form a bond.

Although one electron oxidized derivative that is formed one electron oxidation of the compound of Type (iii) is a cation radical species, it may become a neutral radical species along with elimination of a proton. This one electron oxidized derivative (cation radical species or radical species) causes a chemical reaction of the mode generally called "cycloaddition reaction" at a carbon-carbon double bond site or carbon-carbon triple bond site and thereby forms a bond between atoms such as carbon-carbon, carbon-nitrogen, carbon-sulfur and carbon-oxygen to form a new ring structure in the molecule. The compound of Type (iii) is characterized in that it releases one or more electrons at the same time with or after the bond formation.

More precisely, the compound of Type (iii) is characterized in that it newly produces, after one electron oxidation, a radical species having a ring structure by the cycloaddition reaction, and a second electron is released from the radical species directly or with elimination of proton so that the compound is oxidized.

Further, the compound of Type (iii) include a compound of which two electron-oxidized derivative produced as describe above has an ability to cause, after undergoing hydrolysis in some cases or directly in some cases, a tautomerization reaction with transfer of proton to further release one or more electrons, usually two or more electrons, and thus to be oxidized. It further include a compound of which two electron-oxidized derivative has an ability to directly release one or more electrons, usually two or more electrons, and thus to be oxidized without undergoing such a tautomerization reaction.

The compound of Type (iii) is preferably represented by the formula (3).

In the formula (3), $RED^3$ represents a group having the same meaning as that of $RED^{12}$ in the formula (1-2). $RED^3$ is preferably an arylamino group, a hetelocyclylamino group or an aryl group or heterocyclic group substituted with a group selected from the group consisting of a hydroxy group, a mercapto group, an alkylthio group, a methyl group and an amino group.

When $RED^3$represents an arylamino group, it may be, for example, anilino group, naphthylamino group or the like. The heterocyclic ring of the hetelocyclylamino group is an aromatic or non-aromatic monocyclic or condensed heterocyclic ring, and it preferably includes at least one aromatic ring as a partial structure. The expression of "including an aromatic ring as a partial structure" used here means that 1) the heterocyclic ring itself is an aromatic ring, 2) an aromatic ring is condensed to the heterocyclic ring, or 3) an aromatic ring substitutes on the heterocyclic ring. However, the cases of 1) and 2) are preferred. The amino group substitutes directly on the aromatic ring contained in the heterocyclic ring as a partial structure. Examples of the heterocyclic ring include, for example, pyrrole ring, indole ring, indoline ring, imidazole ring, benzimidazole ring, benzimidazoline ring, thiazole ring, benzothiazole ring, benzothiazoline ring, oxazole ring, benzoxazole ring, benzoxazoline ring, quinoline ring, tetrahydroquinoline ring, quinoxaline ring, tetrahydroquinoxaline ring, quinazoline ring, tetrahydroquinazoline ring, pyridine ring, isoquinoline ring, thiophene ring, benzothiophene ring, 2,3-dihydrobenzothiophene ring, furan ring, benzofuran ring, 2,3-dihydrobenzofuran ring, carbazole ring, phenothiazine ring, phenoxazine ring, phenazine ring and so forth.

When $RED^3$ represents an arylamino group or a hetelocyclylamino group, the amino group of arylamino group and the amino group of hetelocyclylamino group may be further substituted with an arbitrary substituent, and it may form a ring structure via this substituent with the aryl group or the heterocyclic group. Examples of such a ring structure include, for example, indoline ring, tetrahydroquinoline ring, carbazole ring and so forth.

When $RED^3$ represents an aryl group or heterocyclic group substituted with a hydroxy group, a mercapto group, a methyl group, an alkylthio group, an amino group or the like, the aryl group may be phenyl group, naphthyl group or the like, and examples of the heterocyclic ring of the heterocyclic group are similar to those mentioned as examples of "the heterocyclic ring of hetelocyclylamino group". Moreover, the methyl group may have an arbitrary substituent and may form a ring structure via the substituent with the aryl group or heterocyclic group. Examples of such a ring structure include, for example, tetralin ring, indan ring and so forth. On the other hand, the amino group may also have an alkyl group, an aryl group or a heterocyclic group as a substituent and may form a ring structure via such a substituent with the aryl group or heterocyclic group. Examples of such a ring structure include, for example, tetrahydroquinoline ring, indoline ring, carbazole ring and so forth.

$RED^3$preferably represents an arylamino group or an aryl group or heterocyclic group substituted with a hydroxy group, a mercapto group, a methyl group or an amino group, more preferably an arylamino group or an aryl group or heterocyclic group substituted with a mercapto group, a methyl group or an amino group. $RED^3$ particularly preferably represents an arylamino group or an aryl group or heterocyclic group substituted with a methyl group or an amino group.

As the arylamino group, anilino group and naphthylamino group are preferred, and anilino group is particularly preferred. Preferred examples of the substituent of the anilino group include a chlorine atom, an alkyl group, an alkoxy group, an acylamino group, a sulfamoyl group, a carbamoyl group, a ureido group, a sulfonamido group, an alkoxycarbonyl group, a cyano group, an alkyl or arylsulfonyl group, a heterocyclic group and so forth.

Preferred examples of the aryl group or heterocyclic group substituted with a hydroxy group include, for example, hydroxyphenyl group, 5-hydroxyindoline ring group and 6-hydroxy-1,2,3,4-tetrahydroquinoline ring group and so forth, and particularly preferred is a hydroxyphenyl group.

Examples of the aryl group or heterocyclic group substituted with a mercapto group include, for example, a mercaptophenyl group, 5-mercaptoindoline ring group and 6-mercapto-1,2,3,4-tetrahydroquinoline ring group and so forth, and particularly preferred is a mercaptophenyl group.

Examples of the aryl group or heterocyclic group substituted with a methyl group include methylphenyl group, ethylphenyl group, isopropylphenyl group, 3-methylindole ring group, 3-isopropylindole ring group, 5-methylindole ring group, 5-methylindoline ring group, 6-methyl-1,2,3,4-tetrahydroquinoline ring group, 6-methyl-1,2,3,4-tetrahydroquinoxaline ring group and so forth.

Preferred examples of the aryl group or heterocyclic group substituted with an amino group include, for example, methylaminophenyl group, octylaminophenyl group, dodecylaminophenyl group, dimethylaminophenyl group, benzylaminophenyl group, phenylaminophenyl group, methylaminonaphthyl group, 5-methylaminotetralin, 1-butylamino-3,4-methylenedioxyphenyl group, 3-methylaminopyrrole ring group, 3-ethylaminoindole ring group, 5-benzylaminoindoline ring group, 2-aminoimidazole ring group, 2-methylaminothiazole ring group, 6-phenylaminobenzothiazole ring group and so forth. Among these, more preferred are phenyl groups substituted with an alkylamino group or a phenylamino group, and particularly preferred is a phenyl group substituted with an alkylamino group.

Preferred examples of the substituent of the aryl group or heterocyclic group substituted with a hydroxy group, a mercapto group, a methyl group or an amino group include a chlorine atom, an alkyl group, an alkoxy group, an acylamino group, a sulfamoyl group, a carbamoyl group, a ureido group, a sulfonamido group, an alkoxycarbonyl group, a cyano group, an alkyl or arylsulfonyl group, a heterocyclic group, an alkylamino group, an arylamino group and so forth.

The reactive group represented by $Y^3$ in the formula (3) specifically represents an organic group containing at least one carbon-carbon double bond site or carbon-carbon triple bond site. The carbon-carbon double bond site and carbon-carbon triple bond site may have a substituent, and examples of the substituent are similar to those mentioned as substituents of $RED^{11}$ in the formula (1-1). Preferred are an alkyl group, an aryl group, an alkoxycarbonyl group, a carbamoyl group, an acyl group, a cyano group, an electron donor group and so forth. The electron donor group means an alkoxy group, a hydroxy group, an amino group, an alkylamino group, an arylamino group, a hetelocyclylamino group, a sulfonamido group, an acylamino group, an active methine group, a mercapto group, an alkylthio group, an arylthio group or an aryl group having any of these groups as a substituent. The active methine group means a methine group substituted with two of electron-withdrawing groups, and the electron-withdrawing group means an acyl group, an alkoxycarbonyl group, an aryloxycarbonyl group, a carbamoyl group, an alkylsulfonyl group, an arylsulfonyl group, a sulfamoyl group, a trifluoromethyl group, a cyano group, a nitro group or an imino group. Two of the electron-withdrawing groups may bond to each other to form a ring structure.

When $Y^3$ represents an organic group containing a carbon-carbon double bond site, the substituent thereof is more preferably an alkyl group, an alkoxycarbonyl group, a carbamoyl group, an electron donor group or the like. The electron donor group is preferably an alkoxy group, an amino group, an alkylamino group, an arylamino group, a hetelocyclylamino group, a sulfonamido group, an acylamino group, an active methine group, a mercapto group, an alkylthio group or a phenyl group having any of these groups as a substituent. It is also preferred that an alkyl group, an alkoxy group, an alkylthio group, an alkylamino group and so forth as substituents bond to each other to form a ring structure. Specific examples of groups having such a ring structure include 2,3-dihydro-γ-pyran ring group, cyclohexene ring group, 1-thia-2-cyclohexen-3-yl group, tetrahydropyridine ring group and so forth.

When $Y^3$ represents an organic group containing a carbon-carbon double bond site, substituents thereof may bond to each other to form a ring structure. The ring structure formed in this case is a non-aromatic 5- to 7-membered carbon ring or heterocyclic ring. When $Y^3$ represents a carbon-carbon triple bond site, preferred as a substituent are a hydrogen atom, an alkoxycarbonyl group, a carbamoyl group, an electronic donor group and so forth, and preferred electron donor groups are an alkoxy group, an amino group, an alkylamino group, an arylamino group, a hetelocyclylamino group, a sulfonamido group, an acylamino group, an active methine group, a mercapto group, an alkylthio group and a phenyl group having any of these electron donor groups as a substituent.

In the formula (3), the reactive group represented by $Y^3$ is preferably an organic group containing a carbon-carbon double bond.

In the formula (3), $L^3$ represents a bridging group that links $RED^3$ and $Y^3$, and it is specifically each of a single bond, an alkylene group, an arylene group, a heterocyclic ring group, —O—, —S—, —$NR^N$—, —C(=O)—, —$SO_2$—, —SO— and —P(=O)— or a group consisting of a combination of these groups. $R^N$ represents a hydrogen atom, an alkyl group, an aryl group or a heterocyclic group. The bridging group represented by $L^3$may have a substituent. As the substituent, those explained as substituents of $RED^{11}$ in the formula (1-1) can be mentioned.

As for the group represented by $L^3$ in the formula (3), it is preferred that, when a cation radical species produced by oxidation of $RED^3$ in the formula (3) or a radical species produced therefrom with elimination of proton reacts with the reactive group represented by $Y^3$ in the formula (3) to form a bond, a group involved in this reaction can form a 3- to 7-membered ring structure including $L^3$.

Preferred examples of $L^3$ include a single bond, an alkylene group, an arylene group (especially phenylene group), a —C(=O)-group, a —O— group, a —NH— group, a —N(alkyl group)-group and a divalent bridging group consisting of a combination of these groups.

Among the compounds represented by the formula (3), preferred compounds are represented by following formulas (I) to (IV).

Formula (I)

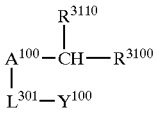

Formula (II)

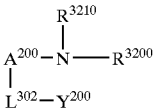

Formula (III)

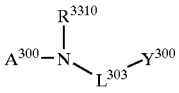

Formula (IV)

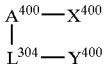

In the formulas (I) to (IV), $A^{100}$, $A^{200}$, $A^{300}$ and $A^{400}$ represent an aryl group or a heterocyclic group, and preferred ranges thereof are the same as that of the preferred range of $RED^3$ in the formula (3). $L^{301}$, $L^{302}$, $L^{303}$ and $L^{304}$ represent a bridging group. This bridging group means a group having the same meaning as $L^3$ in the formula (3), and the preferred range thereof is also the same. $Y^{100}$, $Y^{200}$, $Y^{300}$ and $Y^{400}$ represent a reactive group. This reactive group means a group having the same meaning as $Y^3$ in the formula (3), and the preferred range thereof is also the same. $R^{3100}$, $R^{3110}$, $R^{3200}$, $R^{3210}$ and $R^{3310}$ represent a hydrogen atom or a substituent. $R^{3100}$ and $R^{3110}$ preferably represent a hydrogen atom, an alkyl group or an aryl group. $R^{3200}$ and $R^{3310}$ preferably represent a hydrogen atom. $R^{3210}$ is preferably a substituent, and the substituent is preferably an alkyl group or an aryl group. $R^{3110}$ and $A^{100}$, $R^{3210}$ and $A^{200}$, and $R^{3310}$ and $A^{300}$ may bond to form a ring structure, respectively. The ring structure formed in this case is preferably tetralin ring, indan ring, tetrahydroquinoline ring, indoline ring or the like. $X^{400}$ represents a hydroxy group, a mercapto group or an alkylthio group, preferably a hydroxy group or a mercapto group, more preferably a mercapto group.

The relationship between the formulas (I) to (IV) and the formula (3) will be explained hereafter. $A^{100}$ in the formula (I) represents an aryl group or heterocyclic group substituted with a methyl group: $—CH(R^{3110})(R^{3100})$. $A^{200}$ in the formula (II) represents an aryl group or heterocyclic group substituted with an amino group: $—N(R^{3210})(R^{3200})$. $A^{400}$ in the formula (IV) represents an aryl group or heterocyclic group substituted with a hydroxy group, a mercapto group or an alkylthio group represented by $X^{400}$. The group represented as $A^{300}—N(R^{3310})—$ in the formula (III) similarly represents an arylamino group or a hetelocyclylamino group.

Among the compounds represented by the formula (I) to (IV), more preferred compounds are compounds represented by the formula (I), (II) and (IV).

The compound of Type (iv) will be explained hereafter.

The compound of Type (iv) is a compound having a ring structure on which reducing group substitutes, which can, after the reducing group undergoes one electron oxidation, release one ore more electrons with a cleavage reaction of the ring structure.

In the compound of Type (iv), the ring structure is cleaved after the compound undergoes one electron oxidation. The cleavage reaction of the ring in this case referred to a reaction caused in the manner mentioned below.

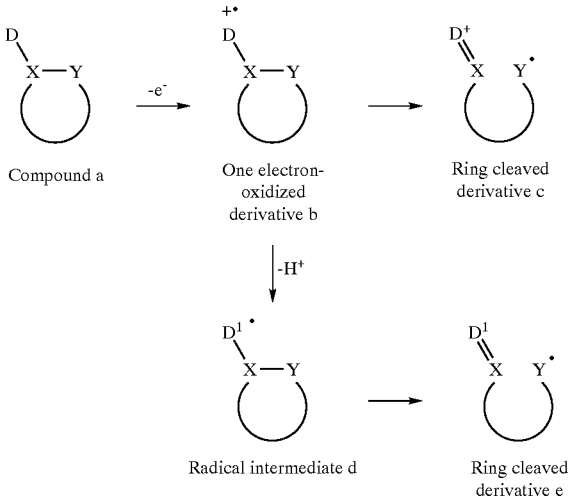

In the aforementioned formulas, Compound a represents a compound of Type (iv). In Compound a, D represents a reducing group, and X and Y represent atoms forming a bond to be cleaved after one electron oxidation in the ring structure. First, Compound a undergoes one electron oxidization to form One electron-oxidized derivative b. After that, the single bond of D—X becomes a double bond, and the bond of X—Y is simultaneously cleaved so that Ring cleaved derivative d is produced. Alternatively, Radical intermediate d may be produced from One electron-oxidized derivative b with elimination of proton, and Ring cleaved derivative e may be produced from Radical intermediate d in a similar manner. The compound is characterized in that one or more electrons are further released thereafter from Ring cleaved derivative c or e produced as described above.

The ring structure of the compound of Type (iv) is a 3- to 7-membered carbon ring or heterocyclic ring, and it may be a monocyclic or condensed aromatic or non-aromatic ring. It is preferably a saturated ring structure, more preferably a 3- or 4-membered ring. Examples of preferred ring structures include cyclopropane ring, cyclobutane ring, oxirane ring, oxetane ring, aziridine ring, azetidine ring, episulfide ring, and thietane ring. More preferred are cyclopropane ring, cyclobutane ring, oxirane ring, oxetane ring and azetidine ring, and particularly preferred are cyclopropane ring, cyclobutane ring and azetidine ring. The ring structure may have a substituent.

The compound of Type (iv) is preferably represented by the formula (4-1) or (4-2).

In the formulas (4-1) and (4-2), $RED^{41}$ and $RED^{42}$ each represent a group having the same meaning as $RED^{12}$ in the formula (1-2), and the preferred ranges thereof are also the same. $R^{40}$ to $R^{44}$ and $R^{45}$ and $R^{49}$ each represent a hydrogen atom or a substituent. Examples of the substituent are the same as those mentioned as substituents of $RED^{12}$. In the formula (4-2), $Z^{42}$ represents $—CR^{420}R^{421}—$, $—NR^{423}—$ or —O—. $R^{420}$ and $R^{421}$ each represent a hydrogen atom or a substituent, and $R^{423}$ represents a hydrogen atom, an alkyl group, an aryl group or a heterocyclic group.

In the formula (4-1), $R^{40}$ is preferably a hydrogen atom, an alkyl group, an alkenyl group, an alkynyl group, an aryl group, a heterocyclic group, an alkoxy group, an amino group, an alkylamino group, an arylamino group, a hetelocyclylamino group, an alkoxycarbonyl group, an acyl group, a carbamoyl group, a cyano group or a sulfamoyl group, more preferably a hydrogen atom, an alkyl group, an aryl group, a heterocyclic group, an alkoxy group, an alkoxycarbonyl group, an acyl group or a carbamoyl group, particularly preferably a hydrogen atom, an alkyl group, an aryl group, a heterocyclic group, an alkoxycarbonyl group or a carbamoyl group.

As for $R^{41}$ to $R^{44}$, it is preferred that at least one of them is a donor group, or both of $R^{41}$ and $R^{42}$ or both of $R^{43}$ and $R^{44}$ are electron-withdrawing groups. It is more preferred that at least one of $R^{41}$ to $R^{44}$ is a donor group. It is still more preferred that at least one of $R^{41}$ to $R^{44}$ is a donor group, and groups of $R^{41}$ to $R^{44}$ other than donor group are hydrogen atoms or alkyl groups.

The donor group referred to in this case is a group selected from the group consisting of a hydroxy group, an alkoxy group, an aryloxy group, a mercapto group, an acylamino group, a sulfonylamino group, an active methine group and groups preferred as $RED^{41}$ and $RED^{42}$. Preferably used as the donor group are an alkylamino group, an arylamino group, a hetelocyclylamino group, a 5-membered aromatic heterocyclic group containing one nitrogen atom in the ring (monocyclic ring or condensed ring), a non-aromatic nitrogen-containing heterocyclic group substituting at a nitrogen atom, a phenyl group substituted with at least one electron donor group (in this case, the electron donor group is a hydroxy group, an alkoxy group, an aryloxy group, an amino group, an alkylamino group, an arylamino group, a hetelocyclylamino group or a non-aromatic nitrogen-containing heterocyclic group substituting at a nitrogen atom). More preferably used are an alkylamino group, an arylamino group, a 5-membered aromatic heterocyclic group containing one nitrogen atom in the ring (in this case, the aromatic heterocyclic ring is indole ring, pyrrole ring or carbazole ring) a phenyl group substituted with an electron donor group (especially a phenyl group substituted with three or more alkoxy groups or a phenyl group substituted with a hydroxy group, an alkylamino group or an arylamino group in this case). Particularly preferably used are an arylamino group, a 5-membered aromatic heterocyclic group containing one nitrogen atom in the ring (in this case, 3-indolyl group), a phenyl group substituted with an electron donor group (especially a trialkoxyphenyl group or a phenyl group substituted with an alkylamino group or an arylamino group in this case). The electron-withdrawing group has the same meaning as that already explained in the explanation of the active methine group.

In the formula (4-2), the preferred range of $R^{45}$ is the same as that of $R^{40}$ in the aforementioned formula (4-1).

Preferred as $R^{46}$ to $R^{49}$ are a hydrogen atom, an alkyl group, an alkenyl group, an alkynyl group, an aryl group, a heterocyclic group, a hydroxy group, an alkoxy group, an amino group, an alkylamino group, an arylamino group, a hetelocyclylamino group, a mercapto group, an arylthio group, an alkylthio group, an acylamino group and a sulfoneamino group, more preferred are a hydrogen atom, an alkyl group, an aryl group, a heterocyclic group, an alkoxy group, an alkylamino group, an arylamino group and a hetelocyclylamino group. Particularly preferred $R^{46}$ to $R^{49}$ are selected from a hydrogen atom, an alkyl group, an aryl group, a heterocyclic group, an alkylamino group and an arylamino group when $Z^{42}$ is a group represented as —$CR^{420}R^{421}$—, a hydrogen atom, an alkyl group, an aryl group and a heterocyclic group when $Z^{42}$ represents —$NR^{423}$—, or a hydrogen atom, an alkyl group, an aryl group and a heterocyclic group when $Z^{42}$ represents —O—.

$Z^{42}$ is preferably —$CR^{420}R^{421}$— or —$NR^{423}$—, more preferably —$NR^{423}$—.

$R^{420}$ and $R^{421}$ preferably represent a hydrogen atom, an alkyl group, an alkenyl group, an alkynyl group, an aryl group, a heterocyclic group, a hydroxy group, an alkoxy group, an amino group, a mercapto group, an acylamino group or a sulfoneamino group, more preferably a hydrogen atom, an alkyl group, an aryl group, a heterocyclic group, an alkoxy group or an amino group. $R^{423}$ preferably represents a hydrogen atom, an alkyl group, an aryl group or an aromatic heterocyclic group, more preferably methyl group, ethyl group, isopropyl group, tert-butyl group, tert-amyl group, benzyl group, diphenylmethyl group, allyl group, phenyl group, naphthyl group, 2-pyridyl group, 4-pyridyl group or 2-thiazolyl group.

When each of $R^{40}$ to $R^{49}$, $R^{420}$, $R^{421}$ and $R^{423}$ is a substituent, each preferably has a total carbon atom number of 40 or less, more preferably 30 or less, particularly preferably 15 or less. Moreover, these substituents may bond to each other or to another site in the molecule ($RED^{41}$, $RED^{42}$ or $Z^{42}$) to form a ring.

Each of the compounds of Types (i), (iii) and (iv) is preferably "a compound having a group adsorptive to silver, halide in the molecule" or "a compound having a partial structure of a spectral sensitization dye in the molecule". The compound of Type (ii) is "a compound having two or more groups adsorptive to silver halide in the molecule".

The group adsorptive to silver halide contained in the compounds of Types (i) to (iv) is a group directly adsorbing to silver halide or a group accelerating adsorption to silver halide. It is specifically a mercapto group (or a salt thereof), a thione group (—C(=S)—), a heterocyclic group containing at least one atom selected from a nitrogen atom, sulfur atom, selenium atom and tellurium atom, a sulfide group, a cationic group or an ethynyl group.

However, the compound of Type (ii) does not contain a sulfide group as an adsorptive group.

The mercapto group (or a salt thereof) as the adsorptive group more preferably means, besides mercapto group (or a salt thereof) itself, a heterocyclic group, aryl group or alkyl group substituted with at least one mercapto group (or salt thereof). The heterocyclic group in this case is a 5- to 7-membered monocyclic or condensed aromatic or non-aromatic heterocyclic group. Examples thereof are, for example, imidazole ring group, thiazole ring group, oxazole ring group, benzimidazole ring group, benzothiazole ring group, benzoxazole ring group, triazole ring group, thiadiazole ring group, oxadiazole ring group, tetrazole ring group, purine ring group, pyridine ring group, quinoline ring group, isoquinoline ring group, pyrimidine ring group, triazine ring group and so forth. Moreover, it may be a heterocyclic group containing a quaternized nitrogen atom. In this case, the substituting mercapto group may be dissociated to serve as a meso ion. Examples of such a heterocyclic group include imidazolium ring group, pyrazolium ring group, thiazolium ring group, triazolium ring group, tetrazolium ring group, thiadiazolium ring group, pyridinium ring group, pyrimidinium ring group, triazinium ring group and so forth, and a triazolium ring group (e.g., 1,2,4-triazolium-3-thiolate ring group) is especially preferred. As the aryl group, phenyl group and naphthyl group can be mentioned. As the alkyl group, a straight, branched or cyclic alkyl group having 1–30 carbon atoms can be mentioned. When the mercapto group forms a salt, the counter ion may be a cation of an alkali metal, alkaline earth metal or heavy metal ($Li^+$, $Na^+$, $K^+$, $Mg^{2+}$, $Ag^+$, $Zn^{2+}$ etc.), an ammonium ion, a heterocyclic group containing a quaternized nitrogen atom, a phosphonium ion or the like.

Further, the mercapto group as the adsorptive group may undergo tautomerization and thereby become a thione group, specifically, a thioamido group (—C(═S)—NH— group in this case) or a group containing a partial structure of the thioamido group, i.e., a straight or cyclic thioamido group, thioureido group, thiourethane group, dithiocarbamic acid ester group or the like. Examples of such a cyclic group include thiazolidine-2-thione group, oxazolidine-2-thione group, 2-thiohydantoin group, rhodanine group, isorhodanine group, thiobarbituric acid group, 2-thioxo-oxazolidin-4-one group and so forth.

The thione group as the adsorptive group include, besides the thione group derived from a mercapto group by tautomerization, a straight or cyclic thioamido group, thioureido group, thiourethane group and dithiocarbamic acid ester group that cannot undergo tautomerization, i.e., that do not have a hydrogen atom at the a-position of the thione group.

The heterocyclic group containing at least one atom selected from a nitrogen atom, sulfur atom, selenium atom and tellurium atom as the adsorptive group is a nitrogen-containing heterocyclic group having a —NH- group that can form imino silver (>NAg) as a partial structure of the heterocyclic ring, or a heterocyclic group having a —S— group, —Se— group, —Te— group or =N— group that can coordinate with a silver ion via a coordinate bond as a partial structure of the heterocyclic ring. Examples of the former include benzotriazol group, triazole group, indazole group, pyrazole group, tetrazole group, benzimidazole group, imidazole group, purine group and so forth. Examples of the latter include thiophene group, thiazole group, oxazole group, benzothiazole group, benzoxazole group, thiadiazole group, oxadiazole group, triazine group, selenazole group, benzoselenazole group, tellurazole group, benzotellurazole group and so forth. The former is preferred.

The sulfide group as the adsorptive group may be any group having a partial structure of —S—. However, it is preferably a group having a partial structure of (alkyl or alkylene)-S-(alkyl or alkylene), (aryl or arylene)-S-(alkyl or alkylene) or (aryl or arylene)-S-(aryl or arylene). Further, these sulfide groups may form a ring structure or form a —S—S— group. Specific examples of the group forming a ring structure include groups containing thiolane ring, 1,3-dithiolane ring, 1,2-dithiolane ring, thiane ring, dithiane ring, tetrahydro-1,4-thiazine ring or the like. Particularly preferred sulfide groups are groups having a partial structure of (alkyl or alkylene)-S-(alkyl or alkylene).

The cationic group as the adsorptive group means a group containing a quaternized nitrogen atom, specifically a group containing a nitrogen-containing heterocyclic group that contains an ammonio group or quaternized nitrogen atom. Examples of the ammonio group include a trialkylammonio group, a dialkylarylammonio group, an alkyldiarylammonio group and so forth, e.g., benzyldimethylammonio group, trihexylammonio group, phenyldiethylammonio group and so forth. Examples of the nitrogen-containing heterocyclic group containing a quaternized nitrogen atom include, for example, pyridinio group, quinolinio group, isoquinolinio group, imidazolio group and so forth. Preferred are pyridinio group and imidazolio group, and particularly preferred is pyridinio group. The nitrogen-containing heterocyclic group containing a quaternized nitrogen atom may have an arbitrary substituent. However, preferred substituents for pyridinio group and imidazolio group are an alkyl group, an aryl group, an acylamino group, a chlorine atom, an alkoxycarbonyl group, a carbamoyl group and so forth. A particularly preferred substituent for pyridinio group is a phenyl group.

The ethynyl group as the adsorptive group means a —C≡CH group, and the hydrogen atom may be substituted.

The aforementioned adsorptive groups may have an arbitrary substituent.

As specific examples of the adsorptive group, those disclosed in JP-A-11-95355, pages 4–7 can be further mentioned.

Preferred as the adsorptive group are a mercapto-substituted nitrogen-containing heterocyclic group (e.g., 2-mercaptothiadiazole group, 3-mercapto-1,2,4-triazole group, 5-mercaptotetrazole group, 2-mercapto-1,3,4-oxadiazole group, 2-mercaptobenzothiazole group, 1,5-dimethyl-1,2,4-triazolium-3-thiolate group etc.), a dimercapto-substituted heterocyclic group (e.g., 2,4-dimercapto-pyrimidine group, 2,4-dimercaptotriazine group, 3,5-dimercapto-1,2,4-triazole group, 2,5-dimercapto-1,3-thiazole group etc.) and a nitrogen-containing heterocyclic group having a —NH— group that can form imino silver (>NAg) as a partial structure of the heterocyclic ring (e.g., benzotriazol group, benzimidazole group, indazole group etc.).

The partial structure of spectral sensitization dye is a group containing a chromophore of spectral sensitization dye, and it is a residue obtained by removing an arbitrary hydrogen atom or substituent from a spectral sensitization dye compound. Preferred spectral sensitization dyes are spectral sensitization dyes typically used in color sensitization techniques, and include, for example, cyanine dyes, complex cyanine dyes, melocyanine dyes, complex melocyanine dyes, homopolar cyanine dyes, stilyl dyes and hemicyanine dyes. Typical spectral sensitization dyes are disclosed in Research Disclosure, Item36544, September, 1994. Those skilled in the art can synthesize these dyes according to the procedures described in Research Disclosure (supra) or F. M. Hamer, The Cyanine dyes and Related Compounds (Interscience Publishers, New York, 1964). Further, all the dyes disclosed in JP-A-11-95355 (U.S. Pat. No. 6,054,260), pages 7–14 can be used as they are.

The compounds of Types (i) to (iv) preferably have a total carbon number of 10–60, more preferably 10–50, still more preferably 11–40, particularly preferably 12–30.

The compounds of Types (i) to (iv) undergo one electron oxidization, which is triggered by light exposure of silver-halide photographic light-sensitive material containing them, then after a subsequent reaction, further release one electron or two or more electrons depending on the type of the compounds and are thereby oxidized. The oxidation potential for the first electron is preferably about 1.4 V or lower, more preferably 1.0 V or lower. This oxidation potential is preferably higher than 0 V, more preferably higher than 0.3 V. Therefore, the oxidation potential is preferably about 0 to about 1.4 V, more preferably about 0.3 V to about 1.0 V.

The oxidation potential referred to herein can be measured by a technique of cyclic voltammetry. Specifically, a sample is dissolved in a solution of acetonitrile:water (containing 1.0 M lithium perchlorate)=80%:20% (volume %), nitrogen gas is bubbled into the solution for 10 minutes, and then the potential is measured by using a glassy carbon disk for a working electrode, a platinum line for a counter electrode and a calomel electrode (SCE) for a reference electrode at 25° C. and a potential scanning rate of 0.1 V/second. A ratio of oxidation potential and SCE is measured when a cyclic voltammetry wave showed a peak potential.

When each of the compounds of Types (i) to (iv) is a compound that undergoes one electron oxidation and then, after a subsequent reaction, further releases one electron, the oxidation potential for the latter oxidation is preferably −0.5 to −2 V, more preferably −0.7 V to −2 V, still more preferably −0.9 to −1.6 V.

When each of the compounds of Types (i) to (iv) is a compound that undergoes one electron oxidation, then after a subsequent reaction, further releases two or more electrons and is thereby oxidized, the oxidation potential for the latter oxidation is not particularly limited. This is because, in many cases, oxidation potential for the second electron and those of the third and subsequent electrons cannot be clearly distinguished and thus they cannot be accurately measured.

Specific examples of the compounds of Types (i) to (iv) are listed below. However, the compounds of Types (i) to (iv) that can be used for the present invention are not limited to these.

1

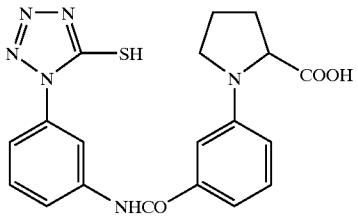

2

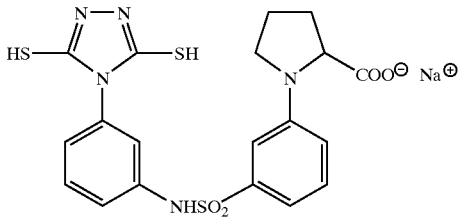

3

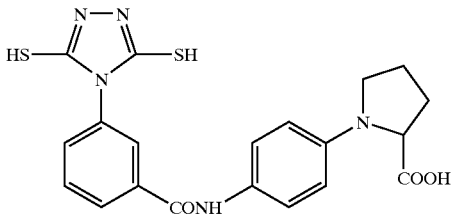

4

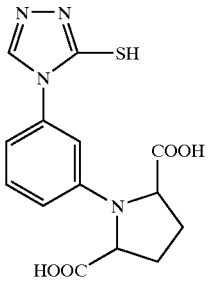

-continued

5

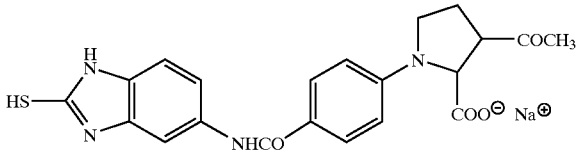

6

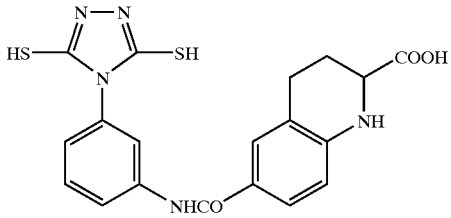

7

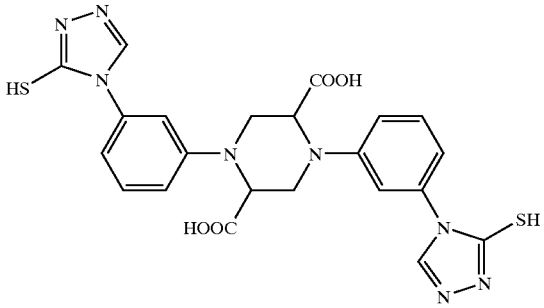

8

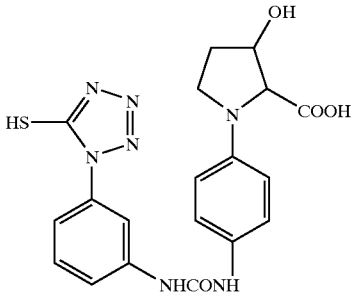

9

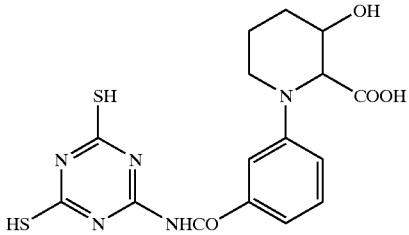

10

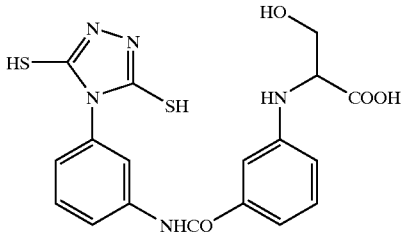

-continued
11
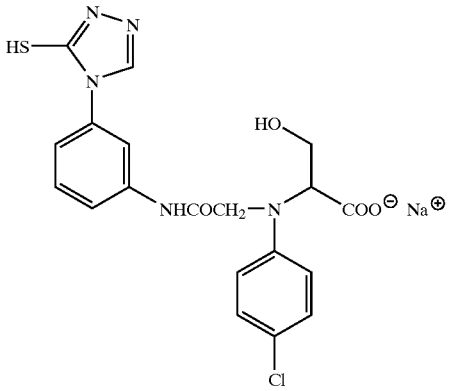
12
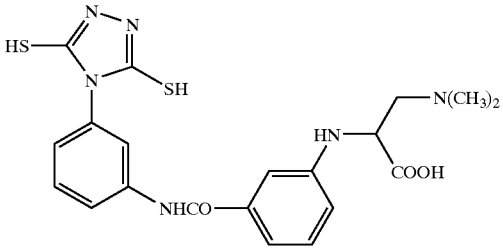
13
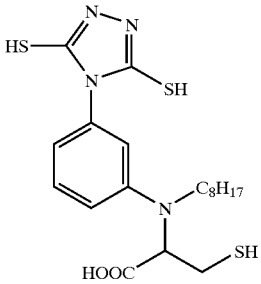
14
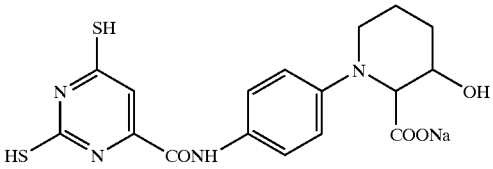
15
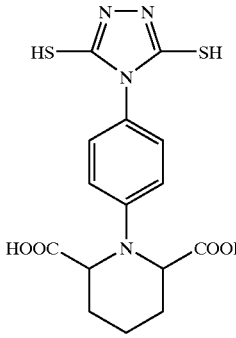
16
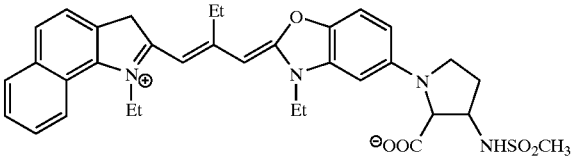
-continued
17
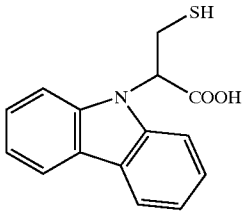
18
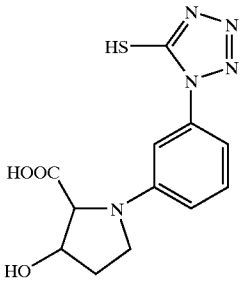
19
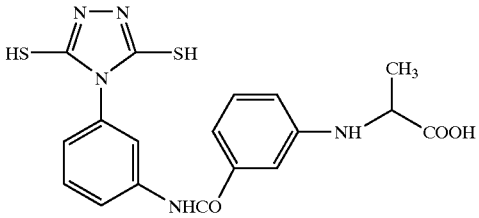
20
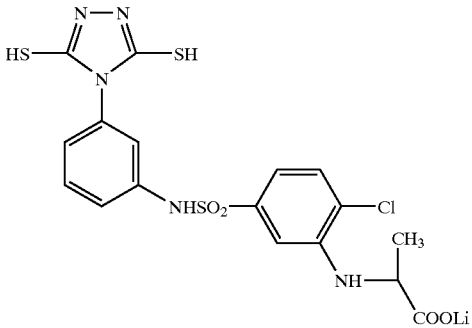
21
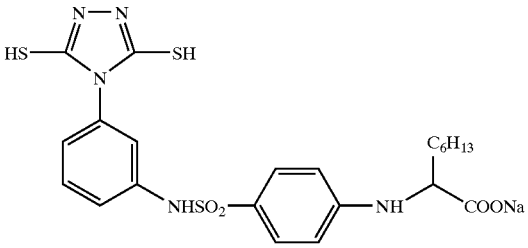
22
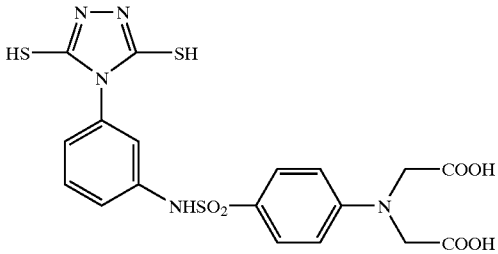

-continued
23
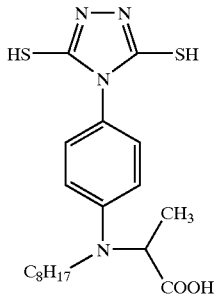
24
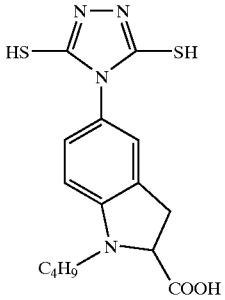
25
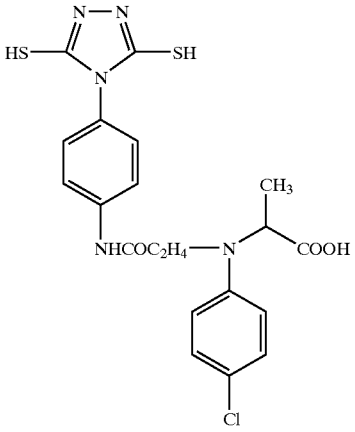
26
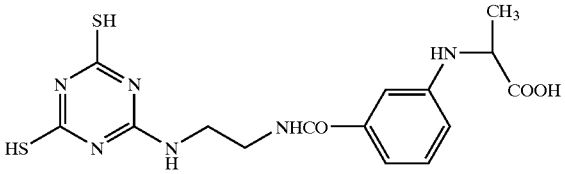
27
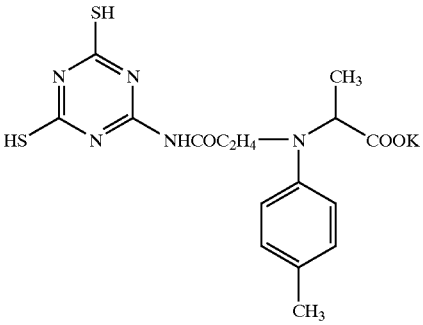
-continued
28
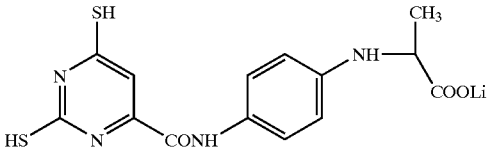
29
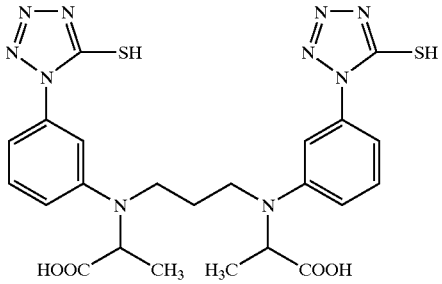
30
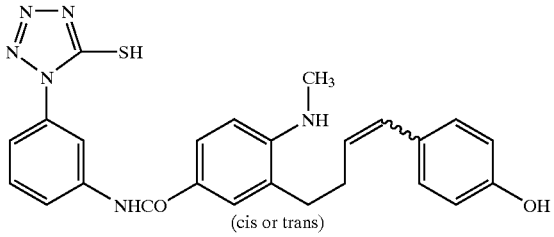
31
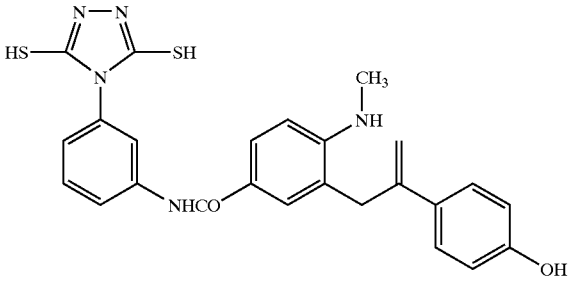
32
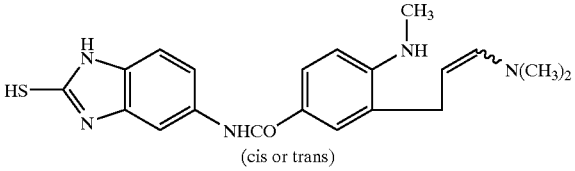
33
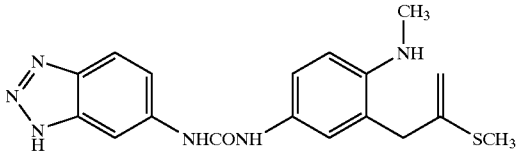
34
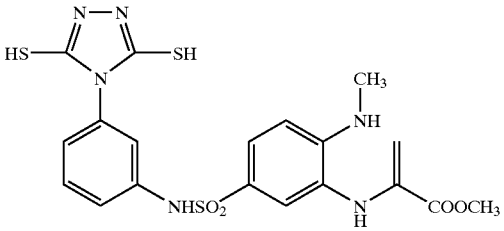

-continued
36
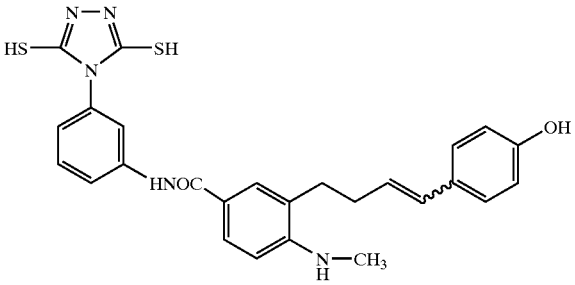
37
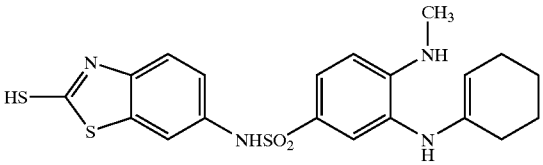
38
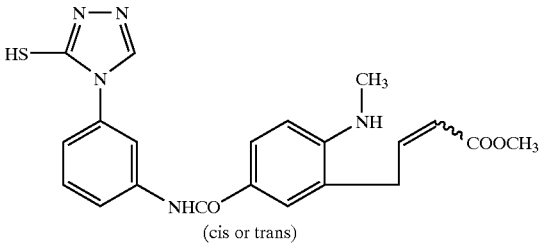
39
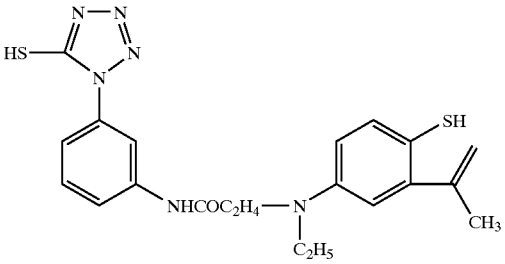
40
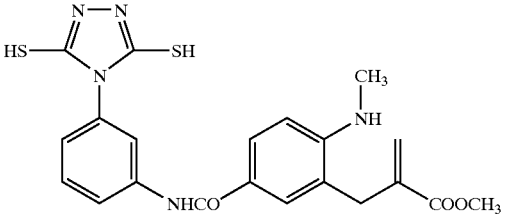
41
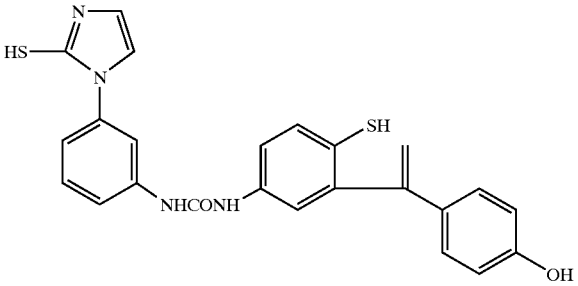
42
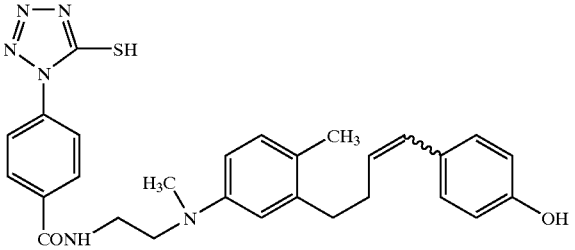
43
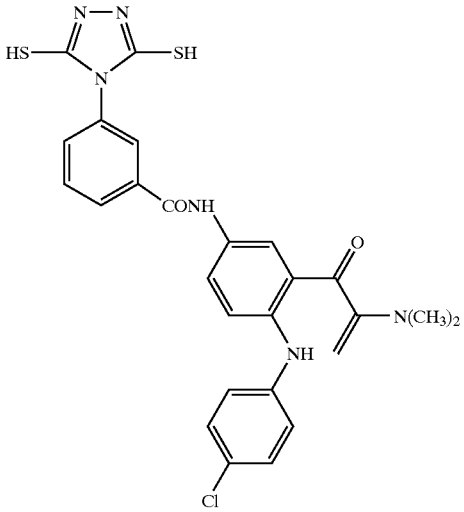
44
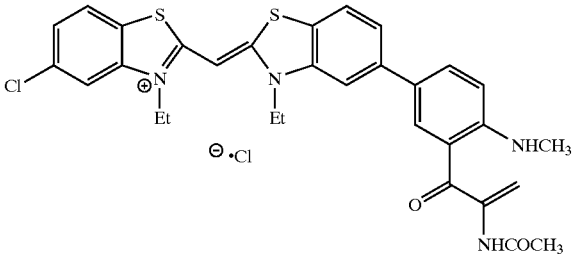
45
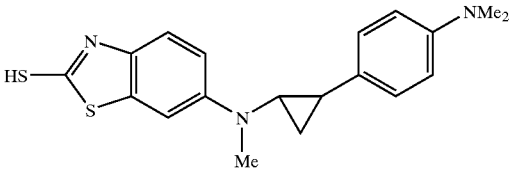

-continued

46

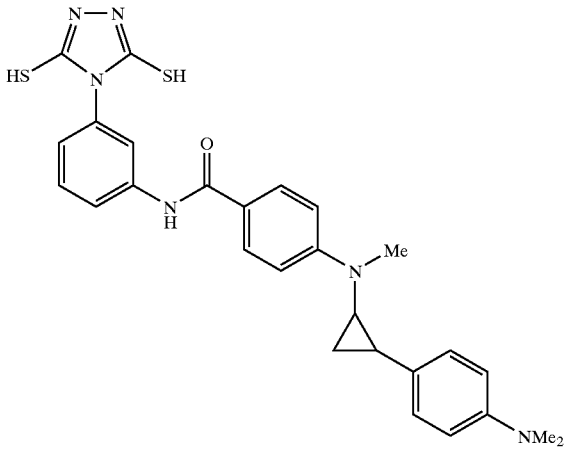

47

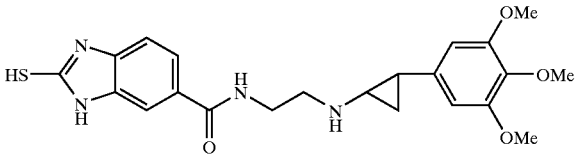

48

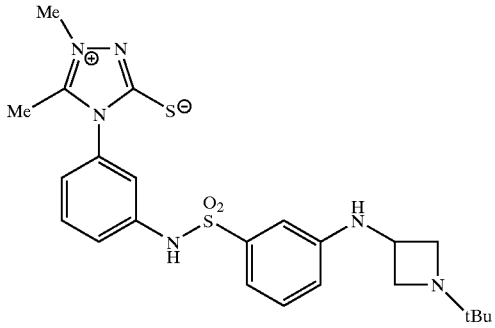

49

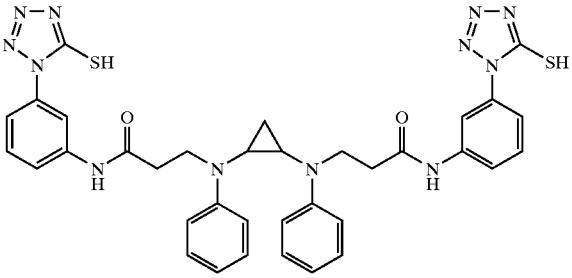

50

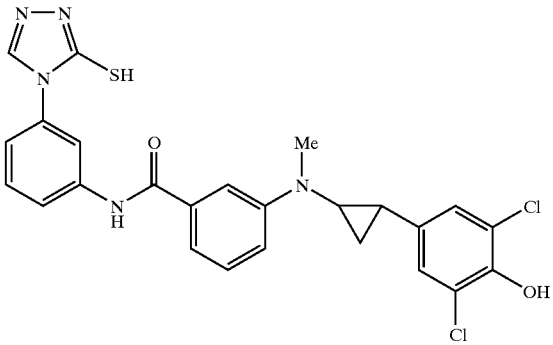

-continued

51

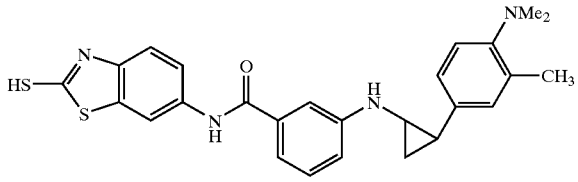

52

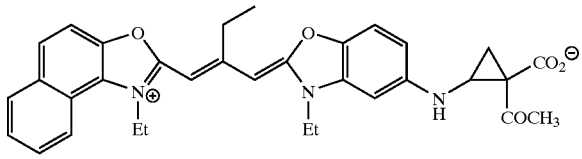

The compounds of Types (i) to (iv) are the same as those explained in detail in Japanese Patent Application Nos. 2001-234075, 2001-234048, 2001-250679 and 2001-272137, respectively. The specific exemplary compounds mentioned in these patent documents can also be mentioned as specific examples of the compounds of Types (i) to (iv).

The compounds of Types (i) to (iv) can be added at any time during the emulsion preparation process or production process of silver halide photographic light-sensitive material. For example, they may be added during grain formation, desalting process, chemical sensitization, before coating etc. They can also be dividedly added at multiple times during these processes. As for the addition time, they are preferably added after completion of the grain formation and before the desalting process, during chemical sensitization (from immediately before the start of chemical sensitization to immediately after completion thereof) or before coating, and they are more preferably added during chemical sensitization or before coating.

The compounds of Types (i) to (iv) are preferably added after being dissolved in water, a water-soluble solvent such as methanol and ethanol or a mixed solvent thereof. A compound of which solubility in water is increased by increasing or decreasing pH may be dissolved with increase or decrease of pH and the obtained solution may be added.

The compounds of Types (i) to (iv) are preferably used in an image-forming layer. However, they may be added to a protective layer or intermediate layer in addition to the image-forming layer and allowed to diffuse during coating. The compounds of Types (i) to (iv) may be added before or after addition of the sensitizing dye, and each of them is preferably added to a silver halide emulsion layer in an amount of $1\times10^{-9}$ to $5\times10^{-2}$ mol, more preferably $1\times10^{-8}$ to $2\times10^{-3}$ mol, per one mole of silver halide.

The silver halide photographic light-sensitive material of the present invention preferably contains a hydrazine compound as a nucleating agent. It particularly preferably contains at least one compound represented by the following formula (D).

Formula (D)

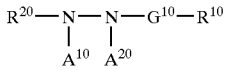

In the formula, $R^{20}$ represents an aliphatic group, an aromatic group or a heterocyclic group, $R^{10}$ represents a hydrogen atom or a blocking group, and $G^{10}$ represents —CO—, —COCO—, —C(=S)—, —$SO_2$—, —SO—, —PO($R^{30}$)— group ($R^{30}$ is selected from the same range of groups defined for $R^{10}$, and $R^{30}$ may be different from $R^{10}$) or an iminomethylene group. $A^{10}$ and $A^{20}$ both represent a hydrogen atom, or one of them represents a hydrogen atom and the other represents a substituted or unsubstituted alkylsulfonyl group, a substituted or unsubstituted arylsulfonyl group or a substituted or unsubstituted acyl group.

In the formula (D), the aliphatic group represented by $R^{20}$ is preferably a substituted or unsubstituted straight, branched or cyclic alkyl, alkenyl or alkynyl group having 1–30 carbon atoms.

In the formula (D), the aromatic group represented by $R^{20}$ is a monocyclic or condensed-ring aryl group. Examples of the ring include benzene ring and naphthalene ring. The heterocyclic group represented by $R^{20}$ is a monocyclic or condensed-ring, saturated or unsaturated, aromatic or non-aromatic heterocyclic group. Examples of the ring include pyridine ring, pyrimidine ring, imidazole ring, pyrazole ring, quinoline ring, isoquinoline ring, benzimidazole ring, thiazole ring, benzothiazole ring, piperidine ring, triazine ring and so forth.

$R^{20}$ is preferably an aryl group, especially preferably a phenyl group.

The group represented by $R^{20}$ may be substituted with a substituent. Typical examples of the substituent include, for example, a halogen atom (fluorine, chlorine, bromine or iodine atom), an alkyl group (including an aralkyl group, a cycloalkyl group, an active methine group etc.), an alkenyl group, an alkynyl group, an aryl group, a heterocyclic group, a quaternized nitrogen atom-containing heterocyclic group (e.g., piperidinio group), an acyl group, an alkoxycarbonyl group, an aryloxycarbonyl group, a carbamoyl group, a carboxyl group or a salt thereof, a sulfonylcarbamoyl group, an acylcarbamoyl group, a sulfamoylcarbamoyl group, a carbazoyl group, an oxalyl group, an oxamoyl group, a cyano group, a thiocarbamoyl group, a hydroxy group, an alkoxy group (including a group containing a repeating unit of ethyleneoxy group or propyleneoxy group), an aryloxy group, a heterocyclyloxy group, an acyloxy group, an, (alkoxy or aryloxy) carbonyloxy group, a carbamoyloxy group, a sulfonyloxy group, an amino group, an (alkyl, aryl or heterocyclyl)amino group, an N-substituted nitrogen-containing heterocyclic group, an acylamino group, a sulfonamido group, a ureido group, a thioureido group, an imido group, an (alkoxy or aryloxy)carbonylamino group, a sulfamoylamino group, a semicarbazido group, a thiosemicarbazido group, a hydrazino group, a quaternary ammonio group, an oxamoylamino group, an (alkyl or aryl) sulfonylureido group, an acylureido group, an N-acylsulfamoylamino group, a nitro group, a mercapto group, an (alkyl, aryl or heterocyclyl) thio group, an (alkyl or aryl) sulfonyl group, an (alkyl or aryl)sulfinyl group, a sulfo group or a salt thereof, a sulfamoyl group, an N-acylsulfamoyl group, a sulfonylsulfamoyl group or a salt thereof, a group having phosphoric acid amide or phosphoric acid ester structure and so forth.

These substituents may be further substituted with any of these substituents.

Preferred examples of the substituent that $R^{20}$ may have include an alkyl group having 1–30 carbon atoms (including an active methylene group), an aralkyl group, a heterocyclic group, a substituted amino group, an acylamino group, a sulfonamido group, a ureido group, a sulfamoylamino group, an imido group, a thioureido group, a phosphoric acid amido group, a hydroxyl group, an alkoxy group, an aryloxy group, an acyloxy group, an acyl group, an alkoxycarbonyl group, an aryloxycarbonyl group, a carbamoyl group, a carboxyl group or a salt thereof, an (alkyl, aryl or heterocyclyl) thio group, a sulfo group or a salt thereof, a sulfamoyl group, a halogen atom, a cyano group, a nitro group and so forth.

In the formula (D), $R^{10}$ represents a hydrogen atom or a blocking group, and specific examples of the blocking group include an alkyl group, an alkenyl group, an alkynyl group, an aryl group, a heterocyclic group, an alkoxy group, an aryloxy group, an amino group and a hydrazino group.

The alkyl group represented by $R^{10}$ is preferably an alkyl group having 1–10 carbon atoms. Examples of the alkyl group include methyl group, trifluoromethyl group, difluoromethyl group, 2-carboxytetrafluoroethyl group, pyridiniomethyl group, difluoromethoxymethyl group, difluorocarboxymethyl group, 3-hydroxypropyl group, methanesulfonamidomethyl group, benzenesulfonamidomethyl group, hydroxymethyl group, methoxymethyl group, methylthiomethyl group, phenylsulfonylmethyl group, o-hydroxybenzyl group and so forth. The alkenyl group is preferably an alkenyl group having 1–10 carbon atoms. Examples of the alkenyl group include vinyl group, 2,2-dicyanovinyl group, 2-ethoxycarbonylvinyl group, 2-trifluoro-2-methoxycarbonylvinyl group and so forth. The alkynyl group is preferably an alkynyl group having 1–10 carbon atoms. Examples of the alkynyl group include ethynyl group, 2-methoxycarbonylethynyl group and so forth. The aryl group is preferably a monocyclic or condensed-ring aryl group, and especially preferably an aryl group containing a benzene ring. Examples of the aryl group include phenyl group, 3,5-dichlorophenyl group, 2-methanesulfonamidophenyl group, 2-carbamoylphenyl group, 4-cyanophenyl group, 2-hydroxymethylphenyl group and so forth.

The heterocyclic group is preferably a 5- or 6-membered, saturated or unsaturated, monocyclic or condensed-ring heterocyclic group that contains at least one nitrogen, oxygen or sulfur atom, and it may be a heterocyclic group containing a quaternized nitrogen atom. Examples of the heterocyclic group include a morpholino group, a piperidino group (N-substituted), a piperazino group, an imidazolyl group, an indazolyl group (e.g., 4-nitroindazolyl group etc.), a pyrazolyl group, a triazolyl group, a benzimidazolyl group, a tetrazolyl group, a pyridyl group, a pyridinio group (e.g., N-methyl-3-pyridinio group), a quinolinio group, a quinolyl group and so forth. Among these, especially preferred are a morpholino group, a piperidino group, a pyridyl group, a pyridinio group and so forth.

The alkoxy group is preferably an alkoxy group having 1–8 carbon atoms. Examples of the alkoxy group include methoxy group, 2-hydroxyethoxy group, benzyloxy group and so forth. The aryloxy group is preferably a phenyloxy group. The amino group is preferably an unsubstituted amino group, an alkylamino group having 1–10 carbon atoms, an arylamino group or a saturated or unsaturated heterocyclylamino group (including a quaternized nitrogen atom-containing heterocyclic group). Examples of the amino group include 2,2,6,6-tetramethylpiperidin-4-ylamino group, propylamino group, 2-hydroxyethylamino group, anilino group, o-hydroxyanilino group, 5-benzotriazolylamino group, N-benzyl-3-pyridinioamino group and so forth. The hydrazino group is especially preferably a substituted or unsubstituted hydrazino group, a substituted or unsubstituted phenylhydrazino group (e.g., 4-benzenesulfonamido-phenylhydrazino group) or the like.

The group represented by $R^{10}$ may be substituted with a substituent. Preferred examples of the substituent are the same as those exemplified as the substituent of $R^{20}$.

In the formula (D), $R^{10}$ may be a group capable of splitting the $G^{10}R^{10}$ moiety from the residual molecule and subsequently causing a cyclization reaction that produces a cyclic structure containing atoms of the —$G^{10}$—$R^{10}$ moiety. Examples of such a group include those described in, for example, JP-A-63-29751.

The hydrazine derivatives represented by the formula (D) may contain an absorptive group capable of being absorbed onto silver halide. Examples of the absorptive group include an alkylthio group, an arylthio group, a thiourea group, a thioamido group, a mercaptoheterocyclic group, a triazole group and so forth, described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245 and JP-A-63-234246. Further, these groups capable of being absorbed onto silver halide may be modified into a precursor thereof. Examples of the precursor include those groups described in JP-A-2-285344.

$R^{10}$ or $R^{20}$ in the formula (D) may contain a polymer or ballast group that is usually used for immobile photographic additives such as couplers. The ballast group used in the present invention means a group having 6 or more carbon atoms including such a linear or branched alkyl group (or an alkylene group), an alkoxy group (or an alkyleneoxy group), an alkylamino group (or an alkyleneamino group), an alkylthio group or a group having any of these groups as a partial structure, more preferably a group having 7–24 carbon atoms including such a linear or branched alkyl group (or an alkylene group), an alkoxy group (or an alkyleneoxy group), an alkylamino group (or an alkyleneamino group), an alkylthio group or a group having any of these groups as a partial structure. Examples of the polymer include those described in, for example, JP-A-1-100530.

$R^{10}$ or $R^{20}$ in the formula (D) may contain a plurality of hydrazino groups as substituents. In such a case, the compound represented by the formula (D) is a multi-mer for hydrazino group. Specific examples of such a compound include those described in, for example, JP-A-64-86134, JP-A-4-16938, JP-A-5-197091, WO95/32452, WO95/32453, JP-A-9-179229, JP-A-9-235264, JP-A-9-235265, JP-A-9-235266, JP-A-9-235267 and so forth.

$R^{10}$ or $R^{20}$ in the formula (D) may contain a cationic group (specifically, a group containing a quaternary ammonio group, a group containing a quaternized phosphorus atom, a nitrogen-containing heterocyclic group containing a quaternized nitrogen atom etc.), a group containing repeating units of ethyleneoxy group or propyleneoxy group, an (alkyl, aryl or heterocyclyl)thio group, or a dissociating group (this means a group or partial structure having a proton of low acidity that can be dissociated with an alkaline developer or a salt thereof, specifically, for example, carboxyl group (—COOH), sulfo group (—$SO_3H$), phosphonic acid group (—$PO_3H$), phosphoric acid group (—$OPO_3H$), hydroxy group (—OH), mercapto group (—SH), —$SO_2NH_2$ group, N-substituted sulfonamido group (—$SO_2NH$—, —$CONHSO_2$— group, —$CONHSO_2NH$— group, —$NHCONHSO_2$—, group, —$SO_2NHSO_2$— group), —CONHCO— group, active methylene group, —NH— group contained in a nitrogen-containing heterocyclic group, a salt thereof etc.). Examples of the compounds containing these groups include those described in, for example, JP-A-7-234471, JP-A-5-333466, JP-A-6-19032, JP-A-6-19031, JP-A-5-45761, U.S. Pat. Nos. 4,994,365 and 4,988,604, JP-A-7-259240, JP-A-7-5610, JP-A-7-244348, and German Pat. No. 4006032, JP-A-11-7093 and so forth.

In the formula (D), $A^{10}$ and $A^{20}$ each represent a hydrogen atom or an alkyl- or arylsulfonyl group having 20 or less carbon atoms (preferably, phenylsulfonyl group, or a phenylsulfonyl group substituted with substituent(s) so that the total of the Hammett substituent constant of the substituent (s) should become −0.5 or more), or an acyl group having 20 or less carbon atoms (preferably, benzoyl group, a benzoyl group substituted with substituent(s) so that the total of the Hammett substituent constant of the substituent(s) should become −0.5 or more, or a straight, branched or cyclic, substituted or unsubstituted, aliphatic acyl group (examples of the substituent include a halogen atom, an ether group, a sulfonamido group, a carbonamido group, a hydroxyl group, a carboxyl group, a sulfo group etc.)). $A^{10}$ and $A^{20}$ each most preferably represent a hydrogen atom.

Hereafter, hydrazine derivatives especially preferably used for the present invention are explained.

$R^{20}$ is especially preferably a substituted phenyl group. Particularly preferred as the substituent are a sulfonamido group, an acylamino group, a ureido group, a carbamoyl group, a thioureido group, an isothioureido group, a sulfamoylamino group, an N-acylsulfamoylamino group and so forth, further preferred are a sulfonamido group and a ureido group, and the most preferred is a sulfonamido group.

The hydrazine derivatives represented by the formula (D) preferably have at least one substituent, directly or indirectly on $R^{20}$ or $R^{10}$, selected from the group consisting of a ballast group, a group that can be absorbed on silver halide, a group containing quaternary ammonio group, a nitrogen-containing heterocyclic group containing a quaternized nitrogen atom, a group containing repeating units of ethyleneoxy group, an (alkyl, aryl or heterocyclyl)thio group, a dissociating group capable of dissociating in an alkaline developer, and a hydrazino group capable of forming a multi-mer (group represented by —NHNH—$G^{10}$—$R^{20}$). Furthermore, $R^{20}$ preferably directly or indirectly has one group selected from the aforementioned groups as a substituent, and $R^{20}$ is most preferably a phenyl group substituted with a benzenesulfonamido group directly or indirectly having one of the aforementioned groups as a substituent on the benzene ring.

Among those groups represented by $R^{10}$, when $G^{10}$ is —CO— group, preferred are a hydrogen atom, an alkyl group, an alkenyl group, an alkynyl group, an aryl group and a heterocyclic group, more preferred are a hydrogen atom, an alkyl group or a substituted aryl group (the substituent is especially preferably an electron-withdrawing group or o-hydroxymethyl group), and the most preferred are a hydrogen atom and an alkyl group.

When $G^{10}$ is —COCO— group, an alkoxy group, an aryloxy group, and an amino group are preferred, and a substituted amino group, specifically an alkylamino group, an arylamino group and a saturated or unsaturated heterocyclylamino group are especially preferred.

Further, when $G^{10}$ is —$SO_2$— group, $R^{10}$ is preferably an alkyl group, an aryl group or a substituted amino group.

In the formula (D), $G^{10}$ is preferably —CO— group or —COCO— group, especially preferably —CO— group.

Specific examples of the compounds represented by the formula (D) are illustrated below, but the present invention is not limited to the following compounds.

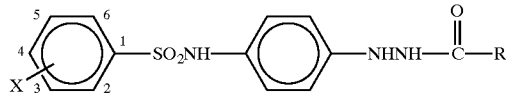
| X = | | R = —H | —$C_2F_4$—COOH (or —$C_2F_4$—$COO^{\ominus}K^{\oplus}$) | 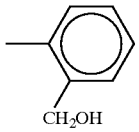 | 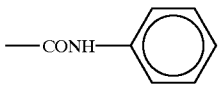 |
|---|---|---|---|---|---|
| D-1 | 3-$NHCOC_9H_{19}$(n) | 1a | 1b | 1c | 1d |
| D-2 | 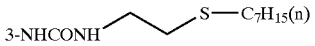 | 2a | 2b | 2c | 2d |
| D-3 | 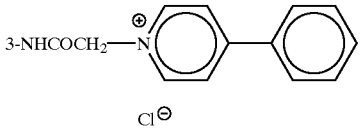 | 3a | 3b | 3c | 3d |
| D-4 | 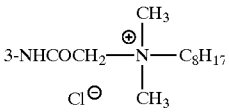 | 4a | 4b | 4c | 4d |
| D-5 | 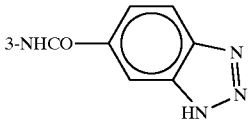 | 5a | 5b | 5c | 5d |
| D-6 | 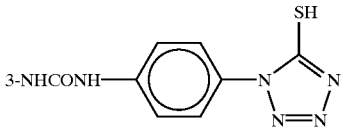 | 6a | 6b | 6c | 6d |
| D-7 | 2,4-$(CH_3)_2$-3-$SC_2H_4(OC_2H_4)_4$—$OC_8H_{17}$ | 7a | 7b | 7c | 7d |

-continued
| | X = | R = —H | —$CF_2H$ | 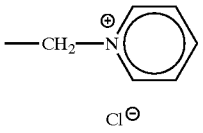 | 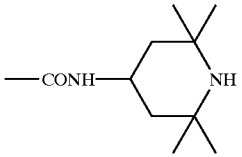 |
|---|---|---|---|---|---|
| D-8 | 3-$CONHCH_2CH(C_2H_5)C_4H_9$ | 8a | 8e | 8f | 8g |
| D-9 | 6-$OCH_3$-3-$C_5H_{11}$(t) | 9a | 9e | 9f | 9g |
| D-10 | 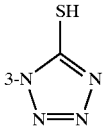 | 10a | 10e | 10f | 10g |
| D-11 | 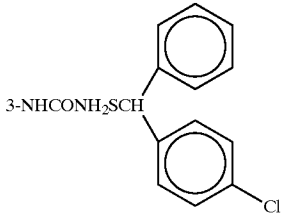 | 11a | 11e | 11f | 11g |
| D-12 | 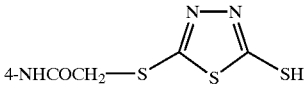 | 12a | 12e | 12f | 12g |
| D-13 | 3-$NHCOCH(CH_2COOH)C_8H_{17}$ | 13a | 13e | 13f | 13g |
| D-14 | 3,5-$(CONHCH_2CH(C_2H_5)C_4H_9)_2$ | 14a | 14e | 14f | 14g |

-continued
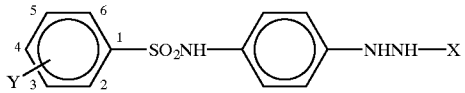
| | Y = | X = —CHO | —COCF$_3$ | —SO$_2$CH$_3$ | —P(=O)(OC$_2$H$_5$)$_2$ |
|---|---|---|---|---|---|
| D-15 | 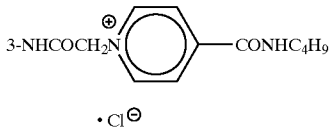 | 15a | 15h | 15i | 15j |
| D-16 | 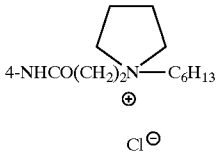 | 16a | 16h | 16i | 16j |
| D-17 | 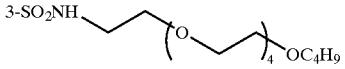 | 17a | 17h | 17i | 17j |
| D-18 | 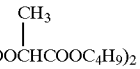 | 18a | 18h | 18i | 18j |
| D-19 | 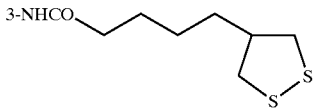 | 19a | 19h | 19i | 19j |
| D-20 | 3-NHSO$_2$NH—C$_8$H$_{17}$ | 20a | 20h | 20i | 20j |
| D-21 | 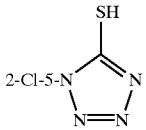 | 21a | 21h | 21i | 21j |

-continued
| | | R = | | | |
|---|---|---|---|---|---|
| | | —H | —$CF_2H$ | 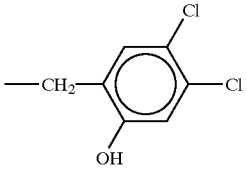 | —$CONHC_3H_7$ |
| D-22 | 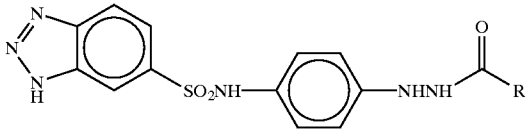 | 22a | 22e | 22k | 22l |
| D-23 | 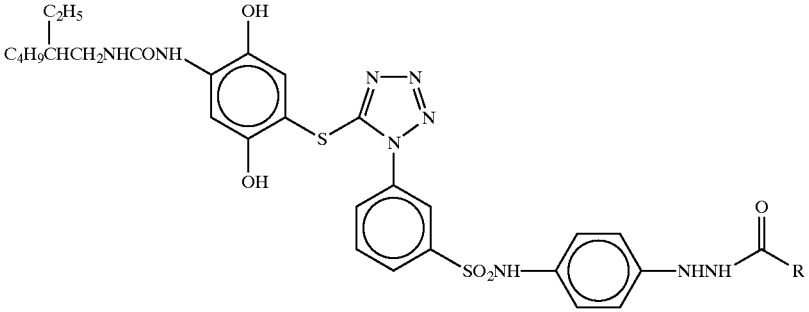 | 23a | 23e | 23k | 23l |
| D-24 | 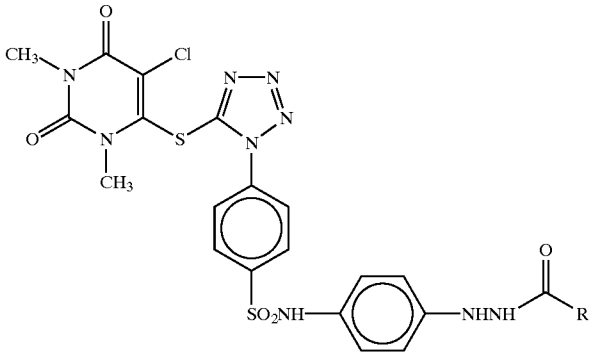 | 24a | 24e | 24k | 24l |

-continued
| | | | | | |
|---|---|---|---|---|---|
| D-25 | 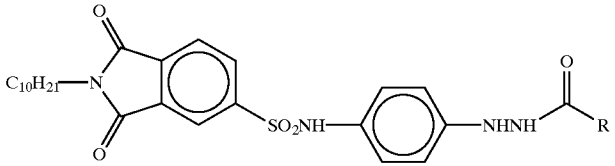 | 25a | 25e | 25k | 25l |
| D-26 | 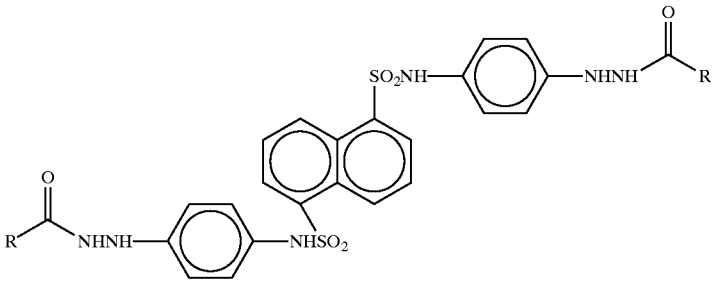 | 26a | 26e | 26k | 26l |
| D-27 | 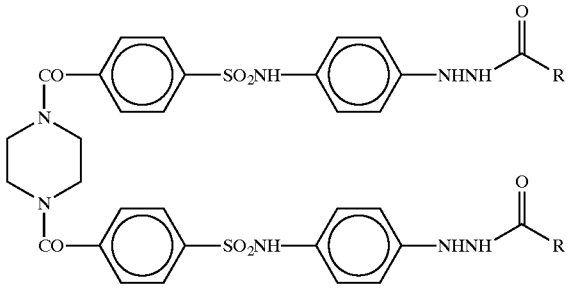 | 27a | 27e | 27k | 27l |
| D-28 | 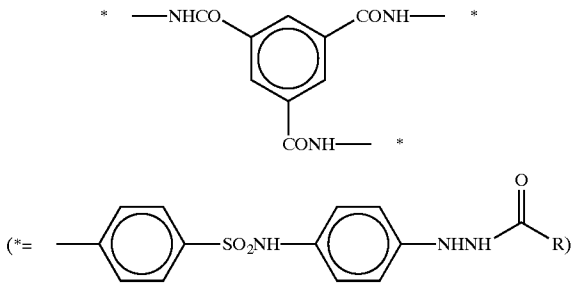 | 28a | 28e | 28k | 28l |

-continued
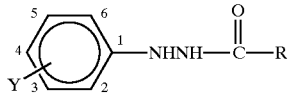
| | Y = | R = —H | —$CH_2OCH_3$ | 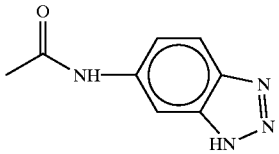 | 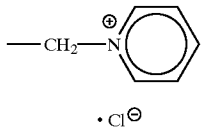 |
|---|---|---|---|---|---|
| D-29 | 4-NHC(=S)NH—$C_8H_{17}$(n) | 29a | 29m | 29n | 29f |
| D-30 | 4-NHP(=S)($OCH_2$—Ph)$_2$ | 30a | 30m | 30n | 30f |
| D-31 | 4-NHCONH—$(CH_2)_3O$—Ph—C(CH$_3$)$_3$ | 31a | 31m | 31n | 31f |
| D-32 | 4-OH, 3-NHCONH$CH_2$CH($C_2H_5$)—$C_4H_9$ | 32a | 32m | 32n | 32f |
| D-33 | 4-$NHSO_2(CH_2)_2NHCO$—Ph—(5-SH-tetrazolyl) | 33a | 33m | 33n | 33f |
| D-34 | 4-$OCH_2$—Ph | 34a | 34m | 34n | 34f |

-continued
| | | | | | |
|---|---|---|---|---|---|
| D-35 | 4-NHCONHN—(CH$_2$— 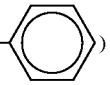 )$_2$ | 35a | 35m | 35n | 35f |
| | | R = | | | |
| | Y = | —H | —C$_3$F$_6$—COOH | —CONHCH$_3$ | 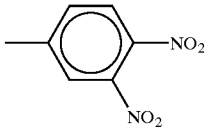 |
| D-36 | 2-NHSO$_2$CH$_3$— | 36a | 36o | 36p | 36q |
| | 2-NHSO$_2$CH$_3$— | | | | |
| | 4-NHCONH(CH$_2$)$_3$S— 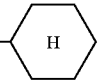 | | | | |
| D-37 | 2-OCH$_3$— | 37a | 37o | 37p | 37q |
| | 4-NHSO$_2$C$_{12}$H$_{25}$ | | | | |
| D-38 | 3-NHCOC$_{11}$H$_{23}$— | 38a | 38o | 38p | 38q |
| | 4-NHSO$_2$CF$_3$ | | | | |
| D-39 | 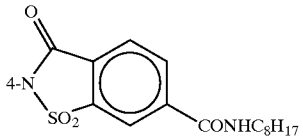 | 39a | 39o | 39p | 39q |
| D-40 | 4-OCO(CH$_2$)$_2$COOC$_6$H$_{13}$ | 40a | 40o | 40p | 40q |
| D-41 | 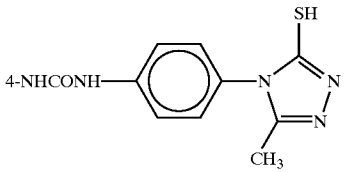 | 41a | 41o | 41p | 41q |

-continued
| | | | | | |
|---|---|---|---|---|---|
| D-42 | 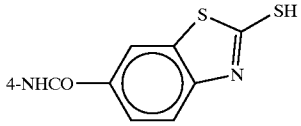 | 42a | 42o | 42p | 42q |
| No. | |
|---|---|
| D-43 | 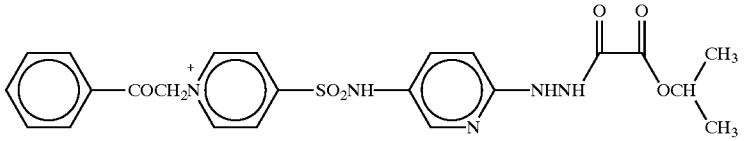 |
| D-44 | 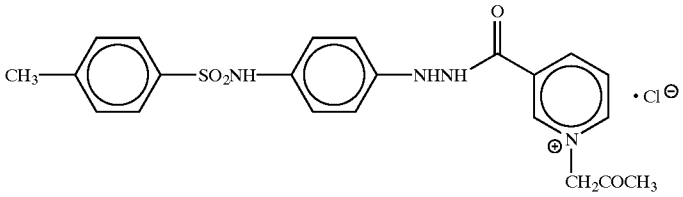 |
| D-45 | 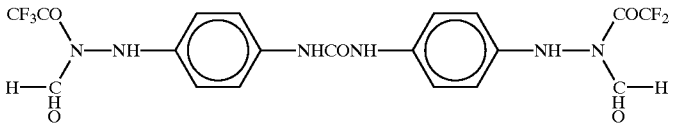 |
| D-46 | 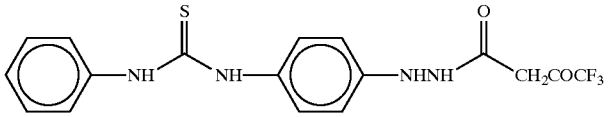 |
| D-47 | 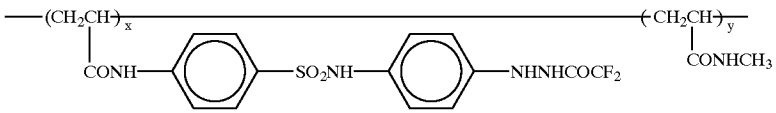 x:y=3:97 |

-continued
D-48
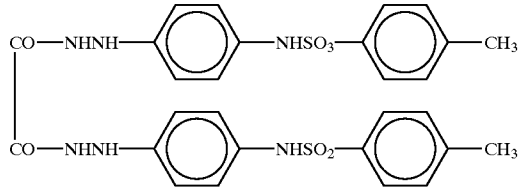
D-49
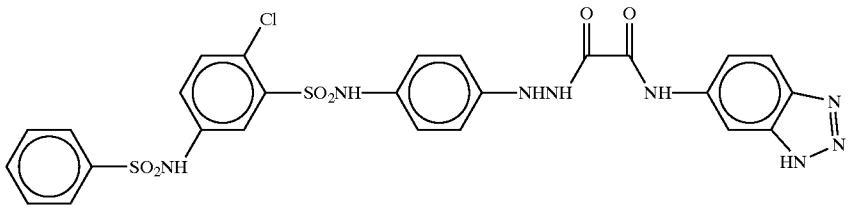
D-50
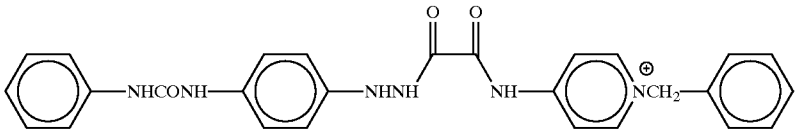
D-51
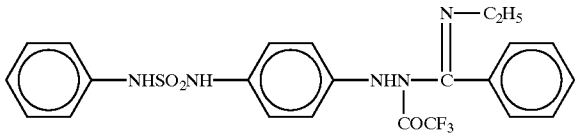
D-52
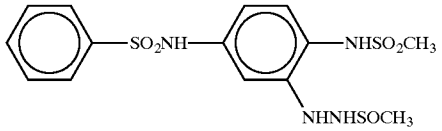
D-53
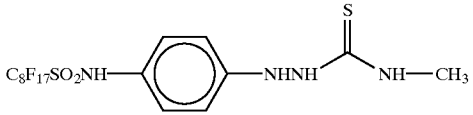

-continued
D-54
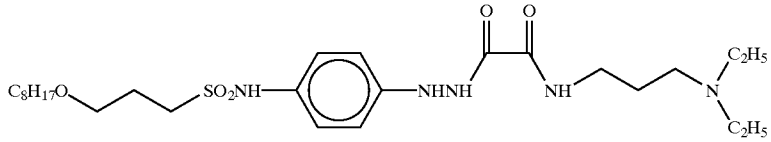
D-55
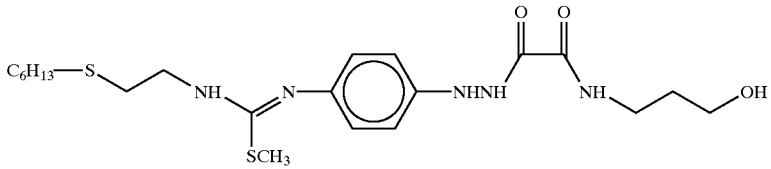
D-56
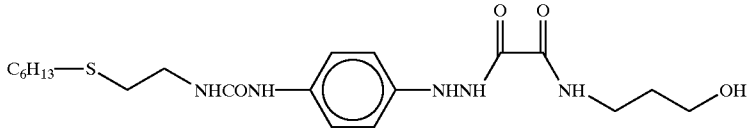
D-57
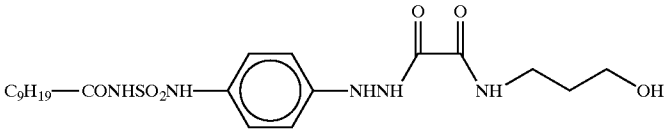
D-58
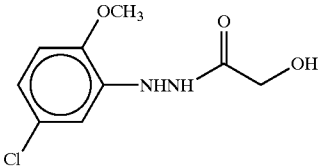
D-59
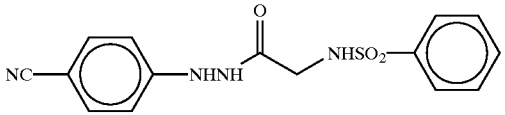

-continued
D-60
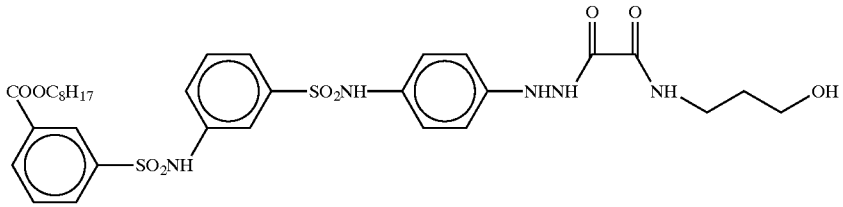
D-61
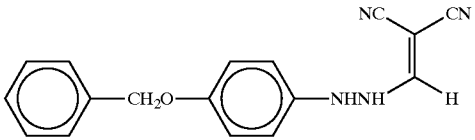
D-62
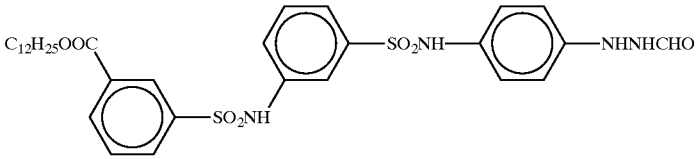
D-63
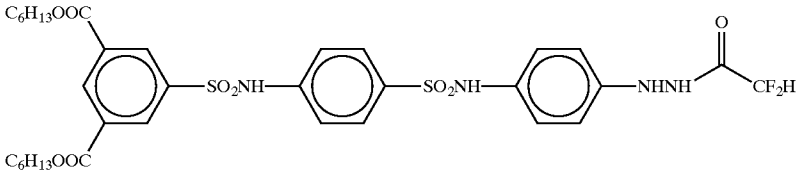
D-64
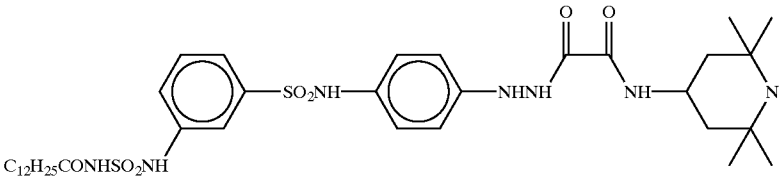

-continued
D-65
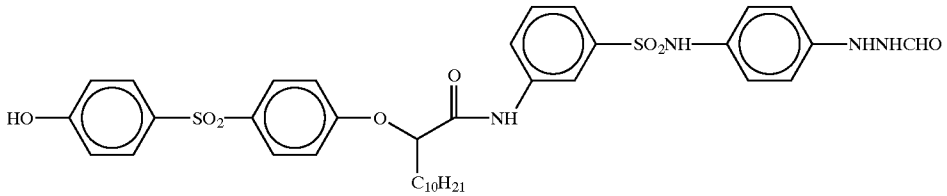
D-66
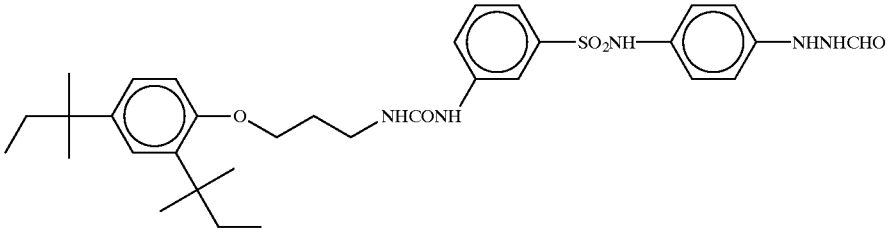
D-67
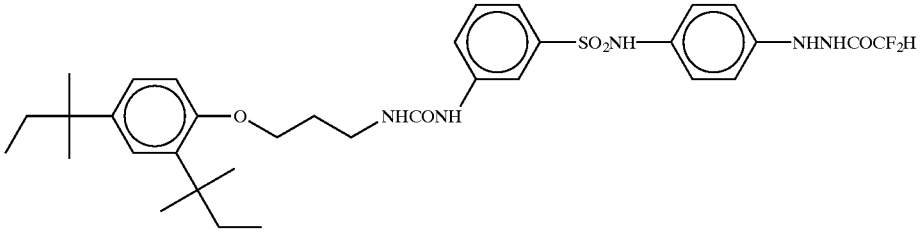
(D-68)
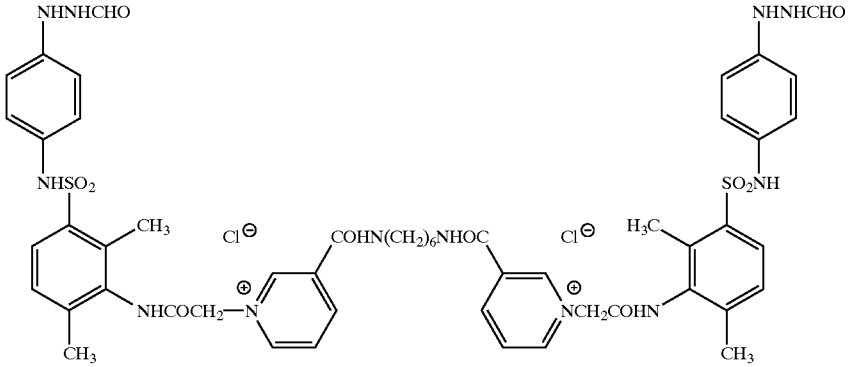

-continued
(D-69)
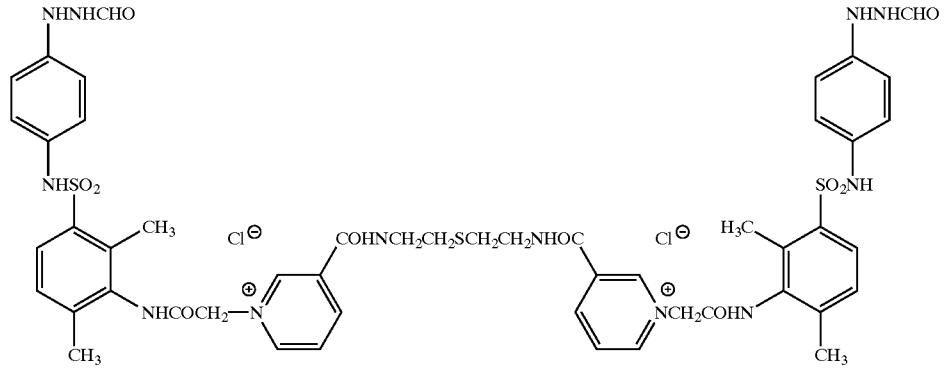
(D-70)
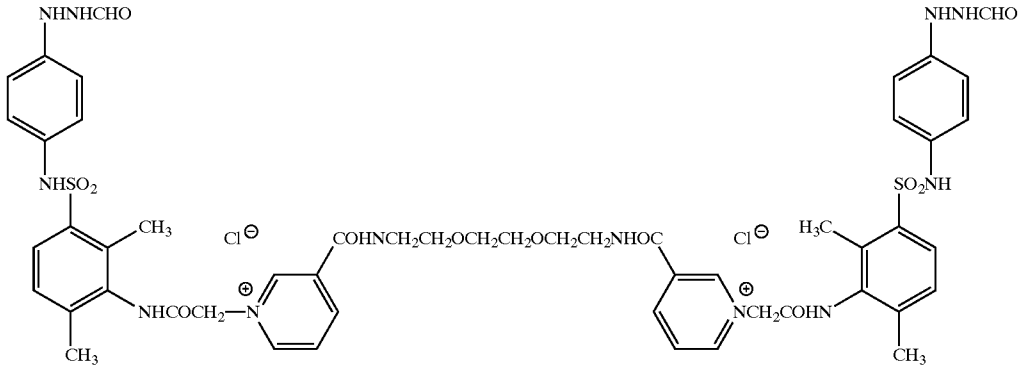

-continued
(D-71)
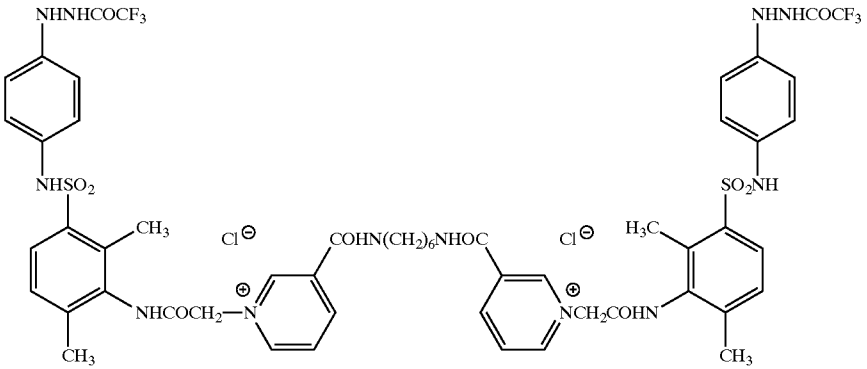
(D-72)
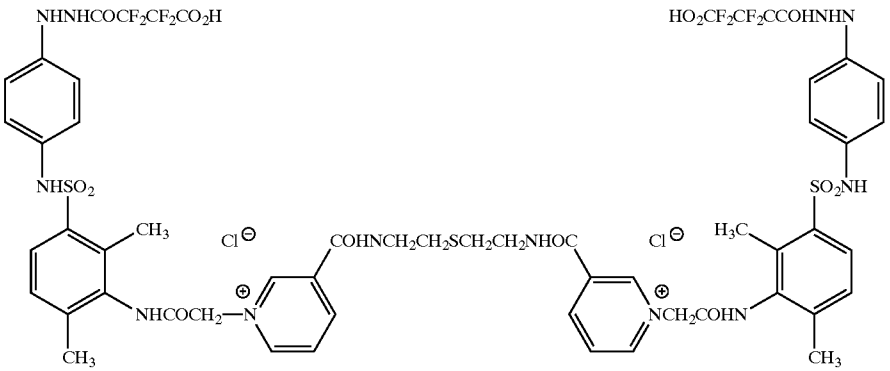

-continued
(D-73)
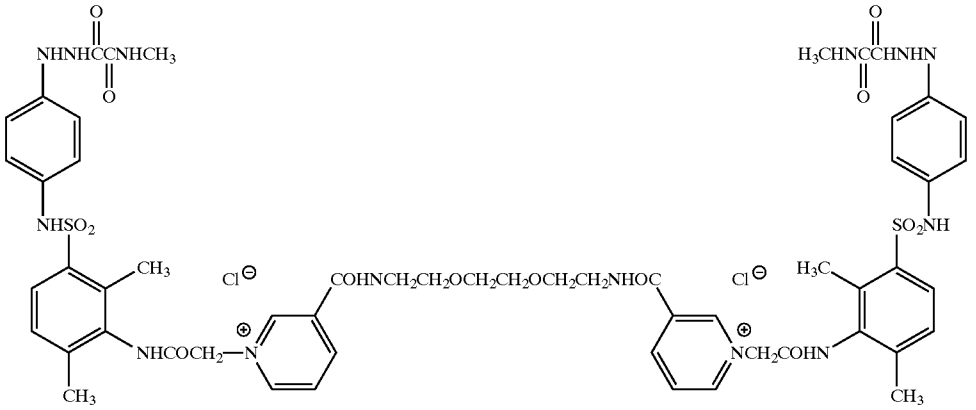
(D-74)
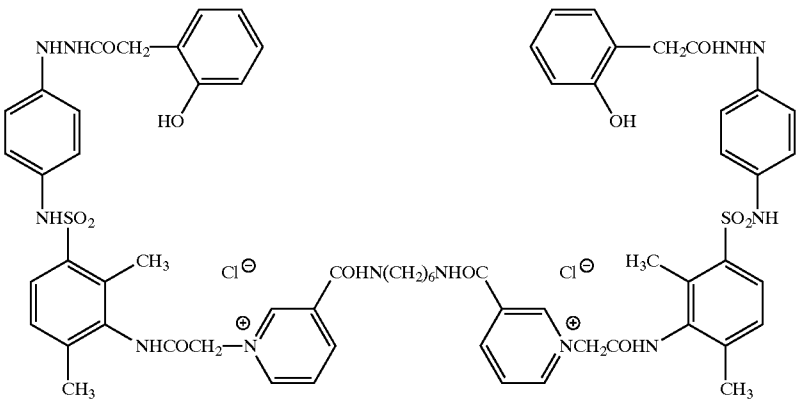

-continued
(D-75)
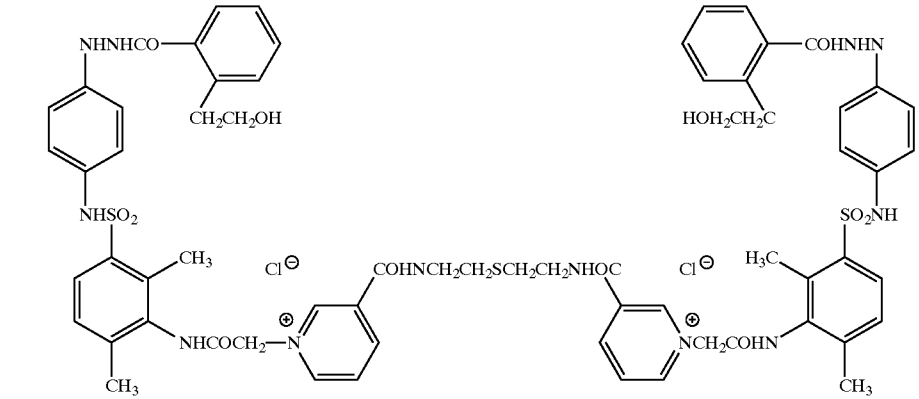
(D-76)
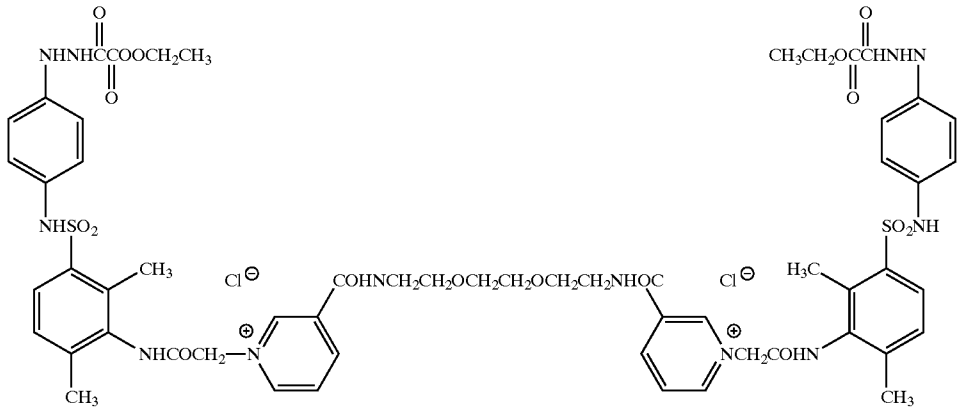

-continued
(D-77)
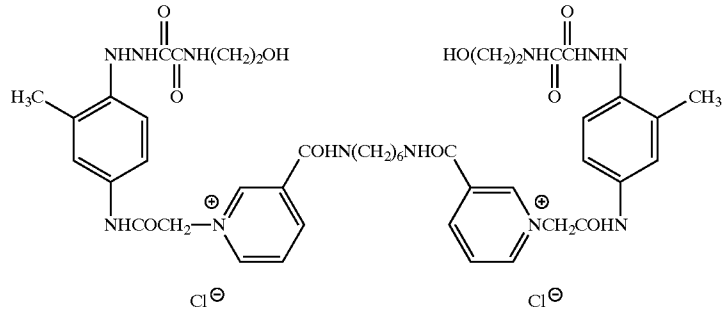
(D-78)
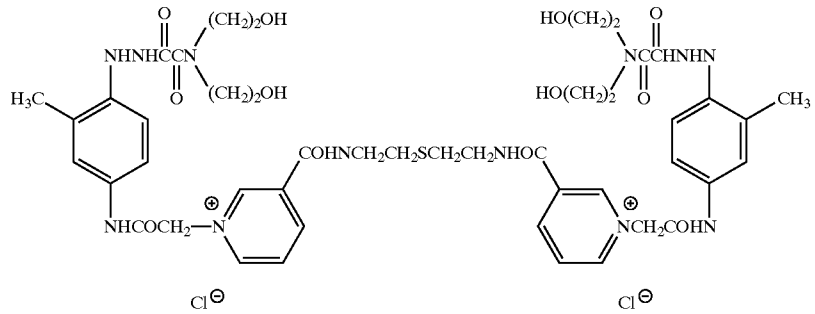
(D-79)
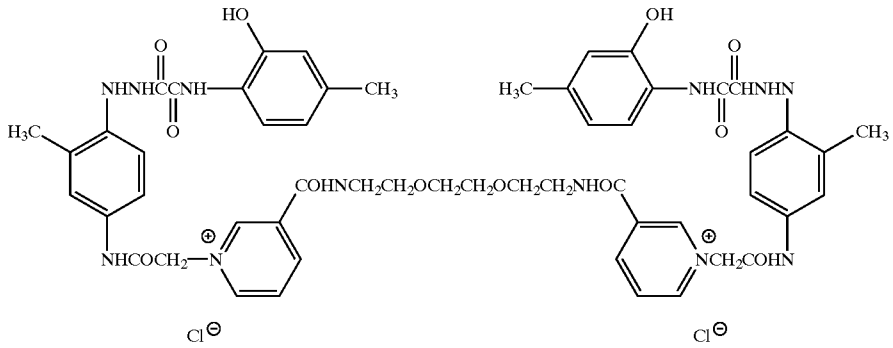

-continued
(D-80)
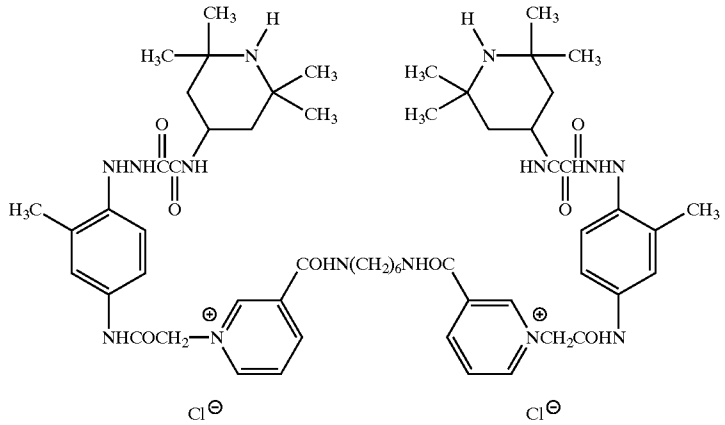
(D-81)
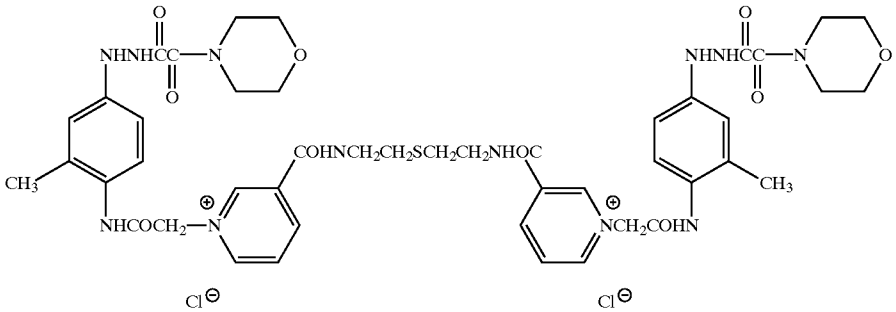
(D-82)
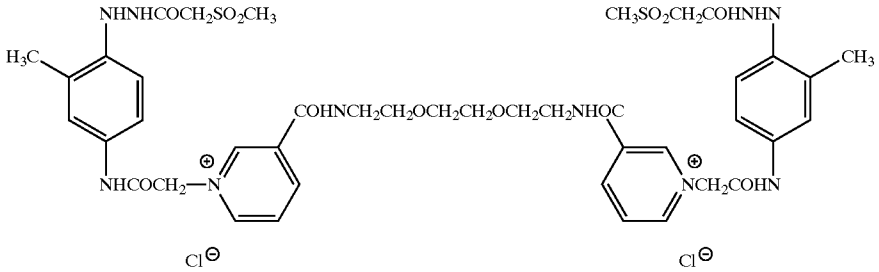

-continued
(D-83)
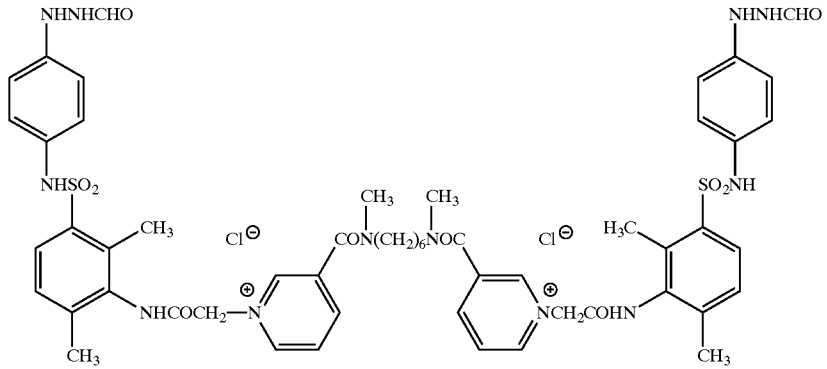
(D-84)
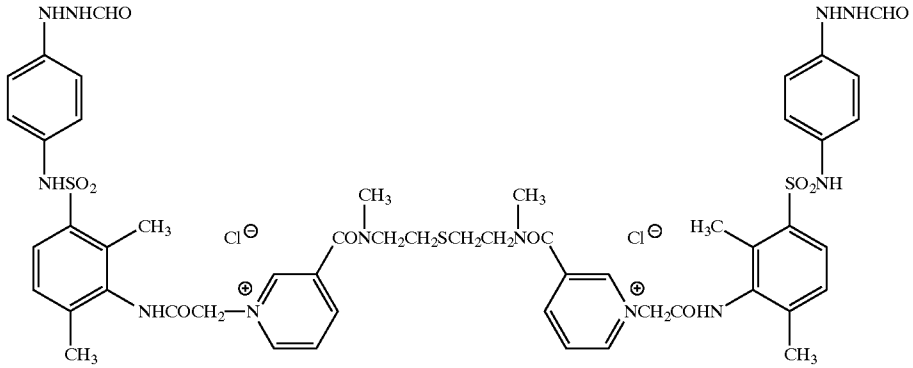

-continued
(D-85)
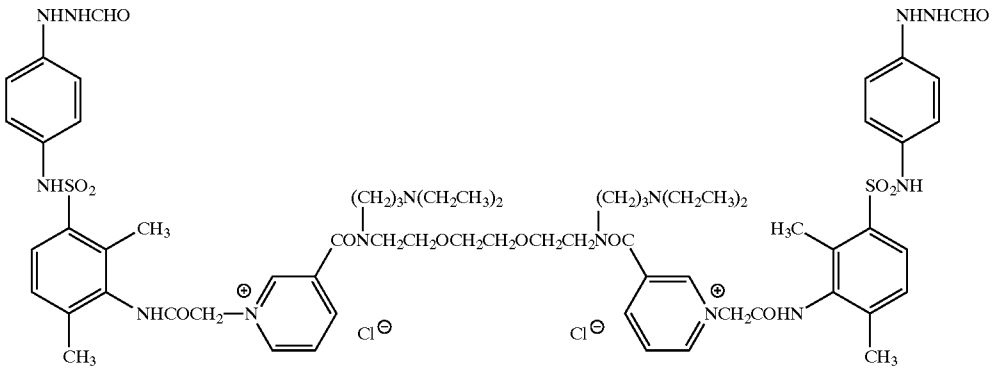
(D-86)
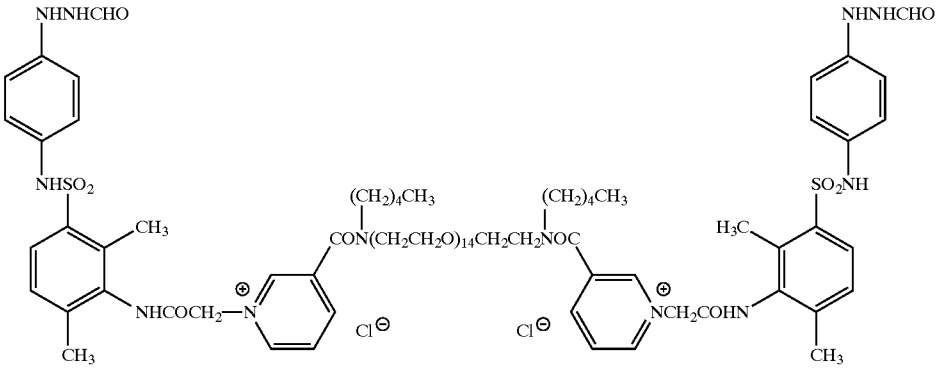

-continued
(D-87)
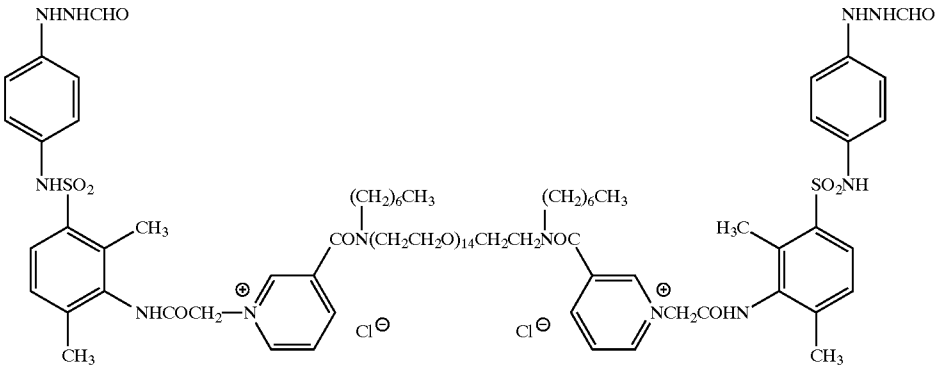
(D-88)
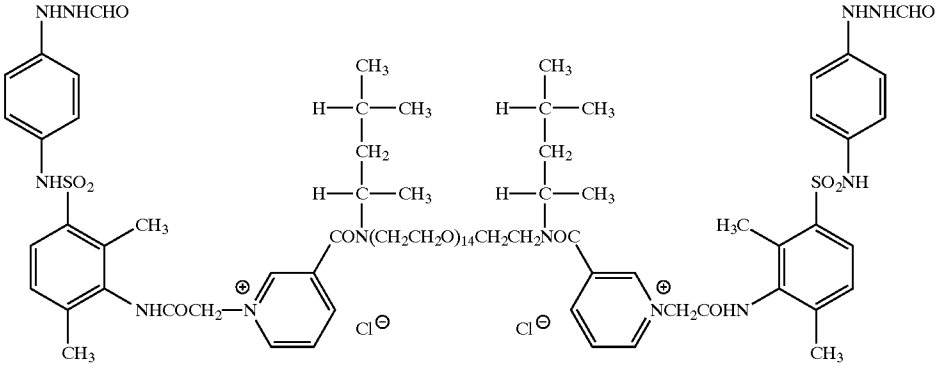

-continued
(D-89)
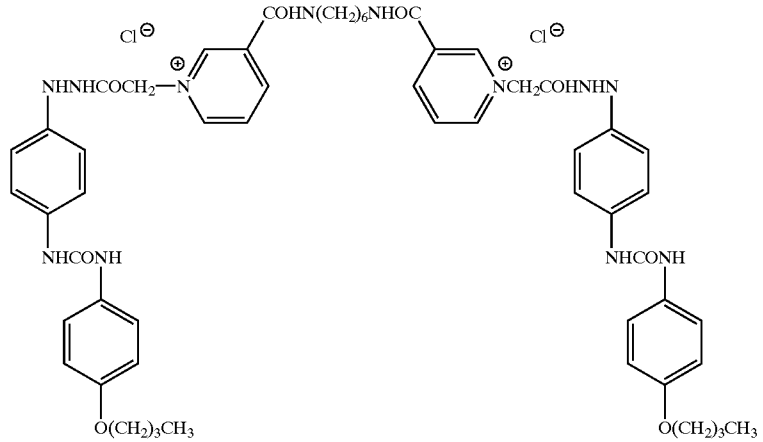
(D-90)
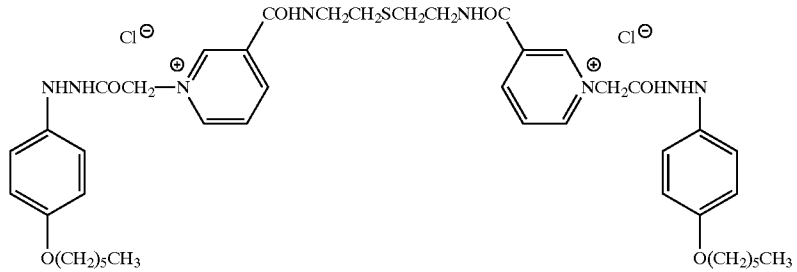
(D-91)
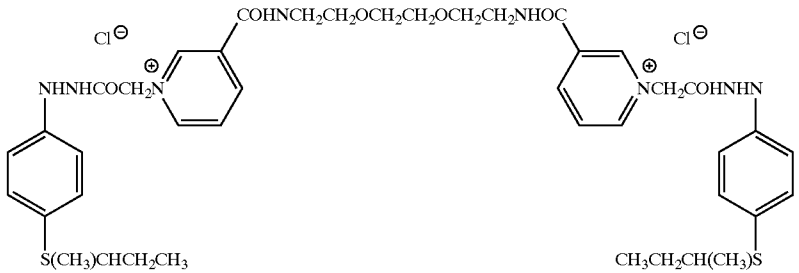

-continued
(D-92)
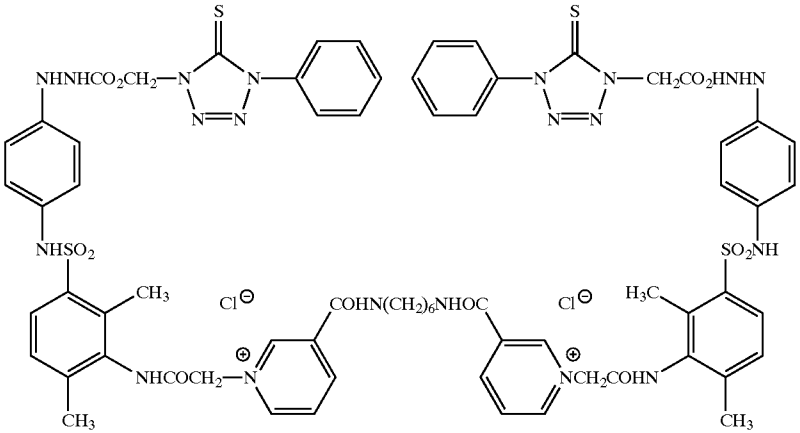
(D-93)
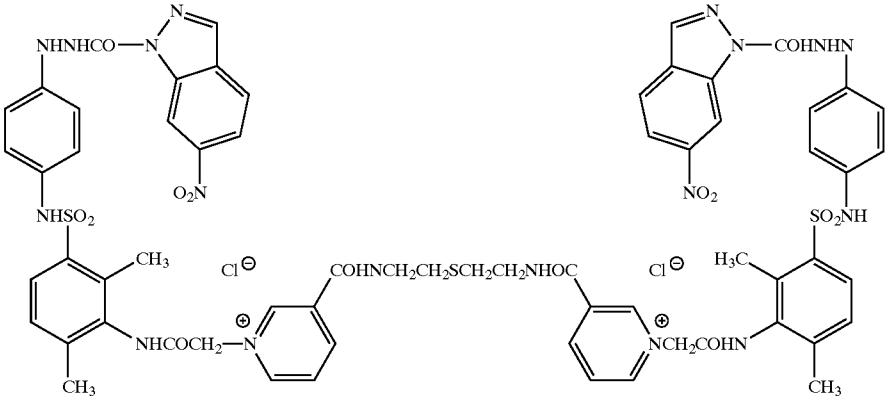

-continued
(D-94)
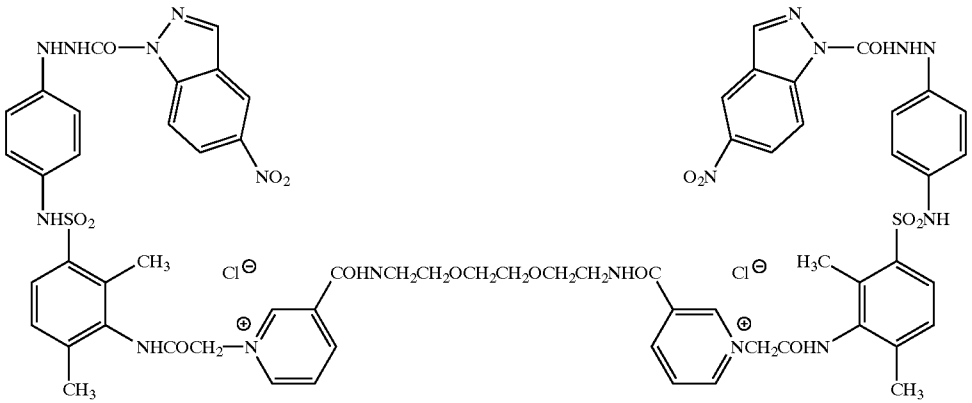
(D-95)
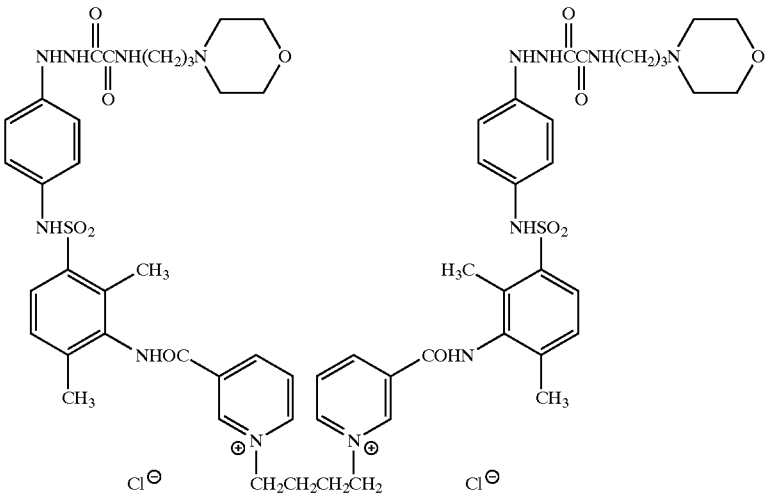

-continued
(D-96)
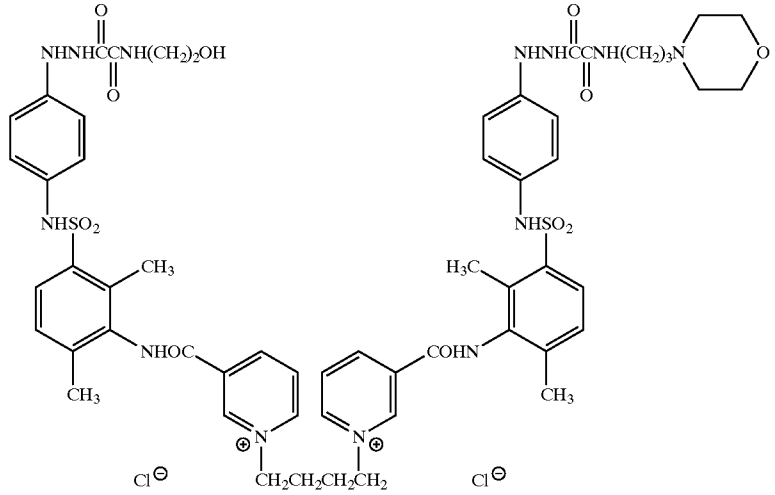
(D-97)
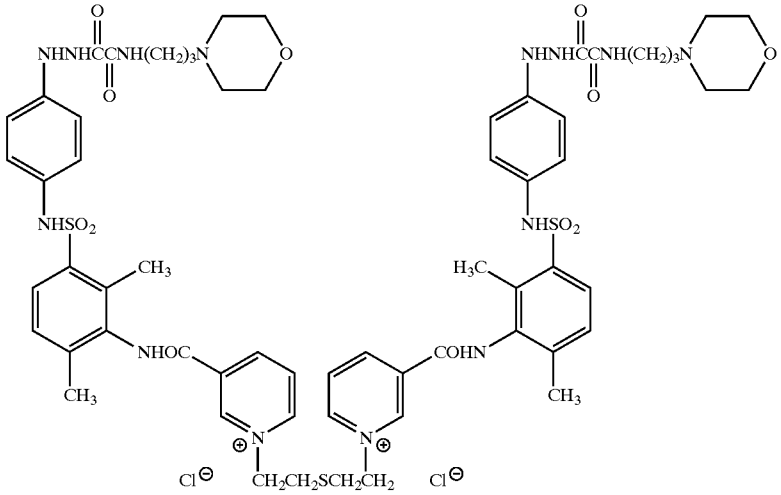

-continued
(D-98)
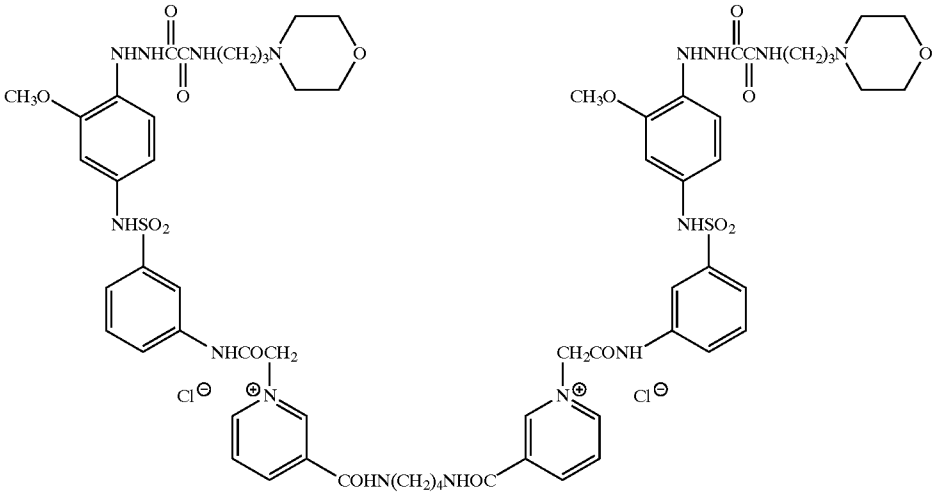
(D-99)
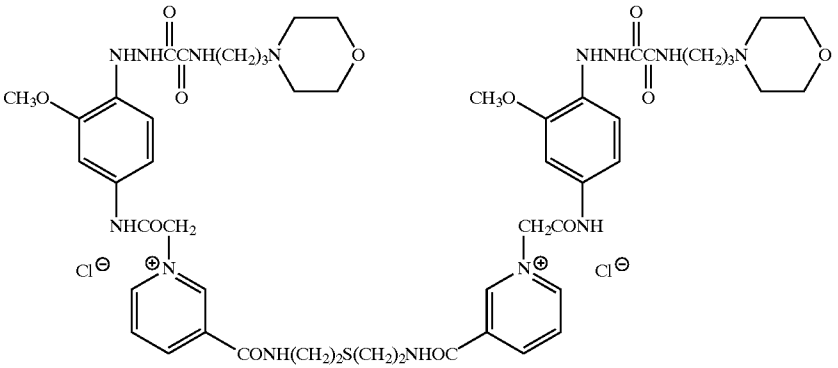

-continued
(D-100)
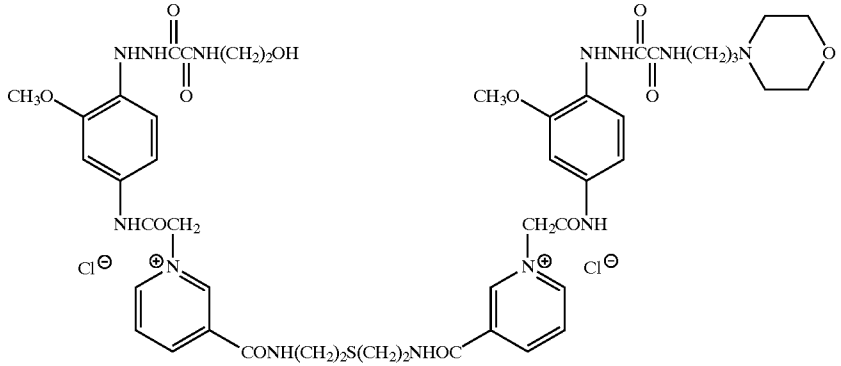
(D-101)
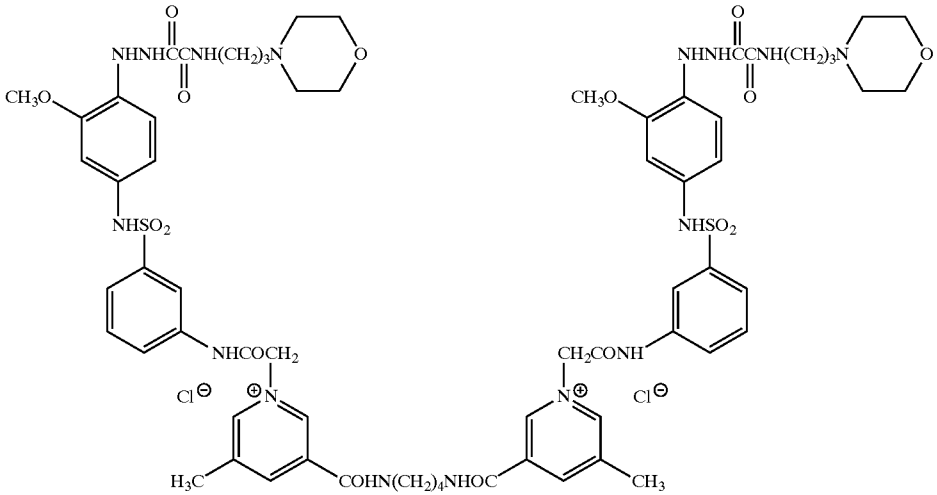

-continued
(D-102)
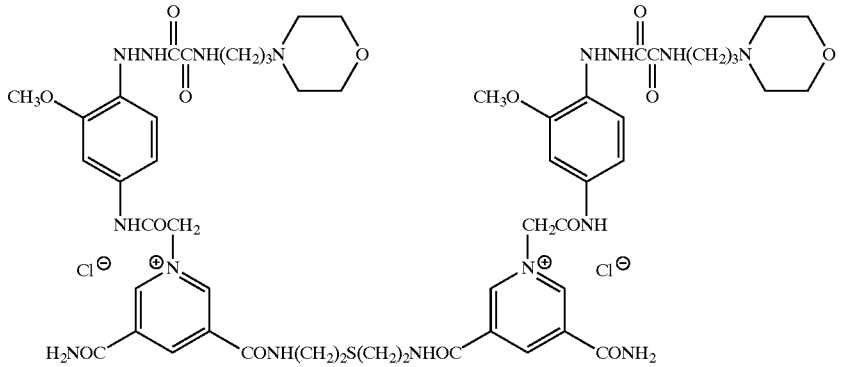
(D-103)
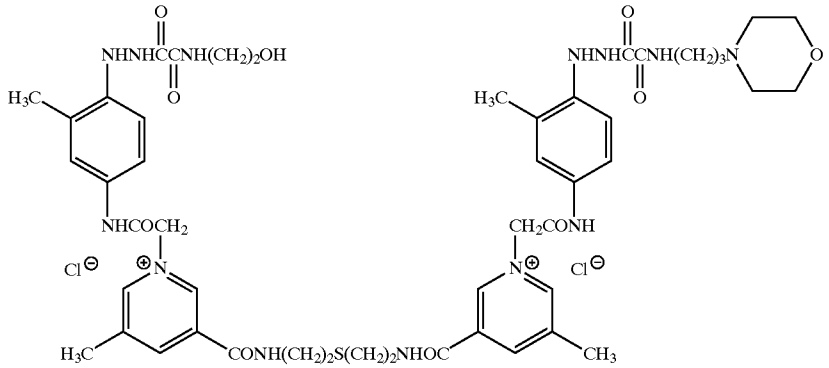

-continued
(D-104)
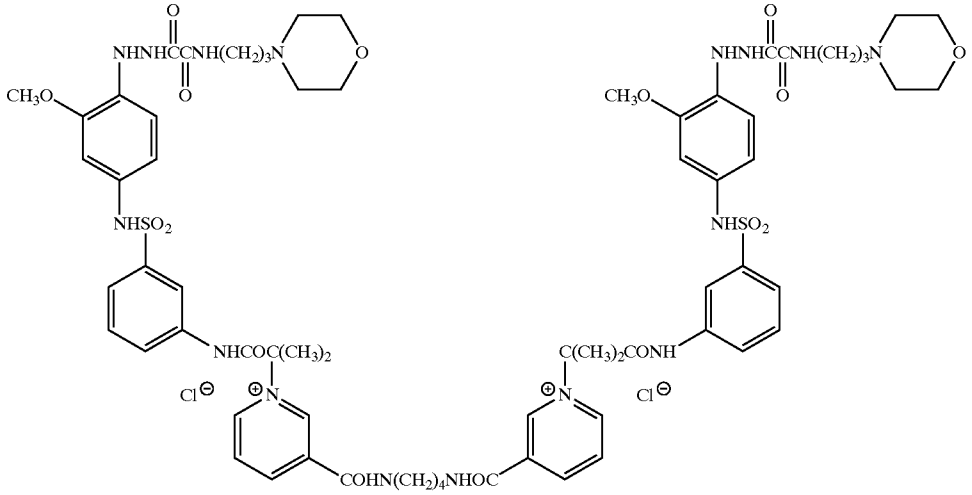
(D-105)
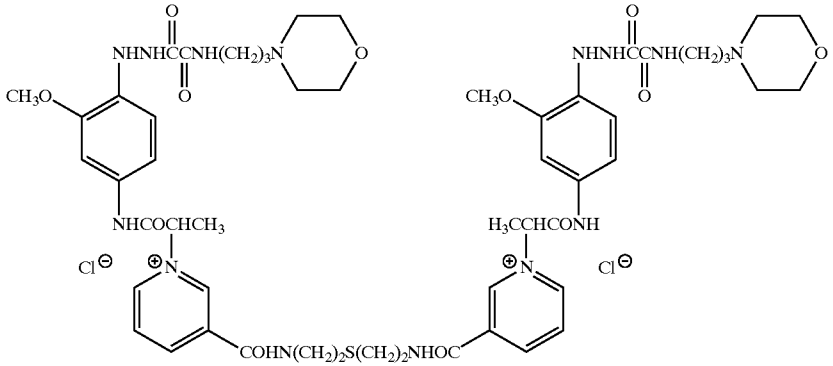

-continued
(D-106)
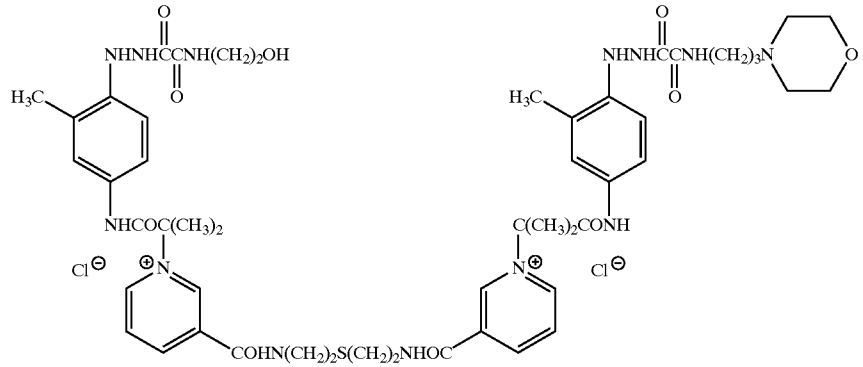
(D-107)
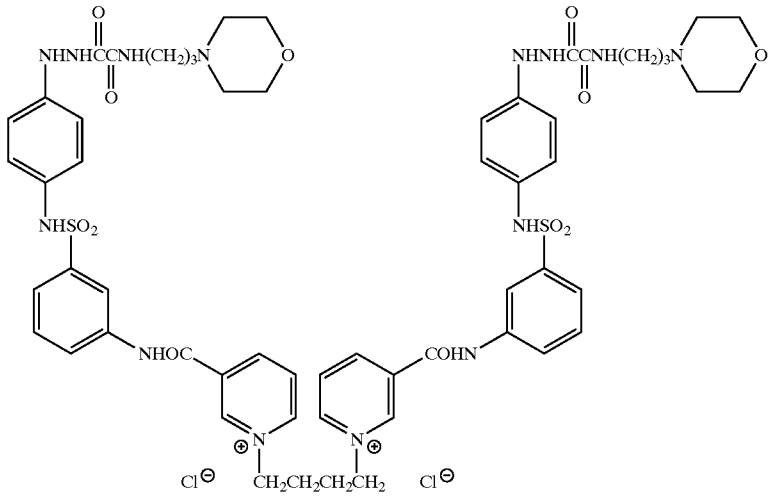

-continued
(D-108)
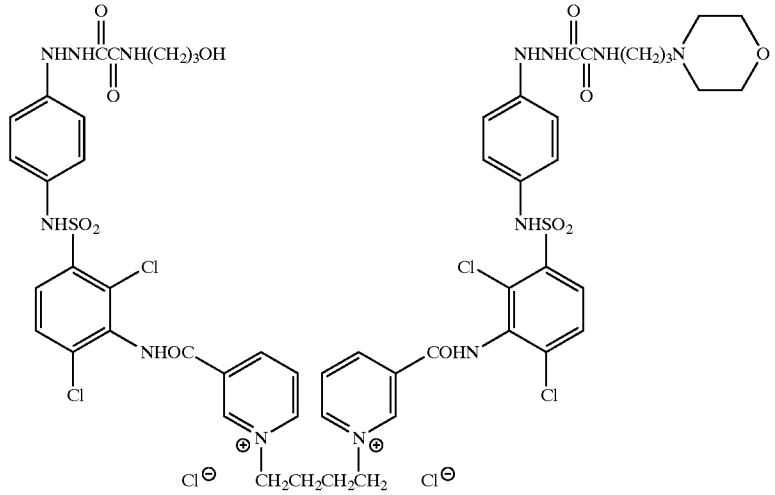
(D-109)
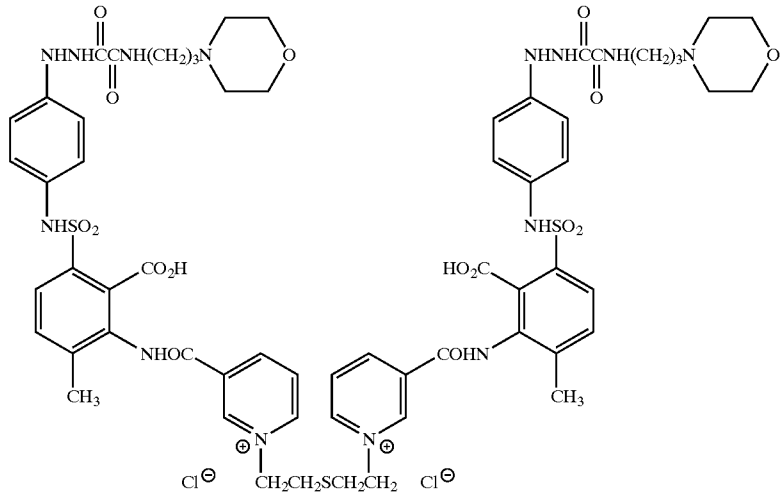

-continued
(D-110)
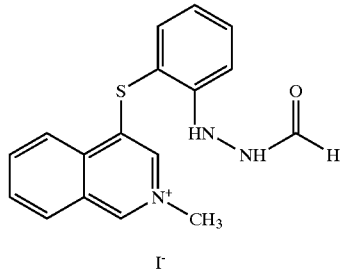
(D-111)
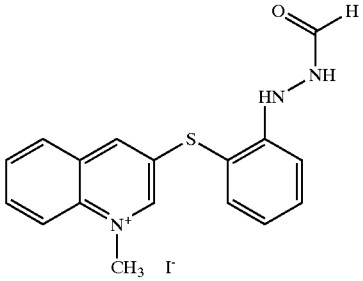
(D-112)
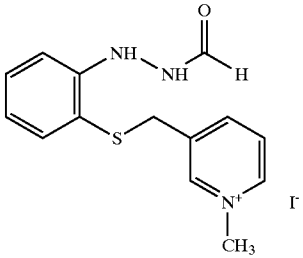

-continued
(D-113)
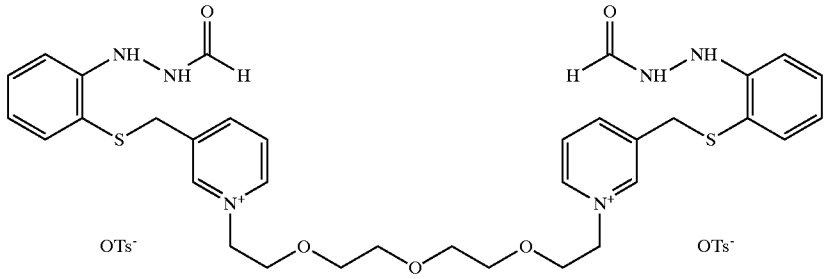
(D-114)
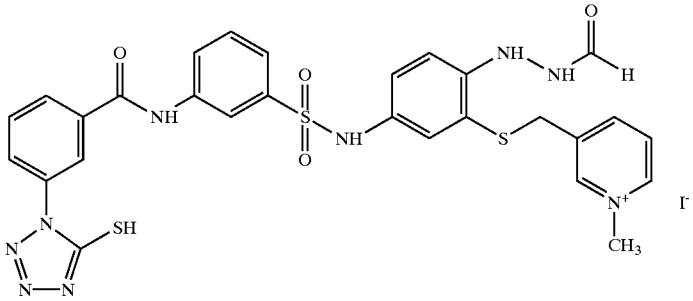
(D-115)
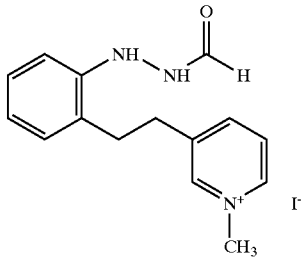

-continued
(D-116)
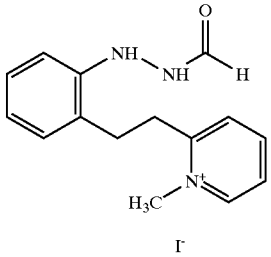
(D-117)
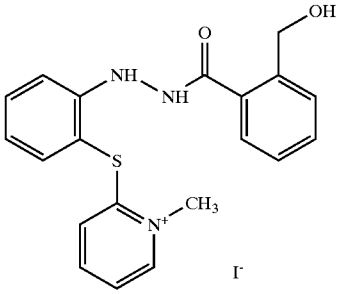
(D-118)
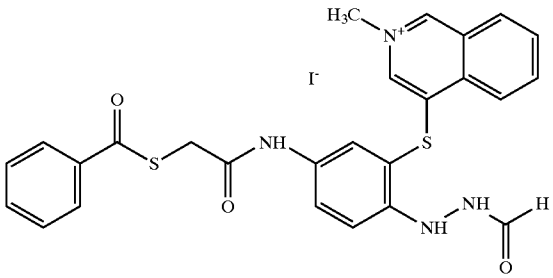
(D-119)
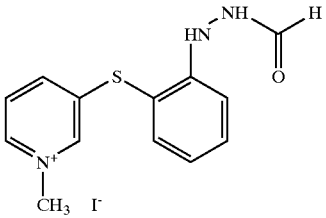

-continued
(D-120)
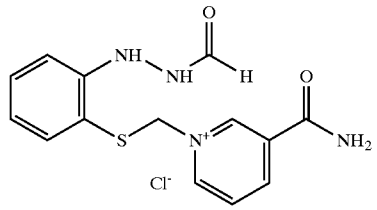
(D-121)
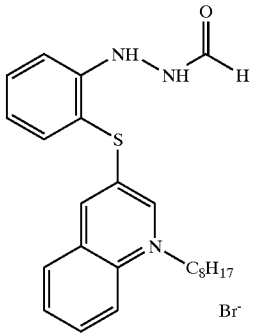
(D-122)
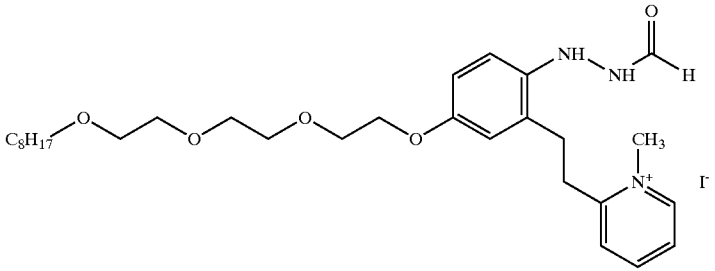

-continued
(D-123)
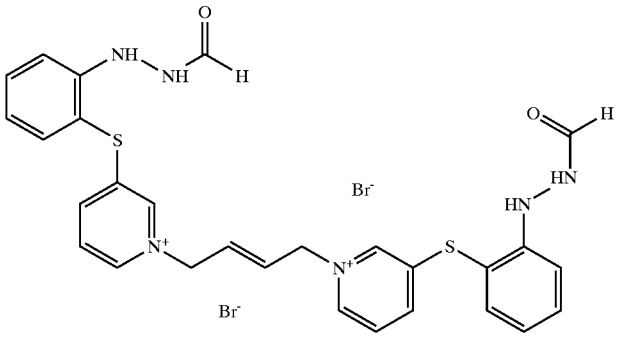
(D-124)
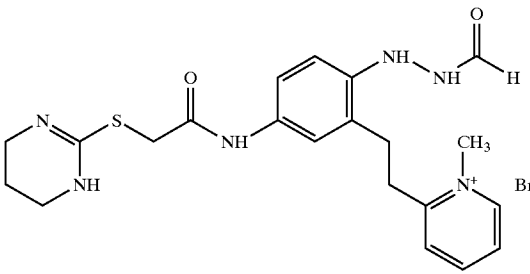
(D-125)
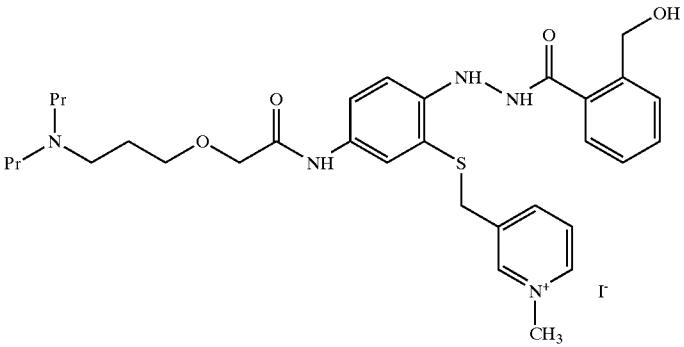

-continued
(D-126)
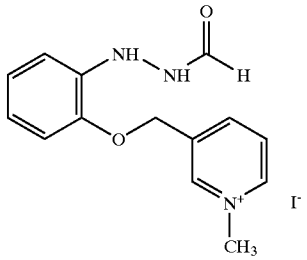
(D-127)
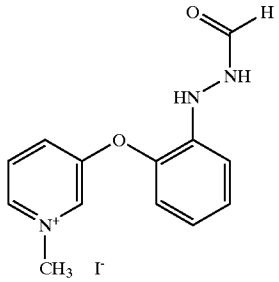
(D-128)
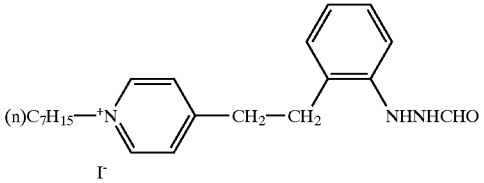

As the hydrazine derivatives used in the present invention, in addition to the above, the following hydrazine derivatives can also preferably be used. The hydrazine derivatives used in the present invention can be synthesized by various methods described in the following patent documents.

Compounds represented by (Chemical formula 1) described in Japanese Patent Publication (Kokoku, henceforth referred to as "JP-B") No. 6-77138, specifically, compounds described on pages 3 and 4 of the same; compounds represented by formula (I) described in JP-B-693082, specifically, Compounds 1 to 38 described on pages 8 to 18 of the same; compounds represented by formulas (4), (5), and (6) described in JP-A-6-230497, specifically, Compound 4-1 to Compound 4-10 described on pages 25 and 26, Compound 5-1 to Compound 5-42 described on pages 28 to 36 and Compound 6-1 to Compound 6-7 described on pages 39 and 40 of the same, respectively; compounds represented by formulas (1) and (2) described in JP-A-6-289520, specifically, Compounds 1-1) to 1-17) and 2-1) described on pages 5 to 7 of the same; compounds represented by (Chemical formula 2) and (Chemical formula 3) described in JP-A-6-313936, specifically, compounds described on pages 6 to 19 of the same; compounds represented by (Chemical formula 1) described in JP-A-6-313951, specifically, compounds described on pages 3 to 5 of the same; compounds represented by formula (I) described in JP-A-7-5610, specifically, Compounds I-1 to I-38 described on pages 5 to 10 of the same; compounds represented by formula (II) described in JP-A-7-77783, specifically, Compounds II-1 to II-102 described on pages 10 to 27 of the same; compounds represented by formulas (H) and (Ha) described in JP-A-7-104426, specifically, Compounds H-1 to H-44 described on pages 8 to 15 of the same; compounds that have an anionic group or nonionic group for forming an intramolecular hydrogen bond with the hydrogen atom of the hydrazine in the vicinity of the hydrazine group described in JP-A-9-22082, especially compounds represented by formulas (A), (B), (C), (D), (E) and (F), specifically, Compounds N-1 to N-30 described in the same; compounds represented by formula (1) described in JP-A-9-22082, specifically, Compounds D-1 to D-55 described in the same as well as the hydrazine derivatives described in WO95/32452, WO95/32453, JP-A-9-179229, JP-A-9-235264, JP-A-9-235265, JP-A-9-235266, JP-A-9-235267, JP-A-9-319019, JP-A-9-319020, JP-A-10-130275, JP-A-11-7093, JP-A-6-332096, JP-A-7-209789, JP-A-8-6193, JP-A-8-248549, JP-A-8-248550, JP-A-8-262609, JP-A-8-314044, JP-A-8-328184, JP-A-9-80667, JP-A-9-127632, JP-A-9-146208, JP-A-9-160156, JP-A-10-161260, JP-A-10-221800, JP-A-10-213871, JP-A-10-254082, JP-A-10-254088, JP-A-7-120864, JP-A-7-244348, JP-A-7-333773, JP-A-8-36232, JP-A-8-36233, JP-A-8-36234, JP-A-8-36235, JP-A-8-272022, JP-A-9-22083, JP-A-9-22084, JP-A-9-54381 and JP-A-10-175946.

In the present invention, the hydrazine nucleating agents may be dissolved in an appropriate water-miscible organic solvent, such as an alcohol (e.g., methanol, ethanol, propanol, fluorinated alcohol), ketone (e.g., acetone, methyl ethyl ketone), dimethylformamide, dimethyl sulfoxide, methyl cellosolve or the like, before use.

The hydrazine nucleating agents may also be dissolved in an oil such as dibutyl phthalate, tricresyl phosphate, glyceryl triacetate or diethyl phthalate using an auxiliary solvent such as ethyl acetate or cyclohexanone and mechanically processed into an emulsion dispersion by a conventionally well-known emulsion dispersion method before use. Alternatively, powder of hydrazine nucleating agents may be dispersed in water by means of ball mill, colloid mill or ultrasonic waves according to a method known as solid dispersion method and used.

In the present invention, the hydrazine nucleating agent may be added to any layer on the silver halide emulsion layer side with respect to the support. For example, it can be added to a silver halide emulsion layer or another hydrophilic colloid layer. However, it is preferably added to a silver halide emulsion layer or a hydrophilic colloid layer adjacent thereto. Two or more hydrazine nucleating agents may be used in combination.

The addition amount of the nucleating agent in the present invention is preferably from $1\times10^{-5}$ to $1\times10^{-2}$ mol, more preferably from $1\times10^{-5}$ to $5\times10^{-3}$ mol, most preferably from $2\times10^{-5}$ to $5\times10^{-3}$ mol, per mol of silver halide.

The silver halide photographic light-sensitive material of the present invention may contain a nucleation accelerator.

Examples of the nucleation accelerator used in the present invention include amine derivatives, onium salts, disulfide derivatives, hydroxymethyl derivatives and so forth. Specific examples thereof include compounds described in JP-A-7-77783, page 48, lines 2 to 37, specifically, Compounds A-1) to A-73) described on pages 49 to 58 of the same; compounds represented by (Chemical formula 21), (Chemical formula 22) and (Chemical formula 23) described in JP-A-7-84331, specifically, compounds described on pages 6 to 8 of the same; compounds represented by formulas [Na] and [Nb] described in JP-A-7-104426, specifically, Compounds Na-1 to Na-22 and Compounds Nb-1 to Nb-12 described on pages 16 to 20 of the same; compounds represented by the formulas (1), (2), (3), (4), (5), (6) and (7) described in JP-A-8-272023, specifically, compounds of 1-1 to 1-19, compounds of 2-1 to 2-22, compounds of 3-1 to 3-36, compounds of 4-1 to 4-5, compounds of 5-1 to 5-41, compounds of 6-1 to 6-58 and compound of 7-1 to 7-38 mentioned in the same; and nucleation accelerators described in JP-A-9-297377, p.55, column 108, line 8 to p.69, column 136, lines 1-44.

As the nucleation accelerator used for the present invention, the quaternary salt compounds represented by the formulas (a) to (f) are preferred, and the compounds represented by the formula (b) are most preferred.

Formula (a)

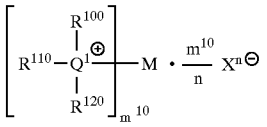

Formula (b)

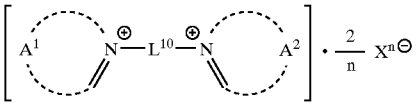

Formula (c)

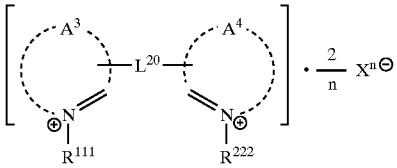

-continued

Formula (d)

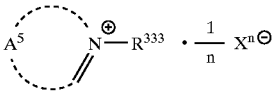

Formula (e)

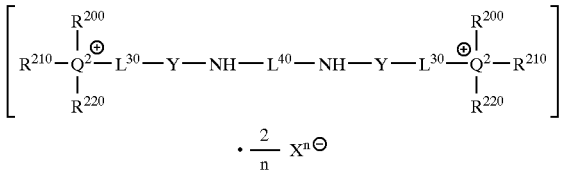

Formula (f)

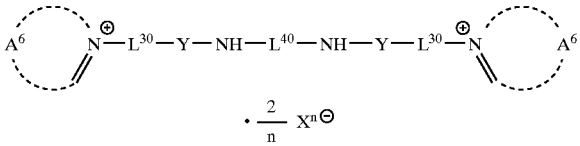

In the formula (a), $Q^1$ represents a nitrogen atom or a phosphorus atom, $R^{100}$, $R^{110}$and $R^{120}$ each represent an aliphatic group, an aromatic group or a heterocyclic group, and these may bond to each other to form a ring structure. M represents an $m^{10}$-valent organic group bonding to $Q^1$ at a carbon atom contained in M, and $m^{10}$ represents an integer of 1–4.

In the formulas (b), (c) and (d), $A^1$, $A^2$, $A^3$, $A^4$ and $A^5$ each represent an organic residue for completing an unsaturated heterocyclic ring containing a quaternized nitrogen atom, $L^{10}$ and $L^{20}$ represent a divalent bridging group, and $R^{111}$, $R^{222}$ and $R^{333}$ represent a substituent.

The quaternary salt compounds represented by the formula (a), (b), (c) or (d) have 20 or more in total of repeating units of ethyleneoxy group or propyleneoxy group in the molecule, and they may contain the units at two or more sites.

In the formula (e), $Q^2$ represents a nitrogen atom or a phosphorus atom. $R^{200}$, $R^{210}$ and $R^{220}$ represent groups having the same meanings of $R^{100}$, $R^{110}$, $R^{120}$ in the formula (a).

In the formula (f), $A^6$ represents a group having the same meaning of $A^1$ or $A^2$ in the formula (b). However, the nitrogen-containing unsaturated heterocyclic ring formed with $A^6$ may have a substituent, but it does not have a primary hydroxyl group on the substituent. In the formulas (e) and (f), $L^{30}$ represents an alkylene group, Y represents —C(=O)— or —$SO_2$—, and $L^{40}$ represents a divalent bridging group containing at least one hydrophilic group.

In the formulas (a) to (f), $X^{n-}$ represents an n-valent counter anion, and n represents an integer of 1–3. However, when another anionic group is present in the molecule and it forms an intramolecular salt with $(Q^1)^+$, $(Q^2)^+$ or $N^+$, $X^{n-}$ is not required.

Examples of the aliphatic group represented by $R^{100}$, $R^{110}$ and $R^{120}$ in the formula (a) include a linear or branched alkyl group such as methyl group, ethyl group, propyl group, isopropyl group, butyl group, isobutyl group, sec-butyl group, tert-butyl group, octyl group, 2-ethylhexyl group, dodecyl group, hexadecyl group and octadecyl group; an aralkyl group such as a substituted or unsubstituted benzyl group; a cycloalkyl group such as cyclopropyl groups, cyclopentyl group and cyclohexyl group; an alkenyl group such as allyl group, vinyl group and 5-hexenyl group; a cycloalkenyl group such as cyclopentenyl group and cyclohexenyl group; an alkynyl group such as phenylethynyl group and so forth. Examples of the aromatic group include an aryl group such as phenyl group, naphthyl group and phenanthoryl group, and examples of the heterocyclic group include pyridyl group, quinolyl group, furyl group, imidazolyl group, thiazolyl group, thiadiazolyl group, benzotriazolyl group, benzothiazolyl group, morpholyl group, pyrimidyl group, pyrrolidyl group and so forth.

Examples of the substituent substituting these groups include, besides the groups represented by $R^{100}$, $R^{110}$ and $R^{120}$, a halogen atom such as fluorine atom, chlorine atom, bromine atom and iodine atom, a nitro group, an (alkyl or aryl)amino group, an alkoxy group, an aryloxy group, an (alkyl or aryl)thio group, a carbonamido group, a carbamoyl group, a ureido group, a thioureido group, a sulfonylureido group, a sulfonamido group, a sulfamoyl group, a hydroxyl group, a sulfonyl group, a carboxyl group (including a carboxylate), a sulfo group (including a sulfonate), a cyano group, an oxycarbonyl group, an acyl group, a heterocyclic group (including a heterocyclic group containing a quaternized nitrogen atom) and so forth. These substituents may be further substituted with any of these substituents.

The groups represented by $R^{100}$, $R^{110}$ and $R^{120}$ in the formula (a) may bond to each other to form a ring structure.

Example of the group represented by M in the formula (a) include, when $m^{10}$ represents 1, the same groups as the groups defined for $R^{100}$, $R^{110}$ and $R^{120}$. When $m^{10}$ represents an integer of 2 or more, M represents an $m^{10}$-valent bridging group bonding to $Q^1$ at a carbon atom contained in M. Specifically, it represents an $m^{10}$-valent bridging group formed with an alkylene group, an arylene group, a heterocyclic group or a group formed from any of these groups in combination with any of —CO— group, —O— group, —N($R^N$)— group, —S— group, —SO— group, —$SO_2$— group and —P=O— group ($R^N$ represents a hydrogen atom or a group selected from the groups defined for $R^{100}$, $R^{110}$, $R^{120}$, and when a plurality of $R^N$ exist in the molecule, they may be identical to or different from each other or one another, and may bond to each other or one another). M may have an arbitrary substituent, and examples of the substituent include the substituents that can be possessed by the groups represented by $R^{100}$, $R^{110}$ and $R^{120}$.

In the formula (a), $R^{100}$, $R^{110}$ and $R^{120}$ preferably represent a group having 20or less carbon atoms. When $Q^1$ represents a phosphorus atom, an aryl group having 15 or less carbon atoms is particularly preferred, and when $Q^1$ represents a nitrogen atom, an alkyl group, aralkyl group and aryl group having 15 or less carbon atoms are particularly preferred. $m^{10}$ is preferably 1 or 2. When $m^{10}$ represents 1, M is preferably a group having 20 or less carbon atoms, and an alkyl group, aralkyl group and aryl group having 15 or less carbon atoms are particularly preferred. When $m^{10}$ represents 2, the divalent organic group represented by M is preferably a divalent group formed with an alkylene group or an arylene group, or a group formed from either of these groups in combination with any of —CO— group, —O— group, —N($R^N$)— group, —S— group and —$SO_2$— group. When $m^{10}$ represents 2, M is preferably a divalent group having 20 or less carbon atoms and bonding to $Q^1$ at a carbon atom contained in M. When M or $R^{100}$, $R^{110}$ or $R^{120}$ contains a plurality of repeating units of ethyleneoxy group or propyleneoxy group, the preferred ranges for the total carbon numbers mentioned above may not be applied. Further, when $m^{10}$ represents an integer of 2 or more, a plurality of $R^{100}$, $R^{110}$ or $R^{120}$ exist in the molecule. In this case, a plurality of $R^{100}$, $R^{110}$ and $R^{120}$ may be identical to or different from each other or one another.

The quaternary salt compounds represented by the formula (a) contain 20 or more in total of repeating units of ethyleneoxy group or propyleneoxy group in the molecule, and they may exist at one site or two or more site. When $m^{10}$ represents an integer of 2 or more, it is more preferred that 20 or more in total of repeating units of ethyleneoxy group or propyleneoxy group should be contained in the bridging group represented by M.

In the formulas (b), (c) and (d), $A^1$, $A^2$, $A^3$, $A^4$ and $A^5$ represent an organic residue for completing a substituted or unsubstituted unsaturated heterocyclic ring containing a quaternized nitrogen atom, and it may contain a carbon atom, an oxygen atom, a nitrogen atom, a sulfur atom and a hydrogen atom and may be condensed with a benzene ring.

Examples of the unsaturated heterocyclic ring formed by $A^1$, $A^2$, $A^3$, $A^4$ or $A^5$ include pyridine ring, quinoline ring, isoquinoline ring, imidazole ring, thiazole ring, thiadiazole ring, benzotriazole ring, benzothiazole ring, pyrimidine ring, pyrazole ring and so forth. A pyridine ring, quinoline ring and isoquinoline ring are particularly preferred.

The unsaturated heterocyclic ring formed by $A^1$, $A^2$, $A^3$, $A^4$ or $A^5$ together with a quaternized nitrogen atom may have a substituent. Examples of the substituent include the same groups as the substituents that may be possessed by the groups represented by $R^{100}$, $R^{110}$ and $R^{120}$ in the formula (a). The substituent is preferably a halogen atom (in particular, chlorine atom), an aryl group having 20 or less carbon atoms (phenyl group is particularly preferred), an alkyl group, an alkynyl group, a carbamoyl group, an (alkyl or aryl)amino group, an (alkyl or aryl)oxycarbonyl group, an alkoxy group, an aryloxy group, an (alkyl or aryl) thio group, hydroxyl group, a mercapto group, a carbonamido group, a sulfonamido group, a sulfo group (including a sulfonate), a carboxyl group (including a carboxylate), a cyano group or the like, particularly preferably a phenyl group, an alkylamino group, a carbonamido group, a chlorine atom, an alkylthio group or the like, most preferably a phenyl group.

The divalent bridging group represented by $L^{10}$ or $L^{20}$ is preferably an alkylene group, an arylene group, an alkenylene group, an alkynylene group, a divalent heterocyclic group, —$SO^2$—, —SO—, —O—, —S—, —$N(R^N)$—, —C(=O)—, —PO— or a group formed by a combination of any of these. $R^N$ represents an alkyl group, an aralkyl group, an aryl group or a hydrogen atom. The divalent bridging group represented by $L^{10}$ or $L^{20}$ may have an arbitrary substituent. Examples of the substituent include the substituents that may be possessed by the groups represented by $R^{100}$, $R^{110}$ and $R^{120}$ in the formula (a). Particularly preferred examples of $L^{10}$ or $L^{20}$ are an alkylene group, an arylene group, —C(=O)—, —O—, —S—, —$SO_2$—, —$N(R^N)$— and a group formed by a combination of any of these.

$R^{111}$, $R^{222}$ and $R^{333}$ preferably represent an alkyl group or aralkyl group having 1–20 carbon atoms, and they may be identical to or different from one another. $R^{111}$, $R^{222}$ and $R^{333}$ may have a substituent, and examples of the substituent include the substituents that may be possessed by the groups represented by $R^{100}$, $R^{110}$ and $R^{120}$ in the formula (a). $R^{111}$, $R^{222}$ and $R^{333}$ each particularly preferably represent an alkyl group or aralkyl group having 1–10 carbon atoms. Preferred examples of the substituent thereof include a carbamoyl group, an oxycarbonyl group, an acyl group, an aryl group, a sulfo group (including a sulfonate), a carboxyl group (including a carboxylate), a hydroxyl group, an (alkyl or aryl) amino group and an alkoxy group.

However, when a plurality of repeating units of ethyleneoxy group or propyleneoxy group are included in $R^{111}$, $R^{222}$ or $R^{333}$, the preferred ranges for the total carbon numbers mentioned above for $R^{111}$, $R^{222}$ and $R^{333}$ shall not be applied.

The quaternary salt compounds represented by the formula (b) or (c) contain 20 or more in total of repeating units of ethyleneoxy group or propyleneoxy group in the molecule, and they may exist at one site or two or more site and may be contained any of $A^1$, $A^2$, $A^3$, $A^4$, $R^{111}$, $R^{222}$, $L^{10}$ and $L^{20}$. However, it is preferred that 20 or more in total of repeating units of ethyleneoxy group or propyleneoxy group should be contained in the bridging group represented by $L^{10}$ or $L^{20}$.

The quaternary salt compounds represented by the formula (d) contain 20 or more in total of repeating units of ethyleneoxy group or propyleneoxy group in the molecule, and they may exist at one site or two or more site and may be contained any of $A^5$ and $R^{333}$. However, it is preferred that 20 or more in total of repeating units of ethyleneoxy group or propyleneoxy group should be contained in the bridging group represented by $R^{333}$.

The quaternary salt compounds represented by the formula (a), (b), (c) or (d) may contain both of a repeating unit of ethyleneoxy group and a repeating unit of propyleneoxy group. Further, when a plurality of repeating units of ethyleneoxy group or propyleneoxy group are contained, number of the repeating units may be defined strictly as one number or defined as an average number. In the latter case, each quaternary salt compound consists of a mixture having a certain degree of molecular weight distribution.

In the present invention, preferably 20 or more, more preferably 20–67, in total of repeating units of ethyleneoxy group should be contained.

In the formula (e) $Q^2$ , $R^{200}$, $R^{210}$ and $R^{220}$ represent groups having the same meanings as $Q^1$, $R^{100}$, $R^{110}$ and $R^{120}$ in the formula (a), respectively, and the preferred ranges thereof are also the same.

In the formula (f), $A^6$ represents a group having the same meaning as $A^1$ or $A^2$ in the formula (b), and the preferred range thereof is also the same. The nitrogen-containing unsaturated heterocyclic ring formed with $A^6$ in the formula (f) together with a quaternized nitrogen atom may have a substituent, provided that it does not have a substituent containing a primary hydroxyl group.

In the formulas (e) and (f), $L^{30}$ represents an alkylene group. The alkylene group is preferably a linear, branched or cyclic substituted or unsubstituted alkylene group having 1–20 carbon atoms. Moreover, it includes not only a saturated alkylene group, of which typical example is ethylene group, but also an alkylene group containing an unsaturated group, of which typical examples are —$CH_2C_6H_4CH_2$— and —$CH_2CH$=$CHCH_2$—. Further, when $L^{30}$ has a substituent, examples of the substituent include the examples of the substituent that may be possessed by the groups represented by $R^{100}$, $R^{110}$ and $R^{120}$ in the formula (a).

$L^{30}$ is preferably a linear or branched saturated group having 1–10 carbon atoms. More preferably, it is a substituted or unsubstituted methylene group, ethylene group or trimethylene group, particularly preferably a substituted or unsubstituted methylene group or ethylene group, most preferably a substituted or unsubstituted methylene group.

In the formulas (e) and (f), $L^{40}$ represents a divalent bridging group having at least one hydrophilic group. The hydrophilic group used herein represents —$SO_2$—, —SO—, —O—, —P(=O)=, —C(=O)—, —CONH—, —$SO_2$NH—, —NHS$C_2$NH—, —NHCONH—, an amino group, a guanidino group, an ammonio group, a heterocyclic group containing a quaternized nitrogen atom or a group consisting of a combination of these groups. $L^{40}$ is formed by an arbitrary combination of any of these hydrophilic groups and an alkylene group, an alkenylene group, an arylene group or a heterocyclic group.

The groups constituting L40 such as an alkylene group, an arylene group, an alkenylene group and a heterocyclic group may have a substituent. Examples of the substituent include the substituents that can be possessed by the groups represented by $R^{100}$, $R^{110}$ and $R^{120}$ in the formula (a).

Although the hydrophilic group in $L^{40}$ may exist so as to interrupt $L^{40}$ or as a part of a substituent on $L^{40}$, it is more preferably exist so as to interrupt $L^{40}$. For example, there, can be mentioned a case where any one of —C(=O)—, —$SO_2$—, —SO—, —O—, —P(=O)=, —CONH—, —$SO_2$NH—, —N$HSO_2$NH—, —NHCONH—, a cationic group (specifically, a quaternary salt structure of nitrogen or phosphorus or a nitrogen-containing heterocyclic ring containing a quaternized nitrogen atom), an amino group and a guanidine group or a divalent group consisting of an arbitrary combination of these groups exists so as to interrupt $L^{40}$.

One of preferred examples of the hydrophilic group of $L^{40}$ is a group having a plurality of repeating units of ethyleneoxy group or propyleneoxy group consisting of a combination of ether bonds and alkylene groups. The polymerization degree or average polymerization degree of such a group is preferably 2–67.

The hydrophilic group of $L^{40}$ also preferably contains a dissociating group obtained as a result of combination of groups such as —$SO_2$—, —SO—, —O—, —P(=O)=, —C(=O)—, —CONH—, —$SO_2$NH—, —N$HSO_2$NH—, —NHCONH—, an amino group, a guanidino group, an ammonio group and a heterocyclic group containing a quaternized nitrogen atom, or as a substituent on $L^{40}$. The dissociating group referred to herein means a group or partial structure having a proton of low acidity that can be dissociated with an alkaline developer, or a salt thereof. Specifically, it means, for example, a carboxy group (—COOH), a sulfo group (—$SO_3$H), a phosphonic acid group (—$PO_3$H), a phosphoric acid group (—$OPO_3$H), a hydroxy group (—OH), a mercapto group (—SH), —$SO_2NH_2$ group, N-substituted sulfonamido group (—$SO_2$NH—, —CONH$SO_2$— group, —$SO_2$NH$SO_2$— group), —CONHCO— group, an active methylene group, —NH— group contained in a nitrogen-containing heterocyclic group, salts thereof etc.

L consisting of a suitable combination of an alkylene group or arylene group with —C(=O)—, —$SO_2$—, —O—, —CONH—, —$SO_2$NH—, —N$HSO_2$NH—, —NHCONH— or an amino group is preferably used. More preferably, $L^{40}$ consisting of a suitable combination of an alkylene group having 2–5 carbon atoms with —C(=O)—, —$SO_2$—, —O—, —CONH—, —$SO_2$NH—, —N$HSO_2$NH— or —NHCONH— is used.

Y represents —C(=O)— or —$SO_2$—. —C(=O)— is preferably used.

Example of the counter anion represented by $X^{n-}$ in the formulas (a) to formula (f) include a halide ion such as chloride ion, bromide ion and iodide ion, a carboxylate ion such as acetate ion, oxalate ion, fumarate ion and benzoate ion, a sulfonate ion such as p-toluenesulfonate ion, methanesulfonate ion, butanesulfonate ion and benzenesulfonate ion, a sulfate ion, a perchlorate ion, a carbonate ion, a nitrate ion and so forth.

As the counter anion represented by $X^{n-}$, a halide ion, a carboxylate ion, a sulfonate ion and a sulfate ion are preferred, and n is preferably 1 or 2. As $X^{n-}$, a chloride ion or a bromide ion is particularly preferred, and a chloride ion is the most preferred.

However, when another anionic group is present in the molecule and it forms an intramolecular salt with $(Q^1)^+$, $(Q^2)^+$ or $N^+$, $X^{n-}$ is not required.

As the quaternary salt compound used in the present invention, the quaternary salt compounds represented by the formula (b), (c) or (f) are more preferred, and the quaternary salt compounds represented by the formula (b) or (f) are particularly preferred. Further, in the formula (b), preferably 20 or more, particularly preferably 20–67, in total of repeating units of ethyleneoxy group should be contained in the bridging group represented by $L^{10}$. Further, in the formula (f), the unsaturated heterocyclic compound formed with $A^6$ particularly preferably represents 4-phenylpyridine, isoquinoline or quinoline.

Specific examples of the quaternary salt compounds represented by any of the formulas (a) to (f) are listed below. In the following formulas, Ph represents a phenyl group. However, the quaternary salt compounds that can be used for the present invention are not limited to the following exemplary compounds.

$Q^+—L_0—Q^+.2X^-$
| No. | $Q^+$ = | $L_0$ = | | $X^-$ = |
|---|---|---|---|---|
| 1 | 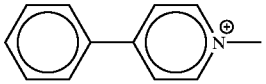 | $—C_2H_4—(OC_2H_4)_n—OC_2H_4—$ | n = 20 | $Cl^{\ominus}$ |
| 2 | 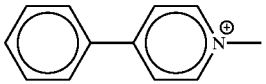 | $—C_2H_4—(OC_2H_4)_n—OC_2H_4—$ | n ≈ 32 | $Cl^{\ominus}$ |
| 3 | 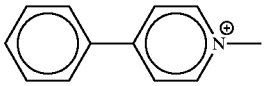 | $—C_2H_4—(OC_2H_4)_n—OC_2H_4—$ | n ≈ 43 | $Cl^{\ominus}$ |
| 4 | 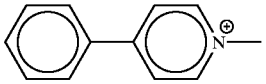 | $—C_2H_4—(OC_2H_4)_n—OC_2H_4—$ | n ≈ 62 | $Cl^{\ominus}$ |
| 5 | 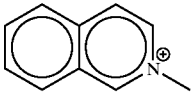 | $—C_2H_4—(OC_2H_4)_n—OC_2H_4—$ | n ≈ 21 | $Cl^{\ominus}$ |
| 6 | 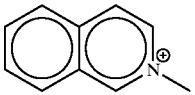 | $—C_2H_4—(OC_2H_4)_n—OC_2H_4—$ | n ≈ 43 | $Cl^{\ominus}$ |
| 7 | 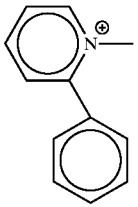 | $—C_2H_4—(OC_2H_4)_n—OC_2H_4—$ | n ≈ 20 | $Cl^{\ominus}$ |

-continued
| | | | | |
|---|---|---|---|---|
| 8 | 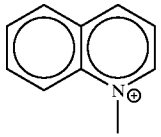 | $—C_2H_4—(OC_2H_4)_n—OC_2H_4—$ | n ≈ 43 | $Cl^{\ominus}$ |
| 9 | 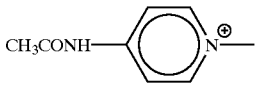 | $—C_2H_4—(OC_2H_4)_n—OC_2H_4—$ | n ≈ 21 | $Cl^{\ominus}$ |
| 10 | 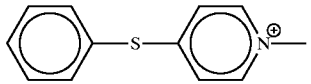 | $—C_2H_4—(OC_2H_4)_n—OC_2H_4—$ | n ≈ 43 | $Cl^{\ominus}$ |
| 11 | 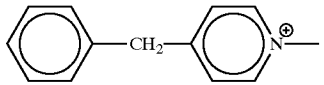 | $—C_2H_4—(OC_2H_4)_n—OC_2H_4—$ | n ≈ 67 | $Cl^{\ominus}$ |
| 12 | 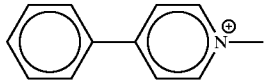 | 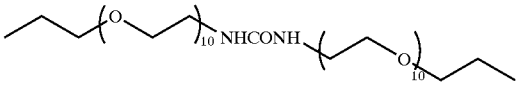 | | $Cl^{\ominus}$ |
| 13 | 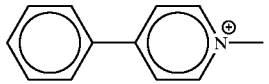 | 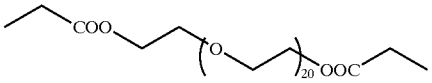 | | $Cl^{\ominus}$ |
| 14 | 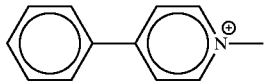 | 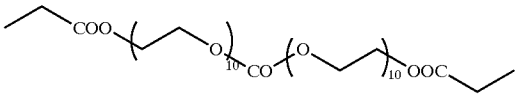 | | $Cl^{\ominus}$ |
| 15 | 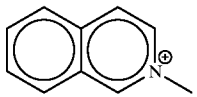 | 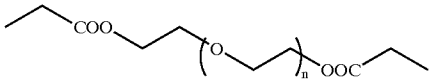 | n ≈ 43 | $Cl^{\ominus}$ |
| 16 | 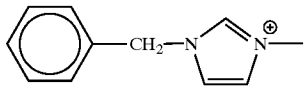 | $—C_2H_4—(OC_2H_4)_n—OC_2H_4—$ | n ≈ 42 | $Cl^{\ominus}$ |

-continued
| | | | | |
|---|---|---|---|---|
| 17 | 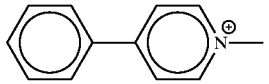 | $—C_2H_4—(OC_2H_4)_n—OC_2H_4—$ | n ≈ 62 | 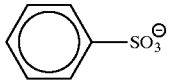 |
| 18 | 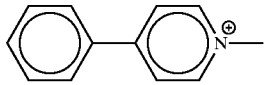 | $—C_2H_4—(OC_2H_4)_n—OC_2H_4—$ | n ≈ 43 | $Br^{\ominus}$ |
| 19 | 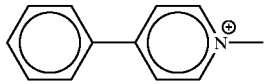 | $—C_2H_4—(OC_2H_4)_n—OC_2H_4—$ | n ≈ 20 | $(COO)_2^{2\ominus}$ |
| 20 | 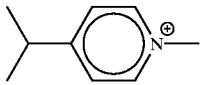 | $—C_2H_4—(OC_2H_4)_n—OC_2H_4—$ | n ≈ 34 | $Cl^{\ominus}$ |
| 21 | 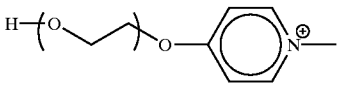 | $—(CH_2)_5—$ | $CH_3SO_3^{\ominus}$ | |
| 22 | 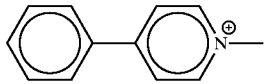 | 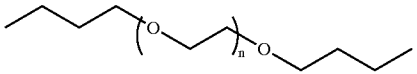 | n ≈ 43 | $Cl^{\ominus}$ |
| 23 | 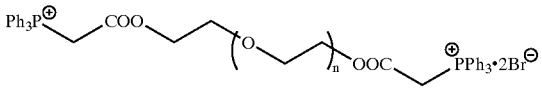 | | | |
| 24 | 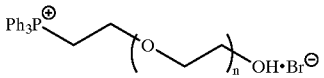 | | | |
| 25 | 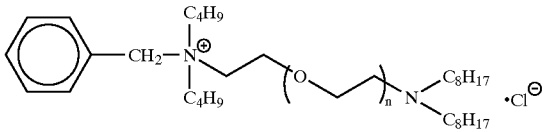 | | | |

-continued
26
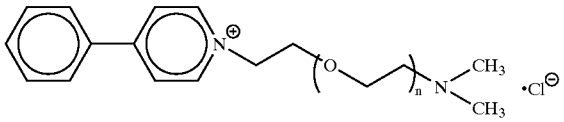
27
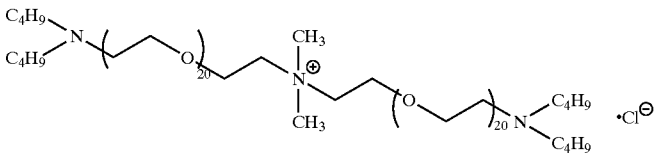
28
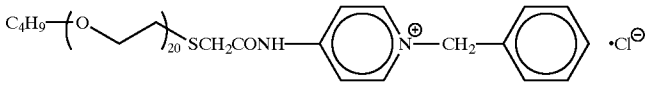
29
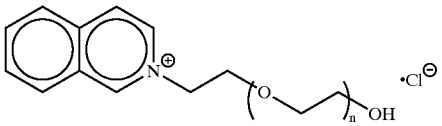
30
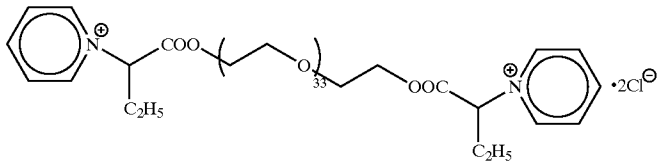
31
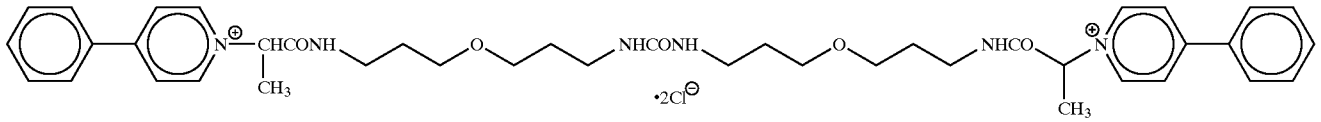
$Q^+—L_0—Q^+.2X^-$
| No. | $Q^+$ = | $L_0$ = | | $X^-$ = |
|---|---|---|---|---|
| 32 | 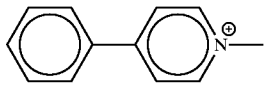 | 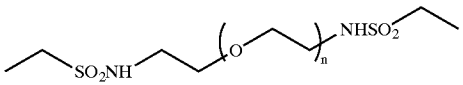 | n = 12 | $Cl^{\ominus}$ |

-continued
| | | | | |
|---|---|---|---|---|
| 33 | 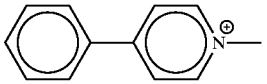 | 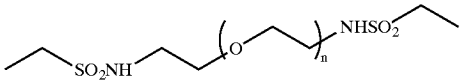 | n ≈ 24 | $Br^{\ominus}$ |
| 34 | 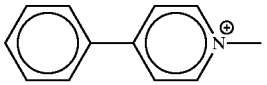 | 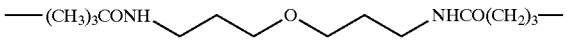 | | $Cl^{\ominus}$ |
| 35 | 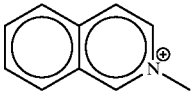 | 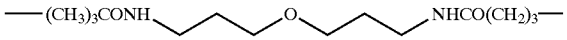 | | $Cl^{\ominus}$ |
| 36 | 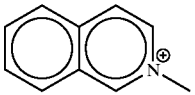 | 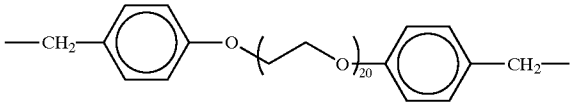 | | $Cl^{\ominus}$ |
| 37 | 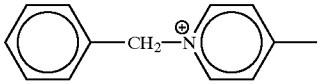 | 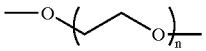 | n ≈ 33 | $Cl^{\ominus}$ |
| 38 | 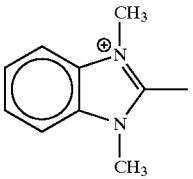 | 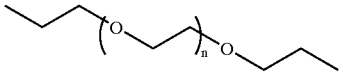 | n ≈ 43 | $Cl^{\ominus}$ |
| 39 | $(C_4H_9)_3N^{\oplus}$— | 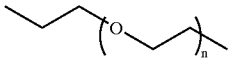 | n = 20 | $Cl^{\ominus}$ |
| 40 | $(C_8H_{17})_2N^{\oplus}(CH_3)$— | 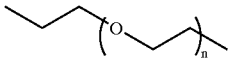 | n ≈ 43 | $Cl^{\ominus}$ |
| 41 | $Ph_3P^{\oplus}$— | 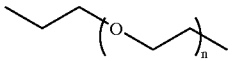 | n = 20 | $Cl^{\ominus}$ |
| 42 | $h_3P^{\oplus}$— | 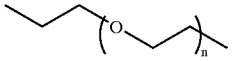 | n ≈ 33 | $Br^{\ominus}$ |

-continued $Q^+$—$CH_2CONH$—L—$NHCOCH_2$—$Q^+.2X^-$

| No. | $Q^+$ = | L = | | $X^-$ = |
|---|---|---|---|---|
| 43 | $PhP^{\oplus}$— | —$C_2H_4$—$(OC_2H_4)_n$— | n = 3 | $Cl^{\ominus}$ |
| 44 | $PhP^{\oplus}$— | —$C_2H_4$—$(OC_2H_4)_n$— | n = 20 | $Br^{\ominus}$ |
| 45 | $PhP^{\oplus}$— | —$C_2H_4$—$(OC_2H_4)_n$— | n ≈ 34 | $Cl^{\ominus}$ |
| 46 | $PhP^{\oplus}$— | —$C_2H_4$—$(OC_2H_4)_n$— | n ≈ 67 | $Cl^{\ominus}$ |
| 47 | 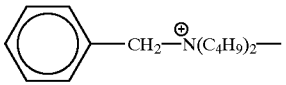 | —$C_2H_4$—$(OC_2H_4)_n$— | n = 12 | $Cl^{\ominus}$ |
| 48 | 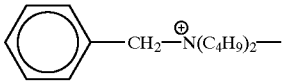 | —$C_2H_4$—$(OC_2H_4)_n$— | n = 30 | $Br^{\ominus}$ |
| 49 | 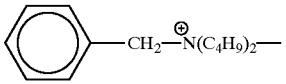 | —$C_2H_4$—$(OC_2H_4)_n$— | n ≈ 43 | 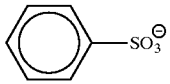 |
| 50 | 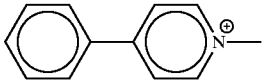 | —$C_2H_4$—$(OC_2H_4)_n$— | n = 3 | $Cl^{\ominus}$ |
| 51 | 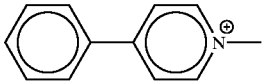 | —$C_2H_4$—$(OC_2H_4)_n$— | n = 12 | $Cl^{\ominus}$ |
| 52 | 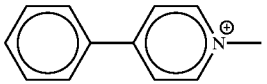 | —$C_2H_4$—$(OC_2H_4)_n$— | n = 20 | $Cl^{\ominus}$ |
| 53 | 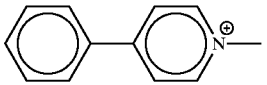 | —$C_2H_4$—$(OC_2H_4)_n$— | n ≈ 43 | $Cl^{\ominus}$ |
| 54 | 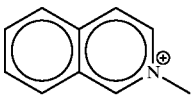 | —$C_2H_4$—$(OC_2H_4)_n$— | n = 2 | $Cl^{\ominus}$ |

-continued
| | | | | |
|---|---|---|---|---|
| 55 | 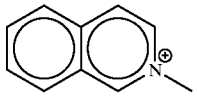 | $—C_2H_4—(OC_2H_4)_n—$ | n = 12 | $Br^{\ominus}$ |
| 56 | 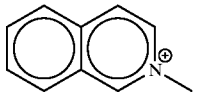 | $—C_2H_4—(OC_2H_4)_n—$ | n = 30 | 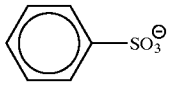 |
| 57 | 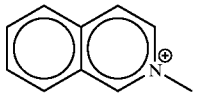 | $—C_2H_4—(OC_2H_4)_n—$ | n ≈ 67 | $(COO)_2^{2\ominus}$ |
| 58 | 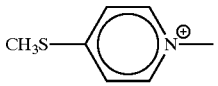 | $—C_2H_4—(OC_2H_4)_n—$ | n = 12 | $Cl^{\ominus}$ |
| 59 | 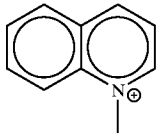 | $—C_2H_4—(OC_2H_4)_n—$ | n = 20 | $Cl^{\ominus}$ |
| 60 | 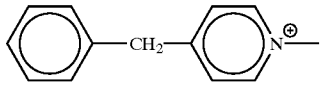 | $—C_2H_4—(OC_2H_4)_n—$ | n = 30 | $Cl^{\ominus}$ |
| 61 | 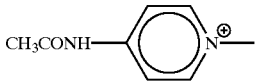 | $—C_2H_4—(OC_2H_4)_n—$ | n ≈ 67 | $Cl^{\ominus}$ |
| 62 | 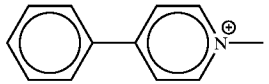 | $—C_3H_6—(OC_2H_4)_n—OC_3H_6—$ | n = 2 | $Cl^{\ominus}$ |
| 63 | 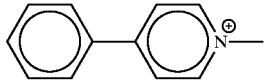 | $—C_3H_6—(OC_2H_4)_n—OC_3H_6—$ | n = 20 | $Cl^{\ominus}$ |

-continued

| | | | | |
|---|---|---|---|---|
| 64 | 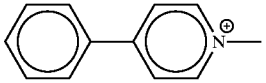 | $—C_3H_6—(OC_2H_4)_n—OC_3H_6—$ | n ≈ 43 | $Cl^{\ominus}$ |
| 65 | $Ph_3P^{\oplus}—$ | $—C_3H_6—(OC_2H_4)_n—OC_3H_6—$ | n = 2 | $Cl^{\ominus}$ |
| 66 | $Ph_3P^{\oplus}—$ | $—C_3H_6—(OC_2H_4)_n—OC_3H_6—$ | n = 12 | $Cl^{\ominus}$ |
| 67 | 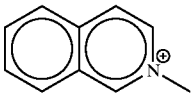 | $—C_3H_6—(OC_2H_4)_n—OC_3H_6—$ | n = 20 | $Cl^{\ominus}$ |
| 68 | 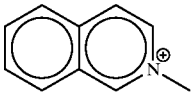 | $—C_3H_6—(OC_2H_4)_n—OC_3H_6—$ | n ≈ 43 | $Cl^{\ominus}$ |
| 69 | $(C_3H_7)_3N^{\oplus}—$ | $—C_3H_6—(OC_2H_4)_n—OC_3H_6—$ | n ≈ 67 | $Cl^{\ominus}$ |
| 70 | $(C_3H_7)_3N^{\oplus}—$ | $—CH(CH_3)CH_2—(OC_2H_4)_n—OCH_2CH(CH_3)—$ | | $Cl^{\ominus}$ |
| 71 | 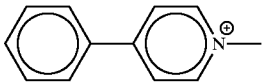 | $—CH(CH_3)CH_2—(OC_2H_4)_n—OCH_2CH(CH_3)—$ | | $Cl^{\ominus}$ |
| 72 | 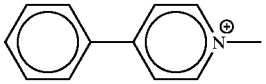 | $—CH(CH_3)CH_2—(OC_2H_4)_n—OCH_2CH(CH_3)—$ | | $Cl^{\ominus}$ |
| 73 | 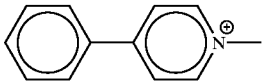 | $—C_2H_4—(O—CH_2—C(CH_3)_2)_n$ | | $Cl^{\ominus}$ |
| 74 | 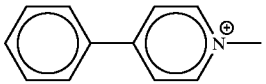 | $—C_2H_4—(O—CH_2—C(CH_3)_2)_n$ | | $Cl^{\ominus}$ |
| 75 | 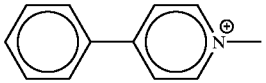 | $(—CH_2—CH_2—CH_2—O)_3—NHCONH—(O—CH_2—CH_2—CH_2—)_3$ | | $Cl^{\ominus}$ |

-continued
| | | | |
|---|---|---|---|
| 76 | 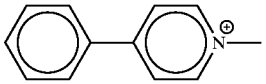 | 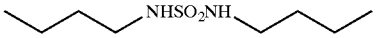 | $Cl^{\ominus}$ |
| 77 | 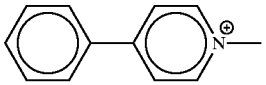 | 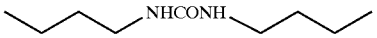 | $Cl^{\ominus}$ |
| 78 | 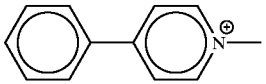 | 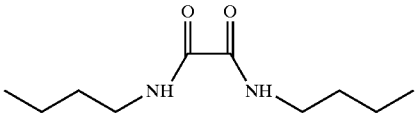 | $Cl^{\ominus}$ |
| 79 | 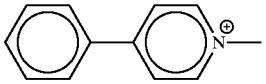 | 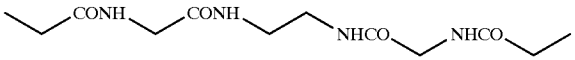 | $Cl^{\ominus}$ |
| 80 | 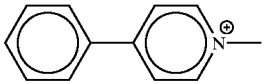 | 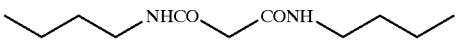 | $Cl^{\ominus}$ |
| 81 | 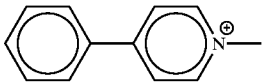 | 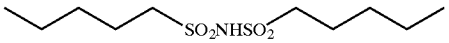 | $Cl^{\ominus}$ |
| 82 | 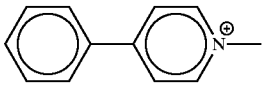 | 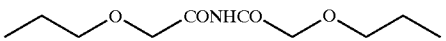 | $Cl^{\ominus}$ |
| 83 | 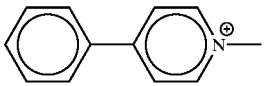 | 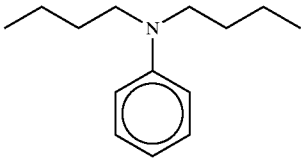 | $Cl^{\ominus}$ |
| 84 | 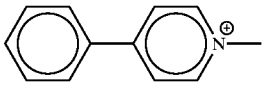 | 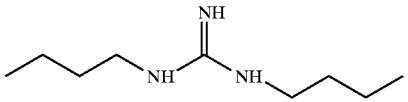 | $Cl^{\ominus}$ |

-continued
| | | | |
|---|---|---|---|
| 85 | 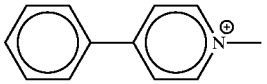 | 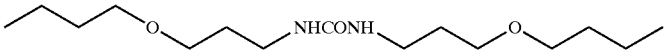 | $Cl^{\ominus}$ |
| 86 | 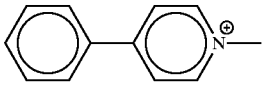 | 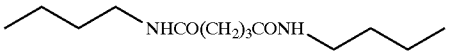 | $Cl^{\ominus}$ |

The quaternary salt compounds represented by the formulas (a) to (f) can be easily synthesized by known methods.

The nucleation accelerator that can be used in the present invention may be dissolved in an appropriate water-miscible organic solvent such as an alcohol (e.g., methanol, ethanol, propanol or a fluorinated alcohol), ketone (e.g., acetone or methyl ethyl ketone), dimethylformamide, dimethylsulfoxide or methyl cellosolve and used.

Alternatively, the nucleation accelerator may also be dissolved in an oil such as dibutyl phthalate, tricresyl phosphate, glyceryl triacetate or diethyl phthalate using an auxiliary solvent such as ethyl acetate or cyclohexanone and mechanically processed into an emulsion dispersion by a conventionally well-known emulsion dispersion method before use. Alternatively, powder of the nucleation accelerator may be dispersed in water by means of ball mill, colloid mill or ultrasonic waves according to a method known as solid dispersion method and used.

The nucleation accelerator that can be used in the present invention is preferably added to a non-photosensitive layer consisting of a hydrophilic colloid layer not containing silver halide emulsion provided on the silver halide emulsion layer side of the support, particularly preferably to a hydrophilic colloid layer between a silver halide emulsion layer and the support.

In the present invention, the nucleation accelerator is preferably used in an amount of from $1\times10^{-6}$ to $2\times10^{-2}$ mol, more preferably from $1\times10^{-5}$ to $2\times10^{-2}$ mol, most preferably from $2\times10^{-5}$ to $1\times10^{-2}$ mol, per mol of silver halide. It is also possible to use two or more nucleation accelerators in combination.

Silver halide of the silver halide emulsion used for the silver halide photographic light-sensitive material of the present invention is not particularly limited, and any of silver chloride, silver chlorobromide, silver bromide, silver chloroiodobromide and silver iodobromide may be used. However, silver chlorobromide and silver chloroiodobromide having a silver chloride content of not less than 50 mol % are preferably used. The form of silver halide grain may be any of cubic, tetradecahedral, octahedral, variable and tabular forms, but a cubic form is preferred. The silver halide preferably has a mean grain size of 0.1–0.7 μm, more preferably 0.1–0.5 μm, and preferably has a narrow grain size distribution in terms of a variation coefficient, which is represented as {(Standard deviation of grain size)/(mean grain size)}×100, of preferably 15% or less, more preferably 10% or less.

The silver halide grains may have uniform or different phases for the inside and the surface layer. Further, they may have a localized layer having a different halogen composition inside the grains or as surface layers of the grains.

The photographic emulsion used for the present invention can be prepared using the methods described in P. Glafkides, Chimie et Physique Photographique, Paul Montel (1967); G. F. Duffin, Photographic Emulsion Chemistry, The Focal Press (1966); V. L. Zelikman et al, Making and Coating Photographic Emulsion, The Focal Press (1964) and so forth.

That is, any of an acidic process and a neutral process may be used. In addition, a soluble silver salt may be reacted with a soluble halogen salt by any of the single jet method, double jet method and a combination thereof. A method of forming grains in the presence of excessive silver ions (so-called reverse mixing method) may also be used.

As one type of the double jet method, a method of maintaining the pAg constant in the liquid phase where silver halide is produced, that is, the so-called controlled double jet method, may also be used. Further, it is preferable to form grains using the so-called silver halide solvent such as ammonia, thioether or tetra-substituted thiourea. More preferred as the silver halide solvent is a tetra-substituted thiourea compound, and it is described in JP-A-53-82408 and JP-A-55-77737. Preferred examples of the thiourea compound include tetramethylthiourea and 1,3-dimethyl-2-imidazolidinethione. While the amount of the silver halide solvent to be added may vary depending on the kind of the compound used, the desired grain size and halide composition of silver halide to be desired, it is preferably in the range of from $10^{-5}$ to $10^{-2}$ mol per mol of silver halide.

According to the controlled double jet method or the method of forming grains using a silver halide solvent, a silver halide emulsion comprising regular crystal form grains and having a narrow grain size distribution can be easily prepared, and these methods are useful for preparing the silver halide emulsion used for the present invention.

In order to achieve a uniform grain size, it is preferable to rapidly grow grains within the range of not exceeding the critical saturation degree by using a method of changing the addition rate of silver nitrate or alkali halide according to the grain growth rate as described in British Patent No. 1,535,016, JP-B-48-36890 and JP-B-52-16364, or a method of changing the concentration of the aqueous solution as described in U.S. Pat. No. 4,242,445 and JP-A-55-158124.

The silver halide emulsion used for the present invention may contain a metal belonging to Group VIII. In particular, it is preferable to add a rhodium compound, iridium compound or ruthenium compound in order to achieve high contrast and low fog. Further, a hexacyanide metal complex such as $K_4[Fe(CN)_6]$, $K_4[Ru(CN)_6]$ and $K_3[Cr(CN)_6]$ is advantageously doped to attain higher sensitivity.

As the rhodium compound used for the present invention, a water-soluble rhodium compound can be used. Examples thereof include rhodium(III) halide compounds and rhodium complex salts having a halogen, amine, oxalato, aquo or the like as a ligand, such as hexachlororhodium(III) complex salt, pentachloroaquorhodium complex salt, tetrachlorodiaquorhodium complex salt, hexabromorhodium(III) complex salt, hexaaminerhodium(III) complex salt and trioxalatorhodium(III) complex salt. The rhodium compound is dissolved in water or an appropriate solvent prior to use and a method commonly used for stabilizing the rhodium compound solution, that is, a method of adding an aqueous solution of hydrogen halide (e.g., hydrochloric acid, hydrobromic acid or hydrofluoric acid) or an alkali halide (e.g., KCl, NaCl, KBr or NaBr), may be used. In place of using a water-soluble rhodium, separate silver halide grains that have been previously doped with rhodium may be added and dissolved at the time of preparation of silver halide.

The rhenium, ruthenium or osmium used for the present invention is added in the form of a water-soluble complex salt described in JP-A-63-2042, JP-A-1-285941, JP-A-2-20852, JP-A-2-20855 and so forth. Particularly preferred examples are six-coordinate complex salts represented by the following formula:

$$[ML_6]^{n-}$$

In the formula, M represents Ru, Re or Os, L represents a ligand, and n represents 0, 1, 2, 3 or 4. In this case, the counter ion plays no important role and an ammonium or alkali metal may be used. Preferred examples of the ligand include a halide ligand, a cyanide ligand, a cyan oxide ligand, a nitrosyl ligand, a thionitrosyl ligand and so forth.

Specific examples of the complex that can be used for the present invention are shown below. However, the scope of the present invention is not limited to these examples.

$[ReCl_6]^{3-}$ $[ReBr_6]^{3-}$ $[ReCl_5(NO)]^{2-}$ $[Re(NS)Br_5]^{2-}$ $[Re(NO)(CN)_5]^{2-}$ $[Re(O)_2(CN)_4]^{3-}$ $[RuCl_6]^{3-}$ $[RuCl_4(H_2O)_2]^{-}$ $[RuCl_5(NO)]^{2-}$ $[RuBr_5(NS)]^{2-}$ $[Ru(CO)_3Cl_3]^{2-}$ $[Ru(CO)Cl_5]^{2-}$ $[Ru(CO)Br_5]^{2-}$ $[OsCl_6]^{3-}$ $[OsCl_5(NO)]^{2-}$ $[Os(NO)(CN)_5]^{2-}$ $[Os(NS)Br_5]^{2-}$ $[Os(CN)_6]^{4-}$ $[Os(O)_2(CN)_4]^{4-}$

The amount of these compounds is preferably from $1\times10^{-9}$ to $1\times10^{-5}$ mol, particularly preferably from $1\times10^{-8}$ to $1\times10^{-6}$ mol, per mole of silver halide.

The iridium compounds used in the present invention include hexachloroiridium, hexabromoiridium, hexaammineiridium, pentachloronitrosyliridium and so forth. The iron compounds used in the present invention include potassium hexacyanoferrate (II) and ferrous thiocyanate.

The silver halide emulsion used for the present invention is preferably subjected to chemical sensitization. The chemical sensitization may be performed by using a known method such as sulfur sensitization, selenium sensitization, tellurium sensitization, noble metal sensitization, organic gold complex sensitization or the like. These sensitization methods may be used each alone or in any combination. When these sensitization methods are used in combination, preferable combinations include sulfur and gold sensitizations, sulfur, selenium and gold sensitizations, sulfur, tellurium and gold sensitizations and so forth.

The sulfur sensitization used in the present invention is usually performed by adding a sulfur sensitizer and stirring the emulsion at a high temperature of 40° C. or above for a predetermined time. The sulfur sensitizer may be a known compound, and examples thereof include, in addition to the sulfur compounds contained in gelatin, various sulfur compounds such as thiosulfates, thioureas, thiazoles and rhodanines, among which thiosulfates and thioureas are preferred. As the thiourea compounds, the specifically tetra-substituted thiourea compounds described in U.S. Pat. No. 4,810,626 are particularly preferred. Although the amount of the sulfur sensitizer to be added varies depending on various conditions such as pH, temperature and grain size of silver halide at the time of chemical ripening, it is preferably from $10^{-7}$ to $10^{-2}$ mol, more preferably from $10^{-5}$ to $10^{-3}$ mol, per mol of silver halide.

The selenium sensitizer used for the present invention may be a known selenium compound. That is, the selenium sensitization is usually performed by adding a labile and/or non-labile selenium compound and stirring the emulsion at a high temperature of 40° C. or above for a predetermined time. Examples of the labile selenium compound include those described in JP-B-44-15748, JP-B-43-13489, JP-A-4-109240 and JP-A-4-324855. Among these, particularly preferred are those compounds represented by formulas (VIII) and (IX) of JP-A-4-324855.

The tellurium sensitizer that can be used for the present invention is a compound capable of producing silver telluride, presumably serving as a sensitization nucleus, on the surface or inside of silver halide grains. The rate of the formation of silver telluride in a silver halide emulsion can be examined according to the method described in JP-A-5-313284.

Specifically, there can be used the compounds described in U.S. Pat. Nos. 1,623,499, 3,320,069 and 3,772,031; British Patents Nos. 235,211, 1,121,496, 1,295,462 and 1,396,696; Canadian Patent No. 800,958; JP-A-4-204640, JP-A-4-271341, JP-A-4-333043, JP-A-5-303157; J. Chem. Soc. Chem. Commun., 635 (1980); ibid., 1102 (1979); ibid., 645 (1979); J. Chem. Soc. Perkin. Trans., 1, 2191 (1980); S. Patai (compiler), The Chemistry of Organic Selenium and Tellurium Compounds, Vol. 1 (1986); and ibid., Vol. 2 (1987). The compounds represented by the formulas (II), (III) and (IV) of JP-A-4-324855 are preferred.

The amount of the selenium or tellurium sensitizer used for the present invention varies depending on silver halide grains used or chemical ripening conditions. However, it is generally from about $10^{-8}$ to about $10^{-2}$ mol, preferably from about $10^{-7}$ to about $10^{31\ 3}$ mol, per mol of silver halide. The conditions for chemical sensitization in the present invention are not particularly restricted. However, in general, pH is 5–8, pAg is 6–11, preferably 7–10 and temperature is 40–95° C., preferably 45–85° C.

Noble metal sensitizers that can be used for the present invention include gold, platinum, palladium and iridium, and gold sensitization is particularly preferred. Specific examples of the gold sensitizers used for the present invention include chloroauric acid, potassium chloroaurate, potassium aurithigcyanate, gold sulfide and so forth, which can be used in an amount of about $10^{-7}$ to about $10^{-2}$ mol per mol of silver halide.

As for the silver halide emulsion used for the present invention, production or physical ripening process for the silver halide grain may be performed in the presence of a cadmium salt, sulfite, lead salt, thallium salt or the like.

In the present invention, reduction sensitization may be used. Examples of the reduction sensitizer include a stannous salt, amine, formamidinesulfinic acid, silane compound and so forth.

To the silver halide emulsion of the present invention, a thiosulfonic acid compound may be added according to the method described in European Unexamined Patent Publication EP293917A.

In the silver halide photographic light-sensitive material of the present invention, one kind of silver halide emulsion may be used or two or more kinds of silver halide emulsions (for example, those having different average grain sizes, different halogen compositions, different crystal habits, those subjected to chemical sensitizations with different conditions or those having different sensitivities) may be used in combination. In order to obtain high contrast, it is especially preferable to coat an emulsion having higher sensitivity as it becomes closer to a support as described in JP-A-6-324426.

The photosensitive silver halide emulsion may be spectrally sensitized with a sensitizing dye for comparatively long wavelength, i.e., blue light, green light, red light or infrared light. The compounds of the formula [I] mentioned in JP-A-55-45015 and the compounds of the formula [I] mentioned in JP-A-9-160185 are preferred, and the compounds of the formula [I] mentioned in JP-A-9-160185 are particularly preferred. Specifically, the compounds of (1) to (19) mentioned in JP-A-55-45015, the compounds of I-1 to I-40 and the compounds of I-56 to I-85 mentioned in JP-A-9-160185 and so forth can be mentioned.

Examples of the other sensitizing dyes include a cyanine dye, merocyanine dye, complex cyanine dye, complex merocyanine dye, holopolar cyanine dye, styryl dye, hemicyanine dye, oxonol dye, hemioxonol dye and so forth.

Other useful sensitizing dyes that can be used for the present invention are described in, for example, Research Disclosure, Item 17643, IV-A, page 23 (December, 1978); ibid., Item 18341X, page 437 (August, 1979) and publications cited in the same.

In particular, sensitizing dyes having spectral sensitivity suitable for spectral characteristics of light sources in various scanners, image setters or photomechanical cameras can also be advantageously selected.

For example, A) for an argon laser light source, Compounds (I)-1 to (I)-8 described in JP-A-60-162247, Compounds I-1 to I-28 described in JP-A-2-48653, Compounds I-1 to I-13 described in JP-A-4-330434, compounds of Examples 1 to 14 described in U.S. Pat. No. 2,161,331, and Compounds 1 to 7 described in West Germany Patent No. 936,071; B) for a helium-neon laser light source, Compounds I-1 to I-38 described in JP-A-54-18726, Compounds I-1 to I-35 described in JP-A-6-75322, and Compounds I-1 to I-34 described in JP-A-7-287338; C) for an LED light source, Dyes 1 to 20 described in JP-B-55-39818, Compounds I-1 to I-37 described in JP-A-62-284343, and Compounds I-1 to I-34 described in JP-A-7-287338; D) for a semiconductor laser light source, Compounds I-1 to I-12 described in JP-A-59-191032, Compounds I-1 to I-22 described in JP-A-60-80841, Compounds I-1 to I-29 described in JP-A-4-335342, and Compounds I-1 to I-18 described in JP-A-59-192242; and E) for a tungsten or xenon light source of a photomechanical camera, besides the aforementioned compounds, Compounds I-41 to I-55 and Compounds I-86 to I-97 described in JP-A-9-160185, and Compounds 4-A to 4-S, Compounds 5-A to 5-Q, and Compounds 6-A to 6-T described in JP-A-6-242547 and so forth may also be advantageously selected.

These sensitizing dyes may be used individually or in combination, and a combination of sensitizing dyes is often used for the purpose of, in particular, supersensitization. In combination with a sensitizing dye, a dye which itself has no spectral sensitization effect, or a material that absorbs substantially no visible light, but exhibits supersensitization may be incorporated into the emulsion.

Useful sensitizing dyes, combinations of dyes that exhibit supersensitization, and materials that show supersensitization are described in, for example, Research Disclosure, Vol. 176, 17643, page 23, Item IV-J (December 1978); JP-B-49-25500, JP-B-43-4933, JP-A-59-19032, JP-A-59-192242 mentioned above and so forth.

The sensitizing dyes used for the present invention may be used in a combination of two or more of them. The sensitizing dye may be added to a silver halide emulsion by dispersing it directly in the emulsion, or by dissolving it in a sole or mixed solvent of such solvents as water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol or N,N-dimethylformamide, and then adding the solution to the emulsion.

Alternatively, the sensitizing dye may be added to the emulsion by the method disclosed in U.S. Pat. No. 3,469,987, in which a dye is dissolved in a volatile organic solvent, the solution is dispersed in water or a hydrophilic colloid and the dispersion is added to the emulsion; the methods disclosed in JP-B-44-23389, JP-B-44-27555, JP-B-57-22091 and so forth, in which a dye is dissolved in an acid and the solution is added to the emulsion, or a dye is made into an aqueous solution in the presence of an acid or base and the solution is added to the emulsion; the method disclosed in, for example, U.S. Pat. Nos. 3,822,135 and 4,006,025, in which a dye is made into an aqueous solution or a colloid dispersion in the presence of a surfactant, and the solution or dispersion is added to the emulsion; the method disclosed in JP-A-53-102733 and JP-A-58-105141, in which a dye is directly dispersed in a hydrophilic colloid and the dispersion is added to the emulsion; or the method disclosed in JP-A-51-74624, in which a dye is dissolved by using a compound capable of red-shift and the solution is added to the emulsion. Ultrasonic waves may also be used for the preparation of the solution.

The sensitizing dye used for the present invention may be added to a silver halide emulsion that at any step known to be useful during the preparation of emulsion. For example, the dye may be added at a step of formation of silver halide grains and/or in a period before desalting or at a step of desilverization and/or in a period after desalting and before initiation of chemical ripening, as disclosed in, for example, U.S. Pat. Nos. 2,735,766, 3,628,960, 4,183,756, 4,225,666, JP-A-58-184142, JP-A-60-196749 etc., or the dye may be added in any period or at any step before coating of the emulsion, such as immediately before or during chemical ripening, or in a period after chemical ripening but before coating, as disclosed in, for example, JP-A-58-113920. Further, a sole kind of compound alone or compounds different in structure in combination may be added as divided portions, for example, a part is added during grain formation, and the remaining during chemical ripening or after completion of the chemical ripening, or a part is added before or during chemical ripening and the remaining after completion of the chemical ripening, as disclosed in, for example, U.S. Pat. No. 4,225,666 and JP-A-58-7629. The kind of compound or the kind of the combination of compounds added as divided portions may be changed.

The addition amount of the sensitizing dye used for the present invention varies depending on the shape, size, halogen composition of silver halide grains, method and degree of chemical sensitization, kind of antifoggant and so forth, but the addition amount may be from $4\times10^{-6}$ to $8\times10^{-3}$ mol per mol of silver halide. For example, when the silver halide grain size is from 0.2–1.3 $\mu$m, the addition amount is preferably from $2\times10^{-7}$ to $3.5\times10^{-6}$, more preferably from $6.5\times10^{-7}$ to $2.0\times10^{-6}$ mol, per $m^2$ of the surface area of silver halide grains.

There are no particular limitations on various additives used in the silver halide photographic light-sensitive material of the present invention and, for example, those described below can be used: polyhydroxybenzene compounds described in JP-A-3-39948, page 10, right lower column, line 11 to page 12, left lower column, line 5, specifically, Compounds (III)-1 to (III)-25 described in the same; compounds that substantially do not have an absorption maximum in the visible region represented by the formula (I) described in JP-A-1-118832, specifically, Compounds I-1 to I-26 described in the same; antifoggants described in JP-A-2-103536, page 17, right lower column, line 19, to page 18, right upper column, line 4; polymer latexes described in JP-A-2-103536, page 18, left lower column, line 12 to left lower column, line 20, polymer latexes having an active methylene group represented by formula (I) described in JP-A-9-179228, specifically, Compounds I-1 to I-16 described in the same, polymer latexes having core/shell structure described in JP-A-9-179228, specifically, Compounds P-1 to P-55 described in the same, and acidic polymer latexes described in JP-A-7-104413, page 14, left column, line 1 to right column, line 30, specifically, Compounds II-1) to II-9) described on page 15 of the same; matting agents, lubricants and plasticizers described in JP-A-2-103536, page 19, left upper column, line 15 to right upper column, line 15; hardening agents described in JP-A-2-103536, page 18, right upper column, line 5 to line 17; compounds having an acid radical described in JP-A-2-103536, page 18, right lower column, line 6 to page 19, left upper column, line 1; conductive materials described in JP-A-2-18542, page 2, left lower column, line 13 to page 3, right upper column, line 7, specifically, metal oxides described in page 2, right lower column, line 2 to line 10 of the same, and conductive polymer compounds P-1 to P-7 described in the same; water-soluble dyes described in JP-A-2-103536, page 17; solid dispersion dyes represented by the formulas (FA), (FA1), (FA2) and (FA3) described in JP-A-9-179243, specifically, Compounds F1 to F34 described in the same; Compounds (II-2) to (II-24), Compounds (III-5) to (III-18) and Compounds (IV-2) to (IV-7) described in JP-A-7-152112, and solid dispersion dyes described in JP-A-2-294638 and JP-A-5-11382; redox compounds capable of releasing a development inhibitor by oxidation described in JP-A-5-274816, preferably redox compounds represented by the formulas (R-1), (R-2) and (R-3) described in the same, specifically, Compounds R-1 to R-68 described in the same; and binders described in JP-A-2-18542, page 3, right lower column, line 1 to line 20.

The swelling ratio of the hydrophilic colloid layers including the emulsion layers and protective layers of the silver halide photographic light-sensitive materials of the present invention is preferably in the range of 80–150%, more preferably 90–140%. The swelling ratio of the hydrophilic colloid layer can be determined in the following manner. The thickness ($d_0$) of the hydrophilic colloid layers including the emulsion layers and protective layers of the silver halide photographic light-sensitive material is measured and the swollen thickness ($\Delta d$) is measured after the silver halide photographic material is immersed in distilled water at 25° C. for one minute. The swelling ratio is calculated from the following equation: Swelling ratio (%)= $(\Delta d/d_0)\times 100$.

The silver halide photographic light-sensitive material of the present invention preferably has a film surface pH of 6.0 or lower, more preferably 4.5–6.0, still more preferably 4.8–6.0, for the side on which silver halide emulsion layer is coated. If it is lower than 4.5, advance of hardening of emulsion layer tends to be slower.

As supports that can be used for practicing the present invention, for example, baryta paper, polyethylene-laminated paper, polypropylene synthetic paper, glass plate, cellulose acetate, cellulose nitrate, and polyester film, e.g., polyethylene terephthalate, can be exemplified. The support is appropriately selected depending on the intended use of the silver halide photographic light-sensitive material.

Further, supports comprising a styrene polymer having syndiotactic structure described in JP-A-7-234478 and U.S. Pat. No. 5,558,979 are also preferably used.

Processing chemicals such as developing solution (developer) and fixing solution (fixer) and processing methods that can be used for the silver halide photographic light-sensitive material according to the present invention are described below, but of course the present invention should not be construed as being limited to the following description and specific examples.

For the development of the silver halide photographic light-sensitive material of the present invention, any of known methods can be used, and known developers can be used.

A developing agent for use in developer (hereinafter, starter developer and replenisher developer are collectively referred to as developer) used for the present invention is not particularly limited, but it is preferable to add a dihydroxybenzene compound, ascorbic acid derivative or hydroquinonemonosulfonate, and they can be used each alone or in combination. In particular, a dihydroxybenzene type developing agent and an auxiliary developing agent exhibiting superadditivity are preferably contained in combination, and combinations of a dihydroxybenzene compound or an ascorbic acid derivative with a 1-phenyl-3-pyrazolidone compound, or combinations of a dihydroxybenzene compound or ascorbic acid compound with a p-aminophenol compound can be mentioned.

Examples of the dihydroxybenzene developing agent as a developing agent used for the present invention includes hydroquinone, chlorohydroquinone, isopropylhydroquinone, methylhydroquinone and so forth, and hydroquinone is particularly preferred. Examples of the ascorbic acid derivative developing agent include ascorbic acid, isoascorbic acid and salts thereof. Sodium erythorbate is particularly preferred in view of material cost.

Examples of the 1-phenyl-3-pyrazolidones, or derivatives thereof as the developing agent used for the present invention include 1-phenyl-3-pyrazolidone, 1-phenyl-4,4-dimethyl-3-pyra-zolidone, 1-phenyl-4-methyl-4-hydroxymethyl-3-pyrazolidone and so forth.

Examples of the p-aminophenol type developing agent that can be used for the present invention include N-methyl-p-aminophenol, p-aminophenol, N-(β-hydroxyphenyl)-p-aminophenol, N-(4-hydroxy-phenyl) glycine, o-methoxy-p-(N,N-dimethylamino) phenol, o-methoxy-p-(N-methylamino)phenol etc., and N-methyl-p-aminophenol and aminophenols described in JP-A-9-297377 and JP-A-9-297378 are preferred.

The dihydroxybenzene type developing agent is preferably used in an amount of generally 0.05–0.8 mol/L. When a dihydroxybenzene compound and a 1-phenyl-3-pyrazolidone compound or a p-aminophenol compound are used in combination, the former is preferably used in an amount of 0.05–0.6 mol/L, more preferably 0.10–0.5 mol/L, and the latter is preferably used in an amount of 0.06 mol/L or less, more preferably 0.003–0.03 mol/L.

The ascorbic acid derivative developing agent is preferably used in an amount of generally 0.01–0.5 mol/L, more preferably 0.05–0.3 mol/L. When an ascorbic acid derivative and a 1-phenyl-3-pyrazolidone compound or a p-aminophenol compound are used in combination, the ascorbic acid derivative is preferably used in an amount of from 0.01–0.5 mol/L, and the 1-phenyl-3-pyrazolidone compound or p-aminophenol compound is preferably used in an amount of 0.005–0.2 mol/L.

The developer used in processing the silver halide photographic light-sensitive material of the present invention may contain additives (e.g., a developing agent, alkali agent, pH buffer, preservative, chelating agent etc.) that are commonly used. Specific examples thereof are described below, but the present invention is by no means limited to them.

Examples of the buffer for use in the developer used in development include carbonates, boric acids described in JP-A-62-186259, saccharides (e.g., saccharose) described in JP-A-60-93433, oximes (e.g., acetoxime), phenols (e.g., 5-sulfosalicylic acid), tertiary phosphates (e.g., sodium salt and potassium salt) etc., and carbonates and boric acids are preferably used. The buffer, in particular the carbonate, is preferably used in an amount of 0.05 mol/L or more, particularly preferably 0.08–1.0 mol/L.

In the present invention, both the starter developer and the replenisher developer preferably have a property that the solution shows pH increase of 0.5 or less when 0.1 mol of sodium hydroxide is added to 1 L of the solution. As for the method of confirming whether the starter developer or replenisher developer used has the property, pH of the starter developer or replenisher developer to be tested is adjusted to 10.5, 0.1 mol of sodium hydroxide is added to 1 L of the solution, then pH of the solution is measured, and if increase of pH value is in the range of 0.5 or less, the solution is determined to have the property defined above. In the present invention, it is particularly preferable to use a starter developer and replenisher developer showing pH increase of 0.4 or less in the aforementioned test.

Examples of the preservative that can be used for the present invention include sodium sulfite, potassium sulfite, lithium sulfite, ammonium sulfite, sodium bisulfite, sodium methabisulfite, formaldehyde-sodium bisulfite and so forth. A sulfite is used in an amount of preferably 0.2 mol/L or more, particularly preferably 0.3 mol/L or more, but if it is added too excessively, silver staining in the developer is caused. Accordingly, the upper limit is preferably 1.2 mol/L. The amount is particularly preferably 0.35–0.7 mol/L.

As the preservative for a dihydroxybenzene type developing agent, a small amount of the aforementioned ascorbic acid derivative may be used together with the sulfite. Sodium erythorbate is particularly preferably used in view of material cost. It is preferably added in an amount of 0.03–0.12, particularly preferably 0.05–0.10, in terms of molar ratio with respect to the dihydroxybenzene type developing agent. When an ascorbic acid derivative is used as the preservative, the developer preferably does not contain a boron compound.

Examples of additives to be used other than, those described above include a development inhibitor such as sodium bromide and potassium bromide, an organic solvent such as ethylene glycol, diethylene glycol, triethylene glycol and dimethylformamide, a development accelerator such as an alkanolamine including diethanolamine, triethanolamine etc., and an imidazole and derivatives thereof and an agent for preventing uneven physical development such as a heterocyclic mercapto compound (e.g., sodium 3-(5-mercaptotetrazol-1-yl)benzenesulfonate, 1-phenyl-5-mercaptotetrazole etc.) and the compounds described in JP-A-62-212651.

Further, a mercapto compound, indazole compound, benzotriazole compound or benzimidazole compound may be added as an antifoggant or a black spot (black pepper) inhibitor. Specific examples thereof include 5-nitroindazole, 5-p-nitrobenzoylamino-indazole, 1-methyl-5-nitroindazole, 6-nitroindazole, 3-methyl-5-nitroindazole, 5-nitrobenzimidazole, 2-isopropyl-5-nitrobenzimi-dazole, 5-nitrobenzotriazole, sodium 4-((2-mercapto-1,3,4-thiadiazol-2-yl)thio)butanesulfonate, 5-amino-1,3,4-thiadiazole-2-thiol, methylbenzotriazole, 5-methylbenzotriazole, 2-mercapto-benzotriazole and so forth. The addition amount thereof is generally 0.01–10 mmol, preferably 0.1–2 mmol, per liter of the developer.

Further, various kinds of organic or inorganic chelating agents can be used individually or in combination in the developer used for the present invention.

As the inorganic chelating agents, sodium tetrapolyphosphate, sodium hexametaphosphate and so forth can be used.

As the organic chelating agents, organic carboxylic acid, aminopolycarboxylic acid, organic phosphonic acid, aminophosphonic acid and organic phosphonocarboxylic acid can be mainly used.

Examples of the organic carboxylic acid include acrylic acid, oxalic acid, malonic acid, succinic acid, glutaric acid, gluconic acid, adipic acid, pimelic acid, azelaic acid, sebacic acid, nonanedicarboxylic acid, decanedicarboxylic acid, undecanedicarboxylic acid, maleic acid, itaconic acid, malic acid, citric acid, tartaric acid etc.

Examples of the aminopolycarboxylic acid include iminodiacetic acid, nitrilotriacetic acid, nitrilotripropionic acid, ethylenediaminemonohydroxyethyltriacetic acid, ethylenedi-aminetetraacetic acid, glycol ether-tetraacetic acid, 1,2-diamino-propanetetraacetic acid, diethylenetriaminepentaacetic acid, triethylenetetraminehexaacetic acid, 1, 3-diamino-2-propanoltetra-acetic acid, glycol ether-diaminetetraacetic acid, and compounds described in JP-A-52-25632, JP-A-55-67747, JP-A-57-102624 and JP-B-53-40900.

Examples of the organic phosphonic acid include hydroxyalkylidene-diphosphonic acids described in U.S. Pat. Nos. 3,214,454 and 3,794,591 and West German Patent Publication No. 2,227,369, and the compounds described in Research Disclosure, Vol. 181, Item 18170 (May, 1979) and so forth.

Examples of the aminophosphonic acid include aminotris (methylenephosphonic acid), ethylenediaminetetramethyl-enephosphonic acid, aminotrimethylenephosphonic acid and so forth, and the compounds described in Research Disclosure, No. 18170 (supra), JP-A-57-208554, JP-A-54-61125, JP-A-55-29883, JP-A-56-97347 and so forth can also be mentioned.

Examples of the organic phosphonocarboxylic acid include the compounds described in JP-A-52-102726, JP-A-53-42730, JP-A-54-121127, JP-A-55-4024, JP-A-55-4025, JP-A-55-126241, JP-A-55-65955, JP-A-55-65956, Research Disclosure, No. 18170 (supra) and so forth.

The organic and/or inorganic chelating agents are not limited to those described above. The organic and/or inorganic chelating agents may be used in the form of an alkali metal salt or an ammonium salt. The amount of the chelating agent added is preferably from $1\times10^{-4}$ to $1\times10^{-1}$ mol, more preferably from $1\times10^{-3}$ to $1\times10^{-2}$ mol, per liter of the developer.

Further, a silver stain inhibitor may be added to the developer, and examples thereof include, for example, the compounds described in JP-A-56-24347, JP-B-56-46585, JP-B-62-2849, JP-A-4-362942 and JP-A-8-6215; triazines having one or more mercapto groups (for example, the compounds described in JP-B-6-23830, JP-A-3-282457, and JP-A-7-175178); pyrimidines having one or more mercapto groups (e.g., 2-mercaptopyrimidine, 2,6-dimercaptopyrimidine, 2,4-dimer-captopyrimidine, 5,6-diamino-2,4-dimercaptopyrimidine, 2,4,6-trimercaptopyrimidine, the compounds described in JP-A-9-274289 etc.); pyridines having one or more mercapto groups (e.g., 2-mercaptopyridine, 2,6-dimercaptopyridine, 3,5-dimercaptopyri-ine, 2,4,6-trimercaptopyridine, compounds described in JP-A-7-248587 etc.); pyrazines having one or more mercapto groups (e.g., 2-mercaptopyrazine, 2,6-dimercaptopyrazine, 2,3-dimer-captopyrazine, 2,3,5-trimercaptopyrazine etc.); pyridazines having one or more mercapto groups (e.g., 3-mercaptopyridazine, 3,4-dimercaptopyridazine, 3,5-dimercaptopyridazine, 3,4,6-trimer-captopyridazine etc.); the compounds described in JP-A-7-175177, polyoxyalkylphosphates described in U.S. Pat. No. 5,457,011 and so forth. These silver stain inhibitors may be used individually or in combination of two or more of these. The addition amount thereof is preferably 0.05–10 mmol, more preferably 0.1–5 mmol, per liter of the developer.

The developer may also contain the compounds described in JP-A-61-267759 as a dissolution aid. Further, the developer may also contain a toning agent, surfactant, defoaming agent, hardening agent or the like, if necessary.

The developer preferably has a pH of 9.0–12.0, more preferably 9.0–11.0, particularly preferably 9.5–11.0. The alkali agent used for adjusting pH may be a usual water-soluble inorganic alkali metal salt (e.g., sodium hydroxide, potassium hydroxide, sodium carbonate, potassium carbonate etc.).

With respect to the cation of the developer, potassium ion less inhibits development and causes less indentations, called fringes, on peripheries of blackened portions, compared with sodium ion. When the developer is stored as a concentrated solution, potassium salt is generally preferred, because of its higher solubility. However, since, in the fixer, potassium ion causes fixing inhibition on the same level as silver ion, a high potassium ion concentration in the developer disadvantageously causes increase of the potassium ion concentration in the fixer because of carrying over of the developer by the silver halide photographic light-sensitive material. In view of the above, the molar ratio of potassium ion to sodium ion in the developer is preferably between 20:80 and 80:20. The ratio of potassium ion to sodium ion can be freely controlled within the above-described range by a counter cation such as those derived from a pH buffer, pH adjusting agent, preservative, chelating agent or the like.

The replenishing amount of the developer is generally 390 mL or less, preferably 30–325 mL, most preferably 120–250 mL, per $m^2$ of the silver halide photographic light-sensitive material. The replenisher developer may have the same composition and/or concentration as the starter developer, or it may have a different composition and/or concentration from the starter developer.

Examples of the fixing agent in the fixing processing agent that can be used for the present invention include ammonium thiosulfate, sodium thiosulfate and ammonium sodium thiosulfate. The amount of the fixing agent may be varied appropriately, but it is generally about 0.7–3.0 mol/L.

The fixer that can be used for the present invention may contain a water-soluble aluminum salt or a water-soluble chromium salt, which acts as a hardening agent, and of these salts, a water-soluble aluminum salt is preferred. Examples thereof include aluminum chloride, aluminum sulfate, potassium alum, ammonium aluminum sulfate, aluminum nitrate, aluminum lactate and so forth. These are preferably contained in an amount of 0.01–0.15 mol/L in terms of an aluminum ion concentration in the solution used.

When the fixer is stored as a concentrated solution or a solid agent, it may be constituted by a plurality of parts including a hardening agent or the like as a separate part, or it may be constituted as a one-part agent containing all components.

The fixing processing agent may contain, if desired, a preservative (e.g., sulfite, bisulfite, metabisulfite etc. in an amount of 0.015 mol/L or more, preferably 0.02–0.3 mol/L), pH buffer (e.g., acetic acid, sodium acetate, sodium carbonate, sodium hydrogencarbonate, phosphoric acid, succinic acid, adipic acid etc. in an amount of generally 0.1–1 mol/L, preferably 0.2–0.7 mol/L), and a compound having aluminum-stabilizing ability or hard water-softening ability (e.g., gluconic acid, iminodiacetic acid, 5-sulfosalicylic acid, glucoheptanoic acid, malic acid, tartaric acid, citric acid, oxalic acid, maleic acid, glycolic acid, benzoic acid, salicylic acid, Tiron, ascorbic acid, glutaric acid, aspartic acid, glycine, cysteine, ethylenediaminetetraacetic acid, nitrilotriacetic acid, derivatives and salts thereof, saccharides etc. in an amount of 0.001–0.5 mol/L, preferably 0.005–0.3 mol/L). However, in view of environmental protection recently concerned, it is preferred that a boron compound is not contained.

In addition, the fixing processing agent may contain a compound described in JP-A-62-78551, a pH adjusting agent (e.g., sodium hydroxide, ammonia, sulfuric acid etc.), a surfactant, a wetting agent, a fixing accelerator etc. Examples of the surfactant include anionic surfactants such as sulfated products and sulfonated products, polyethylene surfactants and amphoteric surfactants described in JP-A-57-6840. Known deforming agents may also be used. Examples of the wetting agent include alkanolamines and alkylene glycols. Examples of the fixing accelerator include alkyl- or aryl-substituted thiosulfonic acids and salts thereof described in JP-A-6-308681; thiourea derivatives described in JP-B-45-35754, JP-B-58-122535 and JP-B-58-122536; alcohols having a triple bond within the molecule; thioether compounds described in U.S. Pat. No. 4,126,459; mercapto compounds described in JP-A-64-4739, JP-A-1-4739, JP-A-1-159645 and JP-A-3-101728; mesoionic compounds and thiocyanates described in JP-A-4-170539.

pH of the fixer used for the present invention is preferably 4.0 or more, more preferably 4.5–6.0. pH of the fixer rises with processing by the contamination of a developer. In such a case, pH of a hardening fixer is preferably 6.0 or less, more preferably 5.7 or less, and that of a non-hardening fixer is preferably 7.0 or less, more preferably 6.7 or less.

The replenishing rate of the fixer is preferably 500 mL or less, more preferably 390 mL or less, still more preferably 320–80 mL, per $m^2$ of processed silver halide photographic light-sensitive material. The composition and/or the concentration of the replenisher fixer may be the same as or different from those of the starter fixer.

The fixer can be reclaimed for reuse according to known fixer reclaiming methods such as electrolytic silver recovery. As reclaiming apparatuses, there are FS-2000 produced by Fuji Photo Film Co., Ltd. and so forth.

Further, removal of dyes and so forth using an adsorptive filter such as those comprising activated carbon is also preferred.

When the developing and fixing processing chemicals used in the present invention are solutions, they are preferably preserved in packaging materials of low oxygen permeation as disclosed in JP-A-61-73147. Further, when these solutions are concentrated solutions, they are diluted with water to a predetermined concentration in the ratio of 0.2–3 parts of water to one part of the concentrated solutions.

Even if the developing processing chemicals and fixing processing chemicals used in the present invention are made as solids, the same effects as solutions can be obtained. Solid processing chemicals are described below.

Solid chemicals that can be used for the present invention may be made into known shapes such as powders, granular powders, granules, lumps, tablets, compactors, briquettes, plates, bars, paste or the like. These solid chemicals may be covered with water-soluble coating agents or films to separate components that react with each other on contact, or they may have a multilayer structure to separate components that react with each other, or both types may be used in combination.

Although known coating agents and auxiliary granulating agents can be used, polyvinylpyrrolidone, polyethylene glycol, polystyrenesulfonic acid and vinyl compounds are preferably used. Further, JP-A-5-45805, column 2, line 48 to column 3, line 13 can be referred to.

When a multilayer structure is used, components that do not react with each other on contact may be sandwiched with components that react with each other and made into tablets and briquettes, or components of known shapes may be made into a similar layer structure and packaged. Methods therefor are disclosed in JP-A-61-259921, JP-A-4-16841, JP-A-4-78848, JP-A-5-93991 and so forth.

The bulk density of the solid processing chemicals is preferably 0.5–6.0 g/cm$^3$, in particular, the bulk density of tablets is preferably 1.0–5.0 g/cm$^3$, and that of granules is preferably 0.5–1.5 g/cm$^3$.

Solid processing chemicals used for the present invention can be produced by using any known method, and one can refer to, for example, JP-A-61-259921, JP-A-4-15641, JP-A-4-16841, JP-A-4-32837, JP-A-4-78848, JP-A-5-93991, JP-A-4-85533, JP-A-4-85534, JP-A-4-85535, JP-A-5-134362, JP-A-5-197070, JP-A-5-204098, JP-A-5-224361, JP-A-6-138604, JP-A-6-138605, JP-A-8-286329 and so forth.

More specifically, the rolling granulating method, extrusion granulating method, compression granulating, method, cracking granulating method, stirring granulating method, spray drying method, dissolution coagulation method, briquetting method, roller compacting method and so forth can be used.

The solubility of the solid chemicals used in the present invention can be adjusted by changing state of surface (smooth, porous, etc.) or partially changing the thickness, or making the shape into a hollow doughnut type. Further, it is also possible to provide different solubilities to a plurality of granulated products, or it is also possible for materials having different solubilities to use various shapes to obtain the same solubilities. Multilayer granulated products having different compositions between the inside and the surface can also be used.

Packaging materials of solid chemicals preferably have low oxygen and water permeabilities, and those of known shapes such as bag-like, cylindrical and box-like shapes can be used. Packaging materials of foldable shapes are preferred for saving storage space of waste packaging materials as disclosed in JP-A-6-242585 to JP-A-6-242588, JP-A-6-247432, JP-A-6-247448, JP-A-6-301189, JP-A-7-5664, and JP-A-7-5666 to JP-A-7-5669. Takeout ports of processing chemicals of these packaging materials may be provided with a screw cap, pull-top or aluminum seal, or packaging materials may be heat-sealed, or other known types may be used, and there are no particular limitations. Waste packaging materials are preferably recycled or reused in view of environmental protection.

Methods of dissolution and replenishment of the solid processing chemicals are not particularly limited, and known methods can be used. Examples of these known methods include a method in which a certain amount of processing chemicals are dissolved and replenished by a dissolving apparatus having a stirring function, a method in which processing chemicals are dissolved by a dissolving apparatus having a dissolving zone and a zone where a finished solution is stocked and the solution is replenished from the stock zone as disclosed in JP-A-9-80718, and methods in which processing chemicals are fed to a circulating system of an automatic processor and dissolved and replenished, or processing chemicals are fed to a dissolving tank provided in an automatic processor with progress of the processing of silver halide photographic light-sensitive materials as disclosed in JP-A-5-119454, JP-A-6-19102 and JP-A-7-261357. In addition to the above methods, any of known methods can be used. The charge of processing chemicals may be conducted manually, or automatic opening and automatic charge may be conducted by using a dissolving apparatus or an automatic processor provided with an opening mechanism as disclosed in JP-A-9-138495. The latter is preferred in view of the working environment. Specifically, there are methods of pushing through, unsealing, cutting off and bursting a takeout port of package, methods disclosed in JP-A-6-19102 and JP-A-6-95331 and so forth.

A silver halide photographic light-sensitive material is subjected to washing or stabilizing processing after being developed and fixed (hereinafter washing includes stabilization processing, and a solution used therefor is called water or washing water unless otherwise indicated). The water used for washing may be any of tap water, ion exchange water, distilled water and stabilized solution. The replenishing rate therefor is, in general, about 8–17 liters per m$^2$ of the silver halide photographic light-sensitive material, but washing can be carried out with a replenishing rate less than the above. In particular, with a replenishing rate of 3 liters or less (including zero, i.e., washing in a reservoir), not only water saving processing can be carried out but also piping for installation of an automatic processor becomes unnecessary. When washing is carried out with a reduced replenishing amount of water, it is more preferable to use a washing tank equipped with a squeegee roller or a crossover roller disclosed in JP-A-63-18350, JP-A-62-287252 or the like. The addition of various kinds of oxidizing agents (e.g., ozone, hydrogen peroxide, sodium hypochlorite, activated halogen, chlorine dioxide, sodium carbonate hydrogen peroxide salt etc.) and filtration through filters may be combined to reduce load on environmental pollution which becomes a problem when washing is carried out with a small amount of water and to prevent generation of scale.

As a method of reducing the replenishing amount of the washing water, a multistage countercurrent system (e.g., two stages or three stages) has been known for a long time. The replenishing amount of the washing water in this system is preferably 50–200 mL per m of the silver halide photographic light-sensitive material. This effect can also similarly be obtained in an independent multistage system (a method in which a countercurrent is not used and fresh solution is separately replenished to multistage washing tanks).

Further, means for preventing generation of scale may be included in a washing process. Means for preventing generation of scale is not particularly limited, and known methods can be used. There are, for example, a method of adding an antifungal agent (so-called scale preventive), a method of using electroconduction, a method of irradiating ultraviolet ray, infrared ray or far infrared ray, a method of applying a magnetic field, a method of using ultrasonic wave processing, a method of applying heat, a method of emptying tanks when they are not used and so forth. These scale preventing means may be used with progress of the processing of silver halide photographic light-sensitive materials, may be used at regular intervals irrespective of usage conditions, or may be conducted only during the time when processing is not conducted, for example, during night. In addition, washing water previously subjected to a treatment with such means may be replenished. It is also preferable to use different scale preventing means for every given period of time for inhibiting proliferation of resistant fungi.

As a water-saving and scale-preventing apparatus, an apparatus AC-1000 produced by Fuji Photo Film Co., Ltd. and a scale-preventing agent AB-5 produced by Fuji Photo Film Co., Ltd. may be used, and the method disclosed in JP-A-11-231485 may also be used.

The antifungal agent is not particularly restricted, and a known antifungal agent may be used. Examples thereof include, in addition to the above-described oxidizing agents, glutaraldehyde, chelating agent such as aminopolycarboxylic acid, cationic surfactant, mercaptopyridine oxide (e.g., 2-mercaptopyridine-N-oxide) and so forth, and a sole antifungal agent may be used, or a plurality of antifungal agents may be used in combination.

The electricity may be applied according to the methods described in JP-A-3-224685, JP-A-3-224687, JP-A-4-16280, JP-A-4-18980 and so forth.

In addition, a known water-soluble surfactant or defoaming agent may be added so as to prevent uneven processing due to bubbling, or to prevent transfer of stains. Further, the dye adsorbent described in JP-A-63-163456 may be provided in the washing with water system, so as to prevent stains due to a dye dissolved out from the silver halide photographic light-sensitive material.

Overflow solution from the washing with water step may be partly or wholly used by mixing it with the processing solution having fixing ability, as described in JP-A-60-235133. It is also preferable, in view of protection of the natural environment, to reduce the biochemical oxygen demand (BOD), chemical oxygen demand (COD), iodine consumption or the like before discharge by subjecting the solution to microbial treatment (for example, activated sludge treatment, treatment with a filter comprising a porous carrier such as activated carbon or ceramic carrying microorganisms such as sulfur-oxidizing bacteria etc.) or oxidation treatment with electrification or an oxidizing agent before discharge, or to reduce the silver concentration in waste water by passing the solution through a filter using a polymer having affinity for silver, or by adding a compound that forms a hardly soluble silver complex, such as trimercaptotriazine, to precipitate silver, and then passing the solution through a filter.

In some cases, stabilization may be performed subsequent to the washing with water, and as an example thereof, a bath containing the compounds described in JP-A-2-201357, JP-A-2-132435, JP-A-1-102553 and JP-A-46-44446 may be used as a final bath of the silver halide photographic light-sensitive material. This stabilization bath may also contain, if desired, an ammonium compound, metal compound such as Bi or Al, fluorescent brightening agent, various chelating agents, layer pH-adjusting agent, hardening agent, bactericide, antifungal agent, alkanolamine or surfactant.

The additives such as antifungal agent and the stabilizing agent added to the washing with water or stabilization bath may be formed into a solid agent like the aforementioned development and fixing processing agents.

Waste solutions of the developer, fixer, washing water or stabilizing solution used for the present invention are preferably burned for disposal. The waste solutions can also be concentrated or solidified by a concentrating apparatus such as those described in JP-B-7-83867 and U.S. Pat. No. 5,439,560, and then disposed.

When the replenishing amount of the processing agents is reduced, it is preferable to prevent evaporation or air oxidation of the solution by reducing the opening area of the processing tank. A roller transportation-type automatic developing machine is described in, for example, U.S. Pat. Nos. 3,025,779 and 3,545,971, and in the present specification, it is simply referred to as a roller transportation-type automatic processor. This automatic processor performs four steps of development, fixing, washing with water and drying, and it is most preferable to follow this four-step processing also in the present invention, although other steps (e.g., stopping step) are not excluded. Further, a rinsing bath, tank for washing with water or washing tank may be provided between development and fixing and/or between fixing and washing with water.

In the development of the silver halide photographic light-sensitive material of the present invention, the dry-to-dry time from the start of processing to finish of drying is preferably 25–160 seconds, the development time and the fixing time are each generally 40 seconds or less, preferably 6–35 seconds, and the temperature of each solution is preferably 25–50° C., more preferably 30–40° C. The temperature and the time of washing with water are preferably 0–50° C. and 40 seconds or less, respectively. According to such a method, the silver halide photographic light-sensitive material after development, fixing and washing with water may be passed through squeeze rollers, for squeezing washing water, and then dried. The drying is generally performed at a temperature of from about 40° C. to about 100° C. The drying time may be appropriately varied depending on the ambient conditions. The drying method is not particularly limited, and any known method may be used. Hot-air drying and drying by a heat roller or far infrared rays as described in JP-A-4-15534, JP-A-5-2256 and JP-A-5-289294 may be used, and a plurality of drying methods may also be used in combination.

The present invention will be specifically explained with reference to the following examples and comparative examples. The materials, amounts, ratios, types and procedures of processes and so forth shown in the following examples can be optionally changed so long as such change does not depart from the spirit of the present invention. Therefore, the scope of the present invention should not be construed in a limitative way based on the following examples.

EXAMPLE 1

In this example, silver halide photographic light-sensitive materials satisfying the requirements of the present invention (Samples 6 to 9 and 14 to 30) and comparative silver halide photographic light-sensitive materials (Samples 1 to 5 and 10 to 13) were prepared and evaluated. Production methods of emulsions and non-photosensitive silver halide grains used for the production of those silver halide photographic light-sensitive materials will be explained first, and then the method for producing the silver halide photographic light-sensitive materials and evaluations of them will be explained.

| <<Preparation of Emulsion A>> | |
|---|---|
| Solution 1 | |
| Water | 750 mL |
| Gelatin | 20 g |
| Sodium chloride | 3 g |
| 1,3-Dimethylimidazolidine-2-thione | 20 mg |
| Sodium benzenethiosulfonate | 10 mg |
| Citric acid | 0.7 g |
| Solution 2 | |
| Water | 300 mL |
| Silver nitrate | 150 g |
| Solution 3 | |
| Water | 300 mL |
| Sodium chloride | 38 g |
| Potassium bromide | 32 g |
| $K_3IrCl_6$ (0.005% in 20% KCl aqueous solution) | Amount shown in Table 1 |

-continued

| <<Preparation of Emulsion A>> | |
|---|---|
| $(NH_4)_3[RhCl_5(H_2O)]$ (0.001% in 20% NaCl aqueous solution) | Amount shown in Table 1 |

$K_3IrCl_6$ (0.005%) and $(NH_4)_3[RhCl_5(H_2O)]$ (0.001%) used for Solution 3 were prepared by dissolving powder of each in 20% aqueous solution of KCl or 20% aqueous solution of NaCl and heating the solution at 40° C. for 120 minutes.

Solution 2 and Solution 3 in amounts corresponding to 90% of each were simultaneously added to Solution 1 maintained at 38° C. and pH 4.5 over 20 minutes with stirring to form nucleus grains having a diameter of 0.16 μm. Subsequently, Solution 4 and Solution 5 shown below were added over 8 minutes. Further, the remaining 10% of Solution 2 and Solution 3 were added over 2 minutes to allow growth of the grains to a diameter of 0.21 μm. Further, 0.15 g of potassium iodide was added and ripening was allowed for 5 minutes to complete the grain formation.

| | |
|---|---|
| Solution 4 | |
| Water | 100 mL |
| Silver nitrate | 50 g |
| Solution 5 | |
| Water | 100 mL |
| Sodium chloride | 13 g |
| Potassium bromide | 11 g |
| $K_4[Fe(CN)_6].3H_2O$ (potassium ferrocyanide) | Amount shown in Table 1 |

Then, the resulting grains were washed according to a conventional flocculation method. Specifically, after the temperature of the mixture was lowered to 35° C., 3 g of Anionic precipitating agent 1 shown below was added to the mixture, and pH was lowered by using sulfuric acid until the silver halide was precipitated (lowered to the range of pH 3.2±0.2). Then, about 3 L of the supernatant was removed (first washing with water). Furthermore, the mixture was added with 3 L of distilled water and then with sulfuric acid until the silver halide was precipitated. In a volume of 3 L of the supernatant was removed again (second washing with water). The same procedure as the second washing with water was repeated once more (third washing with water) to complete the washing with water and desalting processes. The emulsion after the washing with water and desalting was added with 45 g of gelatin, and after pH was adjusted to 5.6 and pAg was adjusted to 7.5, added with 10 mg of sodium benzenethiosulfonate, 3 mg of sodium benzenethiosulfinate, 15 mg of sodium thiosulfate and 10 mg of chloroauric acid to perform chemical sensitization at 55° C. for obtaining optimal sensitivity, and then added with 100 mg of 4-hydroxy-6-methyl-1,3,3a,7-tetrazaindene as a stabilizer and 100 mg of an antiseptic (Proxcel, ICI).

Finally, there was obtained an emulsion of cubic silver iodochlorobromide grains containing 30 mol % of silver bromide and 0.08 mol % of silver iodide and having an average grain size of 0.22 μm and a variation coefficient of 9%. The emulsion finally showed pH of 5.7, pAg of 7.5, electric conductivity of 40 μS/m, density of 1.2–1.25×$10^3$ kg/$m^3$ and viscosity of 50 mPa·s.

Anionic precipitating agent 1

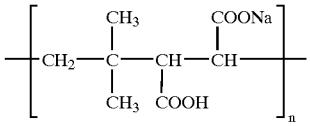

Average molecular weight: 120,000

| <<Preparation of Emulsion B>> | |
|---|---|
| Solution 1 | |
| Water | 750 mL |
| Gelatin | 20 g |
| Sodium chloride | 1 g |
| 1,3-Dimethylimidazolidine-2-thione | 20 mg |
| Sodium benzenthiosulfonate | 10 mg |
| Citric acid | 0.7 g |
| Solution 2 | |
| Water | 300 mL |
| Silver nitrate | 150 g |
| Solution 3 | |
| Water | 300 mL |
| Sodium chloride | 38 g |
| Potassium bromide | 32 g |
| $K_3IrCl_6$ (0.005% in 20% KCl aqueous solution) | Amount shown in Table 1 |
| $(NH_4)_3[RhCl_5(H_2O)]$ (0.001% in 20% NaCl aqueous solution) | Amount shown in Table 1 |

$K_3IrCl_6$ (0.005%) and $(NH_4)_3[RhCl_5(H_2O)]$ (0.001%) used for Solution 3 were prepared by dissolving powder of each in 20% aqueous solution of KCl or 20% aqueous solution of NaCl and heating the solution at 40° C. for 120 minutes.

Solution 2 and Solution 3 in amounts corresponding to 90% of each were simultaneously added to Solution 1 maintained at 38° C. and pH 4.5 over 20 minutes with stirring to form nucleus grains having a diameter of 0.16 μm. Subsequently, 500 mg of 4-hydroxy-6-methyl-1,3,3a,7-tetrazaindene was added, and Solution 4 and Solution 5 shown below were further added over 8 minutes. Further, the remaining 10% of Solution 2 and Solution 3 were added over 2 minutes to allow growth of the grains to a diameter of 0.18 μm. Further, 0.15 g of potassium iodide was added and ripening was allowed for 5 minutes to complete the grain formation.

| | |
|---|---|
| Solution 4 | |
| Water | 100 mL |
| Silver nitrate | 50 g |
| Solution 5 | |
| Water | 100 mL |
| Sodium chloride | 13 mg |
| Potassium bromide | 11 mg |
| $K_4[Fe(CN)_6].3H_2O$ (potassium ferrocyanide) | Amount shown in Table 1 |

Then, the resulting grains were washed according to a conventional flocculation method. Specifically, after the temperature of the mixture was lowered to 35° C., 3 g of Anionic precipitating agent 1 was added to the mixture, and pH was lowered by using sulfuric acid until the silver halide was precipitated (lowered to the range of pH 3.2±0.2). Then, about 3 L of the supernatant was removed (first washing with water). Furthermore, the mixture was added with 3 L of distilled water and then with sulfuric acid until the silver halide was precipitated. In an amount of 3 L of the supernatant was removed again (second washing with water). The same procedure as the second washing with water was repeated once more (third washing with water) to complete the washing with water and desalting processes. The emulsion after the washing with water and desalting was added with 45 g of gelatin, and after pH was adjusted to 5.6 and pAg was adjusted to 7.5, added with 10 mg of sodium benzenethiosulfonate, 3 mg of sodium benzenethiosulfinate, 2 mg of triphenylphosphine selenide and 10 mg of chloroauric acid to perform chemical sensitization at 55° C. for obtaining optimal sensitivity, and then added with 100 mg of 4-hydroxy-6-methyl-1,3,3a,7-tetrazaindene as a stabilizer and 100 mg of an antiseptic (Proxcel, ICI).

Finally, there was obtained an emulsion of cubic silver iodochlorobromide grains containing 30 mol % of silver bromide and 0.08 mol % of silver iodide and having an average grain size of 0.18 μm and a variation coefficient of 10%. The emulsion finally showed pH of 5.7, pAg of 7.5, electric conductivity of 40 μS/m, density of $1.2\times10^3$ kg/m$^3$ and viscosity of 50 mPa·s.

<<Preparation of Emulsions C to K>>

These emulsions were prepared in the same manner as the preparation of Emulsion B except that the halogen compositions, grain sizes, kinds of doped heavy metals and addition amounts were changed as shown in Table 1. The halogen composition was controlled by changing addition amounts of sodium chloride and potassium bromide in Solutions 3 and 5, and the grain sizes were controlled by changing addition amounts of sodium chloride and preparation temperatures for Solution 1.

<<Preparation of Non-photosensitive silver halide grains (i)>>

| | |
|---|---|
| Solution 1 | |
| Water | 1 L |
| Gelatin | 20 g |
| Sodium chloride | 3.0 g |
| 1,3-Dimethylimidazolidine-2-thione | 20 mg |
| Sodium benzenethiosulfonate | 8 mg |
| Solution 2 | |
| Water | 400 mL |
| Silver nitrate | 100 g |
| Solution 3 | |
| Water | 400 mL |
| Sodium chloride | 13.5 g |
| Potassium bromide | 45.0 g |
| $(NH_4)_3[RhCl_5(H_2O)]$ (0.001% in 20% NaCl aqueous solution) | $4\times10^{-5}$ mol/Ag mol |

Solutions 1, 2 and 3 maintained at 70° C. and pH 4.5 were simultaneously added over 15 minutes with stirring to form nucleus grains. Subsequently, Solution 4 and Solution 5 shown below were added over 15 minutes, and 0.15 g of potassium iodide was added to complete the grain formation.

Then, the resulting grains were washed with water according to a conventional flocculation method. Specifically, after the temperature of the mixture was lowered to 35° C., 3 g of Anionic precipitating agent 1 was added to the mixture, and pH was lowered by using sulfuric acid until the silver halide was precipitated (lowered to the range of pH 3.2±0.2). Then, about 3 L of the supernatant was removed (first washing with water). Furthermore, the mixture was added with 3 L of distilled water and then with sulfuric acid until the silver halide was precipitated. In an amount of 3 L of the supernatant was removed again (second washing with water). The same procedure as the second washing with water was repeated once more (third washing with water) to complete the washing with water and desalting processes. The emulsion after the washing with water and desalting was added with 45 g of gelatin, and after pH was adjusted to 5.7 and pAg was adjusted to 7.5, added with phenoxyethanol as an antiseptic to finally obtain a dispersion of non-post ripened cubic silver chloroiodobromide grains (i) containing 30 mol % of silver chloride and 0.08 mol % of silver iodide in average and having an average grain size of 0.45 μm and a variation coefficient of 10%. The emulsion finally showed pH of 5.7, pAg of 7.5, electric conductivity of 40 μS/m, density of $1.3–1.35\times10^3$ kg/m$^3$ and viscosity of 50 mPa·s.

<<Preparation of Non-photosensitive silver halide grains (ii)>>

| | |
|---|---|
| Solution 1 | |
| Water | 1 L |
| Gelatin | 20 g |
| Potassium bromide | 0.9 g |
| Citric acid | 0.2 g |
| $NH_4NO_3$ | 20 g |
| Hydrogen peroxide | 3.5 g |
| Sodium benzenethiosulfonate | 15 mg |
| Solution 2 | |
| Water | 400 mL |
| Silver nitrate | 200 g |
| Solution 3 | |
| Water | 400 mL |
| Potassium bromide | 140.0 g |
| $(NH_4)_3[RhCl_5(H_2O)]$ (0.001% in 20% NaCl aqueous solution) | $4\times10^{-5}$ mol/Ag mol |

Solution 1 maintained at 60° C. was added, with stirring, with 40 mL of NaOH (1 mol/L) and 0.7 g of a silver nitrate aqueous solution. Then, ½each of Solution 2 and Solution 3 were added by the controlled double jet method over 20 minutes while the silver potential was maintained at +24 mV. After physical ripening for 2 minutes, the remaining ½each of Solution 2 and Solution 3 were similarly added by the controlled double jet method over 20 minutes to attain grain formation.

Then, the resulting grains were washed according to a conventional flocculation method. Specifically, after the temperature of the mixture was lowered to 35° C., 3 g of Anionic precipitating agent 1 was added to the mixture, and pH was lowered by using sulfuric acid until the silver halide was precipitated (lowered to the range of pH 3.1±0.2). Then, about 3 L of the supernatant was removed (first washing with water). Furthermore, the mixture was added with 3 L of distilled water and then with sulfuric acid until the silver halide was precipitated. In a volume of 3 L of the supernatant was removed again (second washing with water). The same procedure as the second washing with water was repeated once more (third washing with water) to complete the washing with water and desalting processes. The emulsion after the washing with water and desalting was added with 45 g of gelatin, and after pH was adjusted to 5.7 and pAg was adjusted to 7.5, added with phenoxyethanol as an antiseptic to finally obtain a dispersion of non-post ripened tetradecahedral silver bromide grains (ii) containing 30 mol % of silver chloride and 0.08 mol % of silver iodide in average and having an average grain size of 0.8 μm and a variation coefficient of 10%. The emulsion finally showed pH of 5.7, pAg of 7.5, electric conductivity of 40 μS/m, density of $1.3\times10^3$ kg/m$^3$ and viscosity of 30 mPa·s.

<<Preparation of Non-photosensitive Silver Halide Grains (iii)>>

Aqueous solutions X-1 to X-4 mentioned blow were added with $(NH_4)_3[RhCl_5(H_2O)]$ (0.001% in 20% NaCl aqueous solution) in an amount corresponding to $1\times10^{-5}$ mol per 1 mol of KBr to perform grain formation.

(Addition 1)

An aqueous solution (1300 mL) containing 0.6 g of KBr and 1.1 g of gelatin having an average molecular weight of 15,000 was maintained at 35° C. and stirred.

To the above solution, Aqueous solution Ag-1 (24 mL, containing 4.9 g of $AgNO_3$ per 100 mL), 24 mL of Aqueous solution X-1 (containing 4.1 g of KBr per 100 mL) and 24 mL of, Aqueous solution G-1 (containing 1.8 g of gelatin having an average molecular weight of 15,000 per 100 mL) were added over 30 seconds at constant flow rates by the triple jet method.

Then, 1.3 g of KBr was added, and the temperature was increased to 75° C. A ripening period was provided for 12 minutes after the temperature increase, then 300 mL of Aqueous solution G-2 (containing 12.7 g of gelatin, which was obtained by adding trimellitic acid anhydride to an aqueous solution of alkali-treated osseine gelatin, allowing a reaction at 50° C. and pH 9.0 and removing remaining trimellitic acid, per 100 mL), and then 2.1 g of disodium 4,5-dihydroxy-1,3-disulfonate monohydrate and 0.002 g of thiourea dioxide were successively added with intervals of 1 minute.

(Addition 2)

Then, 157 mL of Aqueous Solution Ag-2 (containing 22.1 g of $AgNO_3$ per 100 mL) and Aqueous solution X-2 (containing 15.5 g of KBr per 100 mL) were added over 14 minutes by the double jet method. In this operation, as for the addition of Aqueous Solution Ag-2, the flow rate was increased so that the final flow rate should become 3.4 times the initial flow rate. The addition of Aqueous Solution X-2 was performed so that pAg of the bulk emulsion solution in the reaction vessel should be kept at 8.3.

(Addition 3)

Subsequently, 329 mL of Aqueous Solution Ag-3 (containing 32.0 g of $AgNO_3$ per 100 mL) and Aqueous Solution X-3 (containing 21.5 g of KBr and 1.6 g of KI per 100 mL) were added over 27 minutes by the double jet method. In this operation, as for the addition of Aqueous Solution Ag-3, the flow rate was increased so that the final flow rate should become 1.6 times the initial flow rate. The addition of Aqueous Solution X-3 was performed so that pAg of the bulk emulsion solution in the reaction vessel should be kept at 8.3.

(Addition 4)

Further, 156 mL of Aqueous Solution Ag-4 (containing 32.0 g of $AgNO_3$ per 100 mL) and Aqueous Solution X-4 (containing 22.4 g of KBr per 100 mL) were added over 17 minutes by the double jet method. In this operation, Aqueous Solution Ag-4 was added at a constant flow rate, and the addition of Aqueous Solution X-3 was performed so that pAg of the bulk emulsion solution in the reaction vessel should be kept at 8.3.

Then, 0.0025 g of sodium benzenethiosulfonate and 125 mL of Aqueous Solution G-3 (containing 12.0 g of alkali-treated osseine gelatin per 100 mL) were successively added with intervals of 1 minute.

Subsequently, 43.7 g of KBr was added, pAg of the bulk emulsion solution in the reaction vessel was adjusted to 9.0, and then 73.9 g of AgI fine grains (containing 13.0 g of AgI fine grains having a mean grain size of 0.047 μm per 100 g) was added.

(Addition 5)

From 2 minutes after that, 249 mL of Aqueous Solution Ag-4 and Aqueous Solution X-4 were added by the double jet method. In this operation, Aqueous Solution Ag-4 was added at a constant flow rate over 16 minute, and the addition of Aqueous Solution X-4 was performed so that pAg should be kept at 9.10.

(Addition 6)

For subsequent 10 minutes, the addition was performed so that pAg of the bulk emulsion in the reaction vessel should be kept at 7.5.

Subsequently, the grains were desalted by a conventional flocculation method, and then added with water, NaOH and alkali-treated osseine gelatin with stirring, and pH and pAg were adjusted to 5.8 and 8.9, respectively, at 56° C.

The obtained grains consisted of tabular silver halide grains having a diameter of 1.0 μm as circle, grain thickness of 0.10 μm, average AgI content of 3.94 mol %, (111) faces as parallel main planes and variation coefficient of 24% for the diameters as circles of the total grains.

<<Preparation of Coating Solutions>>

The silver halide photographic light-sensitive materials prepared in this example had a structure where UL layer, emulsion layer, lower protective layer and upper protective layer were formed in this order on one surface of a polyethylene terephthalate film support mentioned below having moisture proof undercoat layers comprising vinylidene chloride on the both surfaces, and an electroconductive layer and back layer were formed in this order on the opposite surface.

Compositions of coating solutions used for forming the layers are shown below.

| | |
|---|---|
| Coating solution for UL layer | |
| Gelatin | 0.5 g/m$^2$ |
| Polyethyl acrylate latex | 150 mg/m$^2$ |
| Compound (Cpd-7) | 40 mg/m$^2$ |
| Compound (Cpd-14) | 10 mg/m$^2$ |
| Antiseptic (Proxcel, ICI) | 1.5 mg/m$^2$ |
| Coating solution for emulsion layer | |
| Emulsion | Amount shown in Table 2 |
| Compound of Type (i), (ii), (iii) or (iv) | Amount shown in Table 2 |
| Sensitizing dye (SD-1) | $5.7\times10^{-4}$ mol/Ag mol |
| KBr | $3.4\times10^{-4}$ mol/Ag mol |
| Compound (Cpd-1) | $2.0\times10^{-4}$ mol/Ag mol |
| Compound (Cpd-2) | $2.0\times10^{-4}$ mol/Ag mol |
| Compound (Cpd-3) | $8.0\times10^{-4}$ mol/Ag mol |
| 4-Hydroxy-6-methyl-1,3,3a,7-tetrazaindene | $1.2\times10^{-4}$ mol/Ag mol |
| Hydroquinone | $1.2\times10^{-2}$ mol/Ag mol |
| Citric acid | $3.0\times10^{-4}$ mol/Ag mol |
| Hydrazine compound (compound shown in Table 2) | Amount shown in Table 2 |
| Nucleation accelerator (Cpd-5) | $5.0\times10^{-4}$ mol/Ag mol |
| 2,4-Dichloro-6-hydroxy-1,3,5-triazine sodium salt | 90 mg/m$^2$ |
| Aqueous latex (Cpd-6) | 100 mg/m$^2$ |
| Polyethyl acrylate latex | 150 mg/m$^2$ |
| Colloidal silica (particle size: 10 nm) | 15 weight % as for gelatin |
| Compound (Cpd-7) | 4 weight % as for gelatin |
| Latex of copolymer of methyl acrylate, 2-acrylamido-2-methypropanesulfonic acid sodium salt and 2-acetoxyethyl methacrylate (weight ratio = 88:5:7) | 150 mg/m$^2$ |
| Core/shell type latex (core: styrene/butadiene copolymer (weight ratio = 37/63), shell: styrene/2-acetoxyethyl acrylate copolymer (weight ratio = 84/16), core/shell ratio = 50/50) | 150 mg/m$^2$ |

pH of the coating solution was adjusted to 5.6 by using citric acid.

The coating solution for emulsion layer prepared as described above was coated on the support mentioned below so that the coated silver amount and coated gelatin amount should become the amounts mentioned in Table 2.

| Coating solution for lower protective layer | |
|---|---|
| Gelatin | 0.5 g/m$^2$ |
| Non-photosensitive silver halide grains (type shown in Table 2) | 0.1 g/m$^2$ as silver amount |
| compound (Cpd-12) | 15 mg/m$^2$ |
| 1,5-Dihydroxy-2-benzaldoxime | 10 mg/m$^2$ |
| Polyethyl acrylate latex | 150 mg/m$^2$ |
| Compound (Cpd-13) | 3 mg/m$^2$ |
| Compound (Cpd-20) | 5 mg/m$^2$ |
| Antiseptic (Proxcel, ICI) | 1.5 mg/m$^2$ |
| Coating solution for upper protective layer | |
| Gelatin | 0.3 g/m$^2$ |

-continued

| | |
|---|---|
| Amorphous silica matting agent (average particle size: 3.5 $\mu$m) | 25 mg/m$^2$ |
| Compound (Cpd-B) (gelatin dispersion) | 20 mg/m$^2$ |
| Colloidal silica (particle size: 10–20 nm, Snowtex C, Nissan Chemical) | 30 mg/m$^2$ |
| Compound (Cpd-9) | 50 mg/m$^2$ |
| Sodium dodecylbenzenesulfonate | 20 mg/m$^2$ |
| Compound (Cpd-10) | 20 mg/m$^2$ |
| Compound (Cpd-11) | 20 mg/m$^2$ |
| Antiseptic (Proxcel, ICI) | 1 mg/m$^2$ |

Viscosity of the coating solutions for the layers was adjusted by adding Thickener Z mentioned below.

Thickener Z

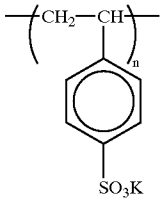

| Coating solution for back layer | |
|---|---|
| Gelatin | 3.3 g/m$^2$ |
| Compound (Cpd-15) | 40 mg/m$^2$ |
| Compound (Cpd-16) | 20 mg/m$^2$ |
| Compound (Cpd-17) | 90 mg/m$^2$ |
| Compound (Cpd-18) | 40 mg/m$^2$ |
| Compound (Cpd-19) | 26 mg/m$^2$ |
| 1,3-Divinylsulfonyl-2-propanol | 60 mg/m$^2$ |
| Polymethyl methacrylate microparticles (mean particle sizes: 6.5 $\mu$m) | 30 mg/m$^2$ |
| Liquid paraffin | 78 mg/m$^2$ |
| Compound (Cpd-7) | 120 mg/m$^2$ |
| Compound (Cpd-20) | 5 mg/m$^2$ |
| Colloidal silica (particle size: 10 nm) | 15 weight % as for gelatin |
| Calcium nitrate | 20 mg/m$^2$ |
| Antiseptic (Proxcel, ICI) | 12 mg/m$^2$ |
| Coating solution for electroconductive layer | |
| Gelatin | 0.1 g/m$^2$ |
| Sodium dodecylbenzenesulfonate | 20 mg/m$^2$ |
| $SnO_2$/Sb (weight ratio = 9:1, average particle size: 0.25 $\mu$m) | 200 mg/m$^2$ |
| Antiseptic (Proxcel, ICI) | 0.3 mg/m$^2$ |

SD-1

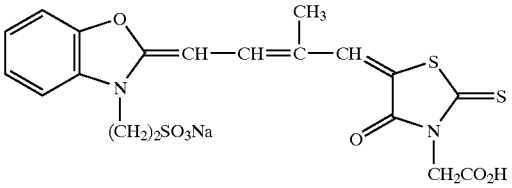

Cpd-1

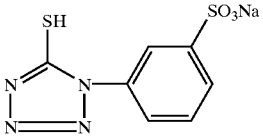

-continued
Thickener Z
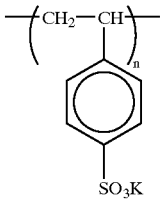
Cpd-2
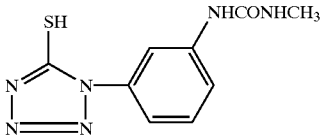
Cpd-3
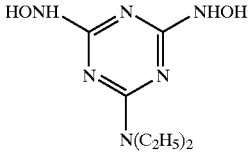
Cpd-4
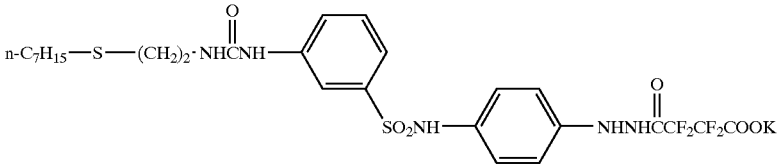
Cpd-5
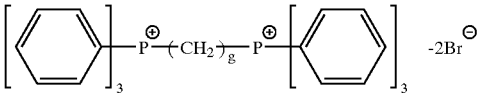
cpd-6
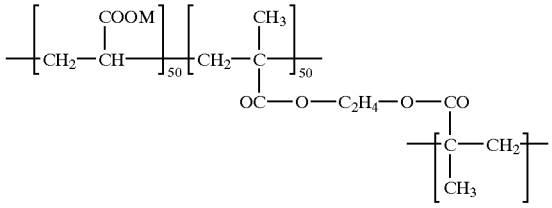
M = H or Na
Cpd-7
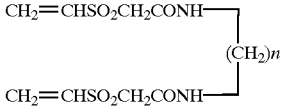
(n = 2):(n = 3) = 3:1
Cpd-14
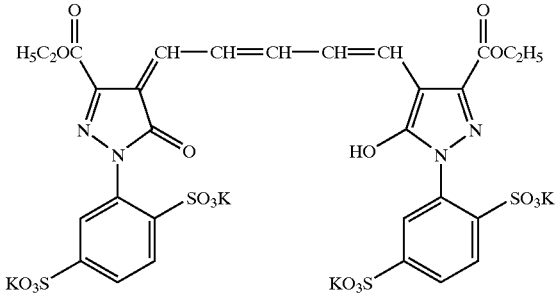

-continued
Thickener Z
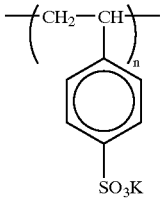
Cpd-15
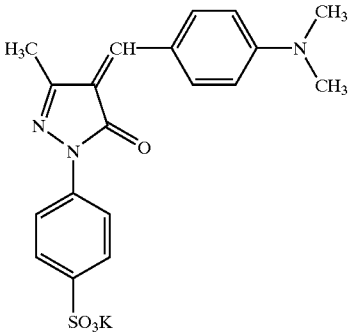
Cpd-16
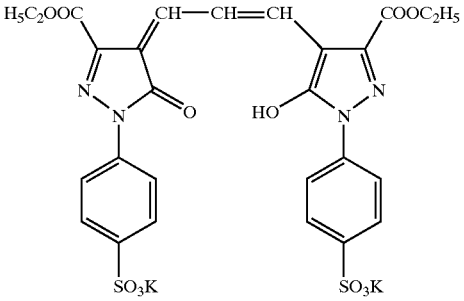
Cpd-17
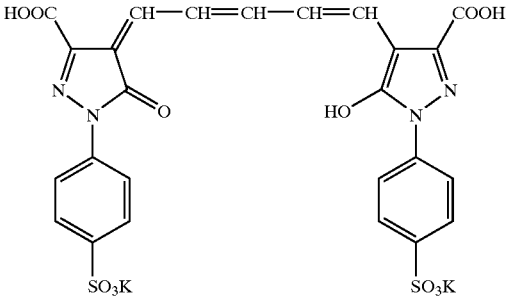
Cpd-18 $CH_3(CH_2)_{11}CH{=}CHSO_3Na$
Cpd-19 $CH_3(CH_2)_{11}CH_2{-}CHSO_3Na$
Cpd-20
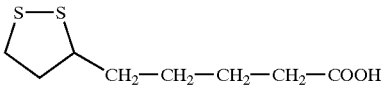
Cpd-8
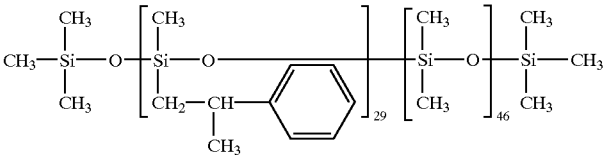

-continued

Thickener Z

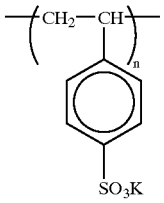

Cpd-9

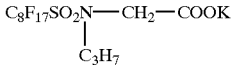

Cpd-10

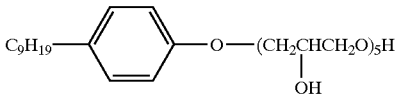

Cpd-11

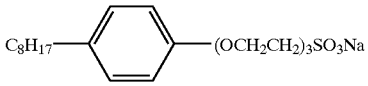

Cpd-12

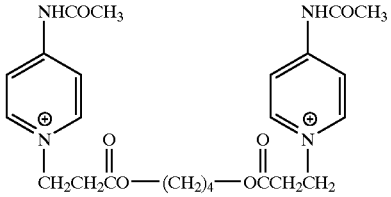

Cpd-13

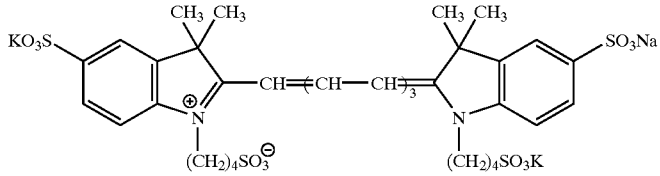

<<Support>>

On both surfaces of a biaxially stretched polyethylene terephthalate support (thickness: 100 μm), coating solutions for first undercoat layer and second undercoat layer having the following compositions were coated.

| Coating solution for first undercoat layer | |
|---|---|
| Core/shell type vinylidene chloride copolymer (i) | 15 g |
| 2,4-Dichloro-6-hydroxy-s-triazine | 0.25 g |
| Polystyrene microparticles (mean particle size: 3 μm) | 0.05 g |
| Compound (Cpd-21) | 0.20 g |
| Colloidal silica (particle size: 70–100 nm Snowtex ZL, Nissan Chemical,) | 0.12 g |
| Water | Amount making total amount 100 g |

The coating solution was adjusted to pH 6 by further addition of 10 weight % of KOH and coated so that a dry thickness of 0.9 μm should be obtained after drying at a drying temperature of 180° C. for 2 minutes.

| Coating solution for second undercoat layer | |
|---|---|
| Gelatin | 1 g |
| Methylcellulose | 0.05 g |
| Compound (Cpd-22) | 0.02 g |
| $C_{12}H_{25}O\ (CH_2CH_2O)_{10}H$ | 0.03 g |
| Antiseptic (Proxcel, ICI) | $3.5 \times 10^{-3}$ g |
| Acetic acid | 0.2 g |
| Water | Amount making total amount 100 g |

This coating solution was coated so that a dry thickness of 0.1 μm should be obtained after drying at a drying temperature of 170° C. for 2 minutes.

Core/shell type vinylidene chloride copolymer (i)

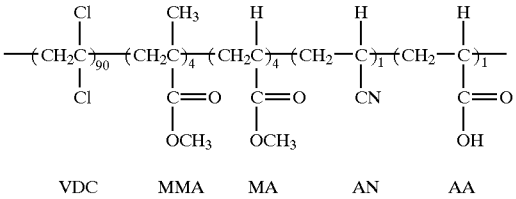

VDC MMA MA AN AA

Core: VDC/MMA/MA (80 weight %)
Shell: VDC/AN/AA (20 weight %)
Average particle size: 70 nm Compound (Cpd-21)

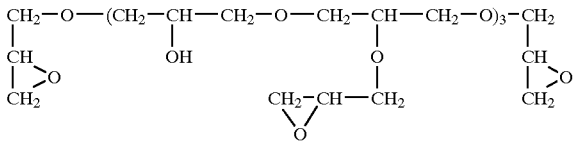

Compound (Cpd-22)

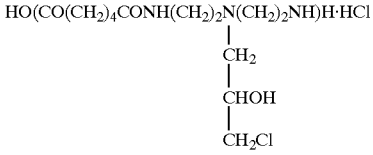

<Method for Coating on Support>>

First, on the aforementioned support coated with the undercoat layers, as the emulsion layer side, four layers of UL layer, emulsion layer, lower protective layer and upper protective layer were simultaneously coated as stacked layers in this order from the support at 35° C. by the slide bead coating method while adding a hardening agent solution and passed through a cold wind setting zone (5° C.). Then, on the side opposite to the emulsion layer side, an electroconductive layer and a back layer were simultaneously coated as stacked layers in this order from the support by the curtain coating method while adding a hardening agent solution, and passed through a cold wind setting zone (5° C.). After the coated support was passed through each setting zone, the coating solutions showed sufficient setting. Subsequently, the support coated with the layers was dried for the both surfaces in a drying zone of the drying conditions mentioned below. The coated support was transported without any contact with rollers and the other members after the coating of the back surface until it was rolled up. The coating speed was 200 m/min.

<<Drying Conditions>>

After the setting, the coated layers were dried with a drying wind at 30° C. until the water/gelatin weight ratio became 800%, and then with a drying wind at 35° C. and relative humidity of 30% for the period where the ratio became 200% from 800%. The coated layers were further blown with the same wind, and 30 second after the point where the surface temperature became 34° C. (regarded as completion of drying), the layers were dried with air at 48° C. and relative humidity of 2% for 1 minute. In this operation, the drying time was 50 seconds from the start to the water/gelatin ratio of 800%, 35 seconds from 800% to 200% of the ratio, and 5 seconds from 200% of the ratio to the end of the drying.

This silver halide photographic light-sensitive material was rolled up at 25° C. and relative humidity of 55%, cut under the same environment, conditioned for moisture content at 25° C. and relative humidity of 50% for 8 hours and then sealed in a barrier bag conditioned for moisture content for 6 hours together with a cardboard conditioned for moisture content at 25° C. and relative humidity of 50% for 2 hours to prepare each of Sample 1 to 26 mentioned in Table 2.

Humidity in the barrier bag was measured and found to be 45%. The obtained samples had a film surface pH of 5.5–5.8 for the emulsion layer side and 6.0–6.5 for the back side. Absorption spectra of the emulsion layer side and back layer side are shown in FIG. 1.

<<Light Exposure and Development>>

Each of the obtained samples was exposed with xenon flash light for an emission time of $10^{-6}$ second through an interference filter having a peak at 667 nm and a step wedge.

Then, each sample was processed at 35° C. for 30 seconds by using a developer (ND-1, Fuji Photo Film Co., Ltd.), a fixer (NF-1, Fuji Photo Film Co., Ltd.) and an automatic developing machine (FG-680AG, Fuji Photo Film Co., Ltd.).

<<Evaluation>>

Sensitivity, gradation (gamma), practice density and storage stability of the samples were measured by the methods described below.

(Sensitivity)

Sensitivity was represented with a reciprocal of exposure giving a density of fog +1.5 as a relative value based on the sensitivity of Sample No. 1, which was taken as 100. A larger value means higher sensitivity.

(Gamma)

A characteristic curve drawn in orthogonal coordinates of optical density (y-axis) and common logarithm of light exposure (x-axis) using equal unit lengths for the both axes is prepared, and inclination of a straight line connecting two points on the curve corresponding to optical densities of 0.3 and 3.10 was determined as gamma.

(Practice Density)

Test steps were outputted by using an image setter (RC5600V, Fuji Photo Film Co., Ltd.) at 175 lines/inch with changing the light quantity and developed under the conditions described above. The exposure was performed at an LV value giving 50% of medium half tone dots, and density of a Dmax portion was measured as practice density. The half tone % and the practice density were measured by using a densitometer (Macbeth TD904).

(Storage Stability of Silver Halide Photographic Light-sensitive Material)

The samples produced as shown in Table 2 were subjected to a forced storage condition test. As for the storage conditions, each sample was stored for 5 days under the conditions of 50° C. and relative humidity of 50%, and evaluated by sensitometry to determine sensitivity S1.5 (Thermo). Variation in the sensitivity (ΔS1.5) from sensitivity of a corresponding sample not subjected to the forced storage condition test (S1.5 (Fr)) was calculated in accordance with the equation mentioned below and represented in terms of percentage.

$$\Delta S1.5=(S1.5(\text{Thermo})-S1.5(\text{Fr}))/S1.5(\text{Fr})\times 100$$

The value of sensitivity variation (ΔS1.5) becomes positive when the sensitivity increases, and conversely becomes negative when the sensitivity decreases. A smaller value is more desirable, and it is required to be 25% or less as an absolute value for practical use. It is more preferably 10% or less as an absolute value.

The results of these evaluations are summarized in Table 2. From the results shown in Table 2, it can be seen that the samples satisfying the requirements of the present invention showed high sensitivity and high practice density and were excellent in the storability.

TABLE 1

| Emulsion | Halogen composition | Grain size (μm) | Heavy metal Type | Amount (mol/Ag mol) | Type | Amount (mol/Ag mol) | Type | Amount (mol/Ag mol) |
|---|---|---|---|---|---|---|---|---|
| A | $AgBr_{30}Cl_{69.9}I_{0.1}$ | 0.22 | $(NH_4)_3[RhCl_5(H_2O)]$ | $2 \times 10^{-7}$ | $K_3IrCl_6$ | $6 \times 10^{-7}$ | $K_4[Fe(CN)_6].3\ H_2O$ | $2 \times 10^{-5}$ |
| B | $AgBr_{30}Cl_{69.9}I_{0.1}$ | 0.18 | $(NH_4)_3[RhCl_5(H_2O)]$ | $5 \times 10^{-7}$ | $K_3IrCl_6$ | $6 \times 10^{-7}$ | $K_4[Fe(CN)_6].3\ H_2O$ | $3 \times 10^{-5}$ |
| C | $AgBr_{30}Cl_{69.9}I_{0.1}$ | 0.23 | $(NH_4)_3[RhCl_5(H_2O)]$ | $6 \times 10^{-7}$ | $K_3IrCl_6$ | $6 \times 10^{-7}$ | $K_4[Fe(CN)_6].3\ H_2O$ | $2 \times 10^{-5}$ |
| D | $AgBr_{45}Cl_{54.9}I_{0.1}$ | 0.22 | $(NH_4)_3[RhCl_5(H_2O)]$ | $6 \times 10^{-7}$ | $K_3IrCl_6$ | $6 \times 10^{-7}$ | $K_4[Fe(CN)_6].3\ H_2O$ | $2 \times 10^{-5}$ |
| E | $AgBr_{55}Cl_{44.9}I_{0.1}$ | 0.21 | $(NH_4)_3[RhCl_5(H_2O)]$ | $3 \times 10^{-7}$ | $K_3IrCl_6$ | $6 \times 10^{-7}$ | $K_4[Fe(CN)_6].3\ H_2O$ | $2 \times 10^{-5}$ |
| F | $AgBr_{70}Cl_{29.9}I_{0.1}$ | 0.20 | $(NH_4)_3[RhCl_5(H_2O)]$ | $2 \times 10^{-7}$ | $K_3IrCl_6$ | $6 \times 10^{-7}$ | $K_4[Fe(CN)_6].3\ H_2O$ | $2 \times 10^{-5}$ |
| G | $AgBr_{99.9}I_{0.1}$ | 0.185 | $(NH_4)_3[RhCl_5(H_2O)]$ | $1.3 \times 10^{-7}$ | $K_3IrCl_6$ | $6 \times 10^{-7}$ | $K_4[Fe(CN)_6].3\ H_2O$ | $2 \times 10^{-5}$ |
| H | $AgBr_{70}Cl_{29.9}I_{0.1}$ | 0.20 | $K[IrCl_5(NO)]$ | $2 \times 10^{-7}$ | $K_3IrCl_6$ | $6 \times 10^{-7}$ | $K_4[Fe(CN)_6].3\ H_2O$ | $2 \times 10^{-5}$ |
| I | $AgBr_{70}Cl_{29.9}I_{0.1}$ | 0.20 | $K_2[RuCl_5(NO)]$ | $2 \times 10^{-7}$ | $K_3IrCl_6$ | $6 \times 10^{-7}$ | $K_4[Fe(CN)_6].3\ H_2O$ | $2 \times 10^{-5}$ |
| J | $AgBr_{70}Cl_{29.9}I_{0.1}$ | 0.20 | $K_2[RuCl_5(H_2O)]$ | $3 \times 10^{-7}$ | $K_3IrCl_6$ | $6 \times 10^{-7}$ | $K_4[Fe(CN)_6].3\ H_2O$ | $2 \times 10^{-5}$ |

TABLE 2

| Sample No. | Emulsion | Emulsion layer Silver amount ($g/m^2$) | Emulsion layer Gelatin amount ($g/m^2$) | Non-photo sensitive silver halide emulsion | Hydrazine compound Type | Hydrazine compound Amount (mol/Agmol) | Compound of Types (I)-(iv) Type | Compound of Types (I)-(iv) Amount (mol/Agmol) | Photographic property Sensitivity | Photographic property Gradation (γ) | Photographic property Practice density | Storability Sensitivity variation (ΔS1.5) | Note |
|---|---|---|---|---|---|---|---|---|---|---|---|---|---|
| 1 | A | 3.4 | 1.4 | 1 | — | — | — | — | 100 | 8.7 | 3.9 | 38% | Comparative |
| 2 | A:B = 1:2 (molar ratio of silver) | 3.4 | 1.4 | 1 | — | — | — | — | 101 | 7.3 | 3.7 | 33% | Comparative |
| 3 | A:B = 1:4 (molar ratio of silver) | 3.4 | 1.4 | 1 | — | — | — | — | 99 | 4.7 | 3.4 | 26% | Comparative |
| 4 | A:B = 1:10 (molar ratio of silver) | 3.4 | 1.4 | 1 | — | — | — | — | 98 | 4.0 | 3.0 | 22% | Comparative |
| 5 | B | 3.4 | 1.4 | 1 | — | — | — | — | 62 | 9.1 | 4.4 | 15% | Comparative |
| 6 | B | 3.4 | 1.4 | 1 | — | — | 1 | $2 \times 10^{-6}$ | 101 | 9.0 | 4.3 | 13% | Invention |
| 7 | B | 3.4 | 1.4 | 1 | — | — | 20 | $3 \times 10^{-6}$ | 98 | 8.9 | 4.2 | 12% | Invention |
| 8 | B | 3.4 | 1.4 | 1 | — | — | 36 | $3 \times 10^{-6}$ | 102 | 8.8 | 4.1 | 13% | Invention |
| 9 | B | 3.4 | 1.4 | 1 | — | — | 45 | $3 \times 10^{-6}$ | 101 | 9.1 | 4.3 | 16% | Invention |
| 10 | A | 3.4 | 1.4 | 1 | cpd-4 | $1.2 \times 10^{-4}$ | — | — | 146 | 25.1 | 5.3 | 65% | Comparative |
| 11 | A:B = 1:2 (molar ratio of silver) | 3.4 | 1.4 | 1 | cpd-4 | $1.2 \times 10^{-4}$ | — | — | 144 | 22.6 | 5.0 | 60% | Comparative |
| 12 | B | 3.4 | 1.4 | 1 | cpd-4 | $1.2 \times 10^{-4}$ | — | — | 88 | 22.1 | 5.3 | 26% | Comparative |
| 13 | F | 3.4 | 1.4 | 1 | cpd-4 | $1.2 \times 10^{-4}$ | — | — | 85 | 25.3 | 5.2 | 26% | Comparative |
| 14 | A | 3.4 | 1.4 | 1 | cpd-4 | $1.2 \times 10^{-4}$ | 1 | $2 \times 10^{6}$ | 162 | 25.3 | 5.2 | 22% | Invention |
| 15 | B | 3.4 | 1.4 | 1 | cpd-4 | $1.2 \times 10^{-4}$ | 1 | $2 \times 10^{6}$ | 150 | 25.4 | 5.5 | 12% | Invention |
| 16 | F | 3.4 | 1.4 | 1 | cpd-4 | $1.2 \times 10^{-4}$ | 1 | $2 \times 10^{6}$ | 148 | 24.9 | 5.4 | 14% | Invention |
| 17 | F | 3.4 | 1.4 | 1 | cpd-4 | $1.2 \times 10^{-4}$ | 20 | $3 \times 10^{6}$ | 152 | 26.4 | 5.3 | 11% | Invention |
| 18 | F | 3.4 | 1.4 | 1 | cpd-4 | $1.2 \times 10^{-4}$ | 36 | $3 \times 10^{6}$ | 149 | 29.2 | 5.5 | 10% | Invention |
| 19 | F | 3.4 | 1.4 | 1 | cpd-4 | $1.2 \times 10^{-4}$ | 45 | $3 \times 10^{6}$ | 146 | 28.3 | 5.7 | 11% | Invention |
| 20 | B | 2.7 | 1.2 | 1 | cpd-4 | $1.2 \times 10^{-4}$ | 1 | $2 \times 10^{6}$ | 150 | 25.3 | 4.6 | 10% | Invention |
| 21 | C | 2.7 | 1.2 | 1 | cpd-4 | $1.2 \times 10^{-4}$ | 1 | $2 \times 10^{6}$ | 152 | 28.2 | 4.5 | 11% | Invention |
| 22 | D | 2.7 | 1.2 | 1 | cpd-4 | $1.2 \times 10^{-4}$ | 1 | $2 \times 10^{6}$ | 148 | 22.9 | 4.4 | 11% | Invention |
| 23 | E | 2.7 | 1.2 | 1 | cpd-4 | $1.2 \times 10^{-4}$ | 1 | $2 \times 10^{6}$ | 144 | 28.3 | 4.8 | 10% | Invention |
| 24 | F | 2.7 | 1.2 | 1 | cpd-4 | $1.2 \times 10^{-4}$ | 1 | $2 \times 10^{6}$ | 151 | 21.6 | 4.6 | 13% | Invention |
| 25 | G | 2.7 | 1.2 | 1 | cpd-4 | $1.2 \times 10^{-4}$ | 1 | $2 \times 10^{6}$ | 152 | 26.2 | 4.7 | 14% | Invention |
| 26 | H | 2.7 | 1.2 | 1 | cpd-4 | $1.2 \times 10^{-4}$ | 1 | $2 \times 10^{6}$ | 150 | 24.5 | 4.5 | 12% | Invention |
| 27 | I | 2.7 | 1.2 | 1 | cpd-4 | $1.2 \times 10^{-4}$ | 1 | $2 \times 10^{6}$ | 153 | 25.1 | 4.4 | 11% | Invention |
| 28 | J | 2.7 | 1.2 | 2 | cpd-4 | $1.2 \times 10^{-4}$ | 1 | $2 \times 10^{6}$ | 154 | 25.7 | 4.3 | 10% | Invention |
| 29 | F | 2.7 | 1.2 | 3 | cpd-4 | $1.2 \times 10^{-4}$ | 1 | $2 \times 10^{6}$ | 152 | 25.2 | 4.5 | 12% | Invention |
| 30 | F | 2.7 | 1.2 | 1 | cpd-4 | $1.2 \times 10^{-4}$ | 1 | $2 \times 10^{6}$ | 150 | 23.9 | 4.4 | 13% | Invention |
| 31 | F | 2.7 | 1.2 | 1 | D-68 | $2.2 \times 10^{-4}$ | 1 | $2 \times 10^{6}$ | 146 | 24.6 | 4.3 | 14% | Invention |
| 32 | F | 2.7 | 1.2 | 1 | D-128 | $3.0 \times 10^{-4}$ | 1 | $2 \times 10^{6}$ | 143 | 22.9 | 4.5 | 13% | Invention |

EXAMPLE 2

Samples were prepared in the same manner as in Example 1 except that carboxymethyltrimethythiourea compound or dicarboxymethyldimethylthiourea, which is a tetra-substituted thiourea compound, was used instead of the sodium thiosulfate used for chemical sensitization of Emulsion A in the same molar amount as sodium thiosulfate. The samples having the characteristics of the present invention showed good performances as in Example 1.

EXAMPLE 3

The same experiment as that of Example 1 was performed by using Developer (A) and Fixer (B) mentioned below. As a result, the samples having the characteristics of the present invention showed good performances as in Example 1.

| Developer (A) [composition per liter of concentrated solution] | |
|---|---|
| Potassium hydroxide | 60.0 g |
| Diethylenetriaminepentaacetic acid | 3.0 g |
| Potassium carbonate | 90.0 g |
| Sodium metabisulfite | 105.0 g |
| Potassium bromide | 10.5 g |
| Hydroquinone | 60.0 g |
| 5-Methylbenzotriazole | 0.53 g |
| 4-Hydroxymethyl-4-methyl-1-phenyl-3-pyrazolidone | 2.3 g |
| Sodium 3-(5-mercaptotetrazol-1-yl)-benzenesulfonate | 0.15 g |
| Sodium 2-mercaptobenzimidazole-5-sulfonate | 0.45 g |
| Sodium erysorbate | 9.0 g |
| Diethylene glycol | 60.0 g |
| pH 10.79 | |

Upon use, a mother solution was prepared by diluting 2 parts of the above concentrated solution with 1 part of water. The mother solution showed pH of 10.65. A replenisher was prepared by diluting 4 parts of the above concentrated solution with 3 part of water. The replenisher showed pH of 10.62.

| Fixer (B) [composition per liter of concentrated solution] | |
|---|---|
| Ammonium thiosulfate | 360 g |
| Disodium ethylenediaminetetraacetate dihydrate | 0.09 g |
| Sodium thiosulfate pentahydrate | 33.0 g |
| Sodium metasulfite | 57.0 g |
| Sodium hydroxide | 37.2 g |
| Acetic acid (100%) | 90.0 g |
| Tartaric acid | 8.7 g |
| Sodium gluconate | 5.1 g |
| Aluminum sulfate | 25.2 g |
| pH 4.85 | |

Upon use, 1 part of the above concentrated solution was diluted with 2 parts of water. pH of the solution used was 4.8.

EXAMPLE 4

The same experiment as that of Example 1 was performed by using Solid Developer (C) and Solid Fixer (D) mentioned below. As a result, the samples having the characteristics of the present invention showed good performances as in Example 1.

| Solid developer (C) | |
|---|---|
| Sodium hydroxide (beads, 99.5%) | 11.5 g |
| Potassium sulfite (bulk powder) | 63.0 g |
| Sodium sulfite (bulk powder) | 46.0 g |
| Potassium carbonate | 62.0 g |
| Hydroquinone (briquettes) | 40.0 g |

Together with the following components, briquettes were prepared.

| | |
|---|---|
| Diethylenetriaminepentaacetatic acid | 2.0 g |
| 5-Methylbenzotriazole | 0.35 g |
| 4-Hydroxymethyl-4-methyl-1-phenyl-3-pyrazolidone | 1.5 g |
| 4-(N-Carboxymethyl-N-methylamino)-2,6-dimercaptopyrimidine | 0.2 g |
| Sodium 3-(5-mercaptotetrazol-1-yl)-benzenesulfonate | 0.1 g |
| Sodium erysorbate | 6.0 g |
| Potassium bromide | 6.6 g |

The briquettes were dissolved in water to a volume of 1 L (pH 10.65).

As for forms of the raw materials, bulk powder means an industrial product itself, and as the beads of alkali metal salt, a marketed product was used.

As for the raw material in the form of briquette, it was made into a plate by compression with pressure using a briquetting machine and the plate was crushed and used. The components used in small amounts were blended before the production of briquettes.

The above processing agents in amounts for 10 L were filled in foldable high density polyethylene containers, and takeout ports were sealed with aluminum seals. For dissolution and replenishment, a dissolution and replenishment apparatus provided with an automatic opening mechanism was used, which is disclosed in JP-A-80718 and JP-A-9-138495.

| Solid Fixer (D) | |
|---|---|
| Agent A (solid) | |
| Ammonium thiosulfate (compact) | 125.0 g |
| Anhydrous sodium thiosulfate (bulk powder) | 19.0 g |
| Sodium metabisulfite (bulk powder) | 18.0 g |
| Anhydrous sodium acetate (bulk powder) | 42.0 g |
| Agent B (liquid) | |
| Disodium ethylenetriaminetetraacetate dihydrate | 0.03 g |
| Tartaric acid | 2.9 g |
| Sodium gluconate | 1.7 g |
| Aluminum sulfate | 8.4 g |
| Sulfuric acid | 2.1 g |

These were dissolved in water to a volume of 50 mL.

Agent A and Agent B were dissolved in water to a volume of 1 L and used as Fixer (D).

pH was 4.8.

As the ammonium thiosulfate (compact), flakes produced by the spray drying method were compressed with pressure using a roller compacter, crushed into chips of irregular forms having a size of 4–6 mm and used by blending with the anhydrous sodium thiosulfate. As for the other bulk powders, usual industrial products were used.

Agents A and B in amounts for 10 L were filled in foldable high density polyethylene containers, and takeout port of the container for Agent A was sealed with aluminum seal. Takeout port of the container for Agent B was stopped with a screw cap. For dissolution and replenishment, a dissolution and replenishment apparatus provided with an automatic opening mechanism was used, which is disclosed in JP-A-80718 and JP-A-9-138495.

EXAMPLE 5

The same experiment as that of Example 1 was performed except that Developer (E) mentioned below was used instead of Developer (A) used in Example 1. As a result, the samples having the characteristics of the present invention showed good performances as in Example 1.

| Developer (E) [composition per liter of concentrated solution] | |
|---|---|
| Potassium hydroxide | 105.0 g |
| Diethylenetriaminepentaacetic acid | 6.0 g |
| Potassium carbonate | 120.0 g |
| Sodium metabisulfite | 120.0 g |
| Potassium bromide | 9.0 g |
| Hydroquinone | 75.0 g |
| 5-Methylbenzotriazole | 0.25 g |
| 4-Hydroxymethyl-4-methyl-1-phenyl-3-pyrazolidone | 1.35 g |
| 4-(N-Carboxymethyl-N-methylamino)-2,6-dimercaptopyrimidine | 0.3 g |
| Sodium 2-mercaptobenzimidazole-5-sulfonate | 0.45 g |
| Sodium erysorbate | 9.0 g |
| Diethylene glycol | 60.0 g |
| pH 10.7 | |

Upon use, 1 part of the above concentrated solution was diluted with 2 parts of water. The solution used showed pH of 10.5.

EXAMPLE 6

Twenty sheets per day of scanner film HL (Fuji Photo Film Co., Ltd.) in the Daizen size (50.8×61.0 cm) blackened for 20% were processed by using the developer ND-1 mentioned in Example 1 with replenishing the used solution in an amount of 50 mL per one sheet of Daizen size. This daily operation was performed for 6 days in a week, and this running was continued for 15 weeks. When a small amount of films were processed as described above, a developer in which the sulfite concentration was decreased to one third was obtained.

Three hundreds sheets per day of scanner film HL (Fuji Photo Film Co., Ltd.) in the Daizen size (50.8×61.0 cm), blackened for 80% were processed by using the developer ND-1 mentioned in Example 1 with replenishing the used solution in an amount of 50 mL per one sheet of Daizen size. This daily operation was performed for continuous 4 days. When a large amount of films were processed as described above, a developer in which pH was lowered to 10.2 and the bromide ion concentration was increased was obtained.

The same experiment as that of Example 1 was performed by using the above exhausted developer or developer in the course of exhaustion. As a result, the samples having the characteristics of the present invention showed good performances as in Example 1.

EXAMPLE 7

When the processing procedures of Examples 1 to 6 were performed at a development temperature of 38° C., fixing temperature of 37° C. and with development time of 20 seconds, results similar to those obtained in Examples 1 to 6 were obtained, and thus the effect of the present invention was not degraded.

EXAMPLE 8

Even when the processing procedures of Examples 1 to 7 were performed with a transportation speed of silver halide photographic light-sensitive materials of 1500 mm/minute as a line speed by using an automatic developing machine, FG-680AS (Fuji Photo Film Co., Ltd.), the samples having the characteristics of the present invention similarly showed good performances.

EXAMPLE 9

When the same evaluations were performed by using, instead of Lux Setter RC-5600V produced by Fuji Photo Film Co., Ltd, any one of Image setter FT-R5055 produced by Dainippon Screen Mfg. Co., Ltd., Select Set 5000, Avantra 25 and Acuset 1000 produced by Agfa Gevaert AG, Dolev 450 and Dolev 800 produced by Scitex, Lino 630, Quasar, Herkules ELITE and Signasetter produced by Heidelberg, Lux Setters Luxel F-9000 and F-6000 produced by Fuji Photo Film Co., and Panther Pro 62 produced by PrePRESS Inc., the samples having the characteristic of the present invention similarly showed good performances.

What is claimed is:

1. A silver halide photographic light-sensitive material comprising at least one silver halide emulsion layer on a support, which contains at least one compound selected from compounds of the following Types (i) to (iv) and has a characteristic curve drawn in orthogonal coordinates of logarithm of light exposure (x-axis) and optical density (y-axis) using equal unit lengths for the both axes, on which gamma is 5.0 or more for the optical density range of 0.3–3.0:

Type (i)

a compound of which one-electron oxidized derivative produced by one electron oxidation of the compound is capable of releasing two or more electrons with a bond cleavage;

Type (ii)

a compound of which one-electron oxidized derivative produced by one electron oxidation of the compound is capable of releasing one more electron with a carbon-carbon bond cleavage, and which has two or more groups adsorptive to silver halide in the molecule;

Type (iii)

a compound of which one-electron oxidized derivative produced by one electron oxidation of the compound is capable of releasing one or more electrons after undergoing a bond formation reaction;

Type (iv)

a compound of which one-electron oxidized derivative produced by one electron oxidation of the compound is capable of releasing one or more electrons after undergoing an intramolecular ring cleavage reaction.

2. The silver halide photographic light-sensitive material according to claim 1, which contains a compound of Type (i).

3. The silver halide photographic light-sensitive material according to claim 1, which contains a compound of Type (ii).

4. The silver halide photographic light-sensitive material according to claim 1, which contains a compound of Type (iii).

5. The silver halide photographic light-sensitive material according to claim 1, which contains a compound of Type (iv).

6. The silver halide photographic light-sensitive material according to claim 1, wherein the compounds of Types (i) to (iv) are compounds represented by following formulas (1-1) to (4-2):

Formula (1-1)

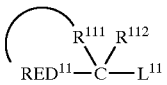

Formula (1-2)

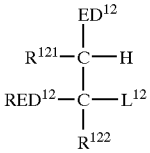

Formula (2)

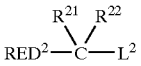

Formula (3)

$RED^3—L^3—Y^3$

Formula (4-1)

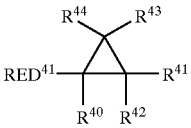

Formula (4-2)

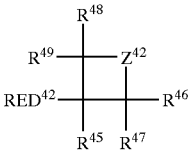

wherein, in the formula (1-1), $RED^{11}$ represents a reducing group, $L^{11}$ represents a leaving group, $R^{112}$ represents a hydrogen atom or a substituent, $R^{111}$ represents a nonmetallic group that can form a ring structure corresponding to a tetrahydro, hexahydro or octahydro derivative of a 5- or 6-membered aromatic ring (including an aromatic heterocyclic ring) together with a carbon atom (C) and $RED^{11}$;

in the formula (1-2), $RED^{12}$ and $L^{12}$ each represent groups having the same meanings as the groups $RED^{11}$ and $L^{11}$ in the formula (1-1), respectively, $R^{121}$ and $R^{122}$ each independently represent a hydrogen atom or a substituent, $ED^{12}$ represents an electron donor group, and $R^{121}$ and $RED^{12}$, $R^{121}$ and $R^{122}$ or $ED^{12}$ and $RED^{12}$ may bond to each other to form a ring structure;

in the formula (2), $RED^2$ represents a group having the same meaning as $RED^{12}$ in the formula (1-2), $L^2$ represents a carboxyl group or a salt thereof, $R^{21}$ and $R^{22}$ each independently represent a hydrogen atom or a substituent, and $RED^2$ and $R^{21}$ may bond to each other to form a ring structure, provided that the compound represented by the formula (2) is a compound having two or more groups adsorptive to silver halide in the molecule;

in the formula (3), $RED^3$ represents a group having the same meaning as $RED^{12}$in the formula (1-2), $Y^3$represents a reactive group containing a carbon-carbon double bond site or carbon-carbon triple bond site that can react with one electron oxidized derivative produced by one electron oxidization of $RED^3$ to form a novel bond, and $L^3$ represents a bridging group bonding $RED^3$ and $Y^3$; and in the formulas (4-1) and (4-2), $RED^{41}$ and $RED^{42}$ each independently represent a group having the same meaning as RED12 in the formula (1-2), and $R^{40}$ to $R^{44}$ and $R^{45}$ to $R^{49}$ each independently represent a hydrogen atom or a substituent, and in the formula (4-2), $Z^{42}$ represents $—CR^{420}R^{421}—$, $—NR^{423}—$ or —O—, $R^{420}$ and $R^{421}$ each independently represent a hydrogen atom or a substituent, and $R^{423}$ represents a hydrogen atom, an alkyl group, an aryl group, or a heterocyclic group.

7. The silver halide photographic light-sensitive material according to claim 6, which contains a compound represented by formula (1-1).

8. The silver halide photographic light-sensitive material according to claim 6, which contains a compound represented by formula (1-2).

9. The silver halide photographic light-sensitive material according to claim 6, which contains a compound represented by formula (2).

10. The silver halide photographic light-sensitive material according to claim 6, which contains a compound represented by formula (3).

11. The silver halide photographic light-sensitive material according to claim 6, which contains a compound represented by formula (4-1).

12. The silver halide photographic light-sensitive material according to claim 6, which contains a compound represented by formula (4-2).

13. The silver halide photographic light-sensitive material according to claim 1, wherein the compounds of Type (i), Type (iii) and Type (iv) have a group adsorptive to silver halide and/or a partial structure of a spectral sensitization dye.

14. The silver halide photographic light-sensitive material according to claim 13, wherein the group adsorptive to silver halide is a mercapto group or a salt thereof, a thione group, a heterocyclic group containing at least one atom selected from a nitrogen atom, sulfur atom, selenium atom and tellurium atom, a sulfide group, a cationic group or an ethynyl group.

15. The silver halide photographic light-sensitive material according to claim 13, wherein the group adsorptive to silver halide is a mercapto-substituted nitrogen-containing heterocyclic group, a dimercapto-substituted heterocyclic group and a nitrogen-containing heterocyclic group having a —NH-group that can form imino silver as a partial structure of the heterocyclic ring.

16. The silver halide photographic light-sensitive material according to claim 13, wherein the group adsorptive to silver halide is 2-mercaptothiadiazole group, 3-mercapto-1,2,4-triazole group, 5-mercaptotetrazole group, 2-mercapto-1,3,4-oxadiazole group, 2-mercaptobenzothiazole group, 1,5-dimethyl-1,2,4-triazolium-3-thiolate group, 2,4-dimercaptopyrimidine group, 2,4-dimercaptotriazine group, 3,5-dimercapto-1,2,4-triazole group, 2,5-dimercapto-1,3-thiazole group, benzotriazol group, benzimidazole group or indazole group.

17. The silver halide photographic light-sensitive material according to claim 1, wherein the compounds of Types (i) to (iv) have an oxidation potential for releasing the first electron is 0.3 V to 1.0 V.

18. The silver halide photographic light-sensitive material according to claim 1, wherein the compounds of Types (i) to (iv) have an oxidation potential for releasing the second releasing electron is −0.9 to −1.6 V.

19. The silver halide photographic light-sensitive material according to claim 1, which contains a hydrazine compound.

20. The silver halide photographic light-sensitive material according to claim 1, which has a film surface pH of 6.0 or lower on the emulsion layer side.

* * * * *